US010553071B2

(12) United States Patent
Arnone et al.

(10) Patent No.: US 10,553,071 B2
(45) Date of Patent: Feb. 4, 2020

(54) SELF-RECONFIGURING WAGERING SYSTEM

(71) Applicant: Gamblit Gaming, LLC, Glendale, CA (US)

(72) Inventors: Miles Arnone, Sherborn, MA (US); Eric Meyerhofer, Pasadena, CA (US); Frank Cire, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

(21) Appl. No.: 15/413,322

(22) Filed: Jan. 23, 2017

(65) Prior Publication Data

US 2017/0278343 A1 Sep. 28, 2017

Related U.S. Application Data

(60) Provisional application No. 62/281,659, filed on Jan. 21, 2016.

(51) Int. Cl.
*G07F 17/32* (2006.01)

(52) U.S. Cl.
CPC ..... *G07F 17/3227* (2013.01); *G07F 17/3251* (2013.01); *G07F 17/3267* (2013.01); *G07F 17/3288* (2013.01); *G07F 17/3295* (2013.01); *G07F 17/3244* (2013.01); *G07F 17/3255* (2013.01); *G07F 17/3262* (2013.01)

(58) Field of Classification Search
CPC .. G07F 17/32; G07F 17/3244; G07F 17/3255; G07F 17/3262; G07F 17/3267
USPC ..... 463/16, 20, 21, 23
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |

(Continued)

OTHER PUBLICATIONS

U.S. Appl. No. 14/205,303 Arnone, et al., filed Mar. 11, 2014.

(Continued)

*Primary Examiner* — Chase E Leichliter
(74) *Attorney, Agent, or Firm* — Frank Cire

(57) ABSTRACT

A self-reconfiguring wagering system is disclosed. The system comprises an interactive controller that communicates with a process controller, determines a skill outcome for two or more skill objectives presented to a user, and communicates to the process controller the skill outcome. A chance-based controller of the system hu communicates with the process controller, generates an ordered set of chance components having one or more chance outcomes using a random number generator and a paytable, and communicates the ordered set of chance components to the process controller. The process controller receives the ordered set of chance components, reorders the ordered set of chance components on the basis of a testing skill outcome and an actual use skill outcome, receives the skill outcome from the interactive controller, and updates one or more credit meters using the skill outcome and the ordered set of chance components.

9 Claims, 27 Drawing Sheets

(56) References Cited

U.S. PATENT DOCUMENTS 6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1* 5/2008 Oberberger ..... G07F 17/32 463/16
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.

(56) References Cited

U.S. PATENT DOCUMENTS

2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1* 9/2011 Bowers ..... G07F 17/32 463/25
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0115581 A1* 5/2012 Englman ..... G07F 17/3258 463/25
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2013/0324222 A1* 12/2013 De Viveiros Ortiz ..... G07F 17/3267 463/25
2014/0087801 A1 3/2014 Nicely et al.
2014/0087808 A1 3/2014 Leandro et al.
2014/0087809 A1 3/2014 Leupp et al.
2014/0087855 A1* 3/2014 Caputo ..... G07F 17/3258 463/26
2014/0274263 A1* 9/2014 Fine ..... G07F 17/3288 463/16
2014/0357350 A1 12/2014 Weingardt et al.
2015/0031426 A1* 1/2015 Alloway ..... A63F 13/67 463/9
2015/0287264 A1* 10/2015 De Viveiros Ortiz ..... G07F 17/3244 463/25
2016/0171827 A1* 6/2016 Washington ..... G07F 17/3227 463/22
2016/0171835 A1* 6/2016 Washington ..... G07F 17/3244 463/25
2017/0228976 A1* 8/2017 Chesworth ..... G07F 17/3227

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.

(56) References Cited

OTHER PUBLICATIONS

U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 15/362,214 Arnone, et al. filed Nov. 28, 2016.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.

(56) References Cited

OTHER PUBLICATIONS

U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.

* cited by examiner

SELF-RECONFIGURING WAGERING SYSTEM

CROSS REFERENCE TO RELATED APPLICATIONS

This application claims the benefit of U.S. Provisional Patent Application No. 62/281,659, filed Jan. 21, 2016, the contents of which are incorporated by reference herein in their entirety.

FIELD OF THE INVENTION

Embodiments of the present invention are generally related to communication within data processing systems. More particularly, the present invention relates to communication within a gaming system.

BACKGROUND

The gaming industry has traditionally developed electronic gaming machines (EGMs) that implement simple wagers. However, more complicated wagering processes need communication and processing systems that are better suited for implementing these more complicated wagering processes. Various aspects of embodiments of the present invention meet such a need.

SUMMARY OF THE INVENTION

Systems and methods in accordance with embodiments of the invention provide a communication and data processing system constructed for a self-reconfiguring wagering system.

In an embodiment of the invention, a combined wagering proposition includes one or more skill propositions and one or more chance propositions. In some embodiments, one or more skill outcomes of the one or more skill propositions are used to allocate one or more chance outcomes of the one or more chance propositions to determine a combined wagering outcome for the combined wagering proposition. In other such embodiments, one or more chance outcomes of the one or more chance propositions are used to allocate one or more skill outcomes of the one or more skill propositions to determine a combined wagering outcome for the combined wagering proposition.

In an embodiment of the invention, a process controller operates as an interface between an interactive controller that determines skill outcomes and a chance-based controller that determines chance outcomes. By virtue of this feature, the chance-based controller is isolated from the interactive controller allowing the interactive controller to operate in an unregulated environment will allowing the chance-based controller to operate in a regulated environment, thus providing for more efficient management of the operations of such a system.

In another embodiment of the invention, a single chance-based controller may provide services to two or more interactive controllers and/or two or more process controllers, thus allowing a self-reconfiguring wagering system to operate more efficiently over a large range of scaling.

In another embodiment of the invention, multiple types of interactive controllers using different operating systems may be interfaced to a single type of process controller and/or chance-based controller without requiring customization of the process controller and/or the chance-based controller, thus improving the efficiency of the process controller and or the chance-based controller by reducing complexity associated with maintaining separate process controllers and/or chance-based controllers for each type of interactive controller.

In another embodiment of the invention, an interactive controller may be provided as a user device under control of a user while maintaining the chance-based controller in an environment under the control of a regulated operator of wagering equipment, thus providing for a more economical system as the regulated operator need not expend capital to purchase interactive controllers.

In another embodiment of the invention, data communicated between the controllers may be encrypted to increase security of the self-reconfiguring wagering system.

In another embodiment of the invention, a process controller isolates chance proposition logic and skill proposition logic as unregulated logic from a regulated chance-based controller, thus allowing errors in the skill proposition logic and/or chance proposition logic to be corrected, new skill proposition logic and/or chance proposition logic to be used, or modifications to be made to the skill proposition logic and/or chance proposition logic without a need for time-consuming regulatory approval.

In another embodiment of the invention, an interactive application may require extensive processing resources from an interactive controller leaving few processing resources for the functions performed by a process controller and/or a chance-based controller. By virtue of an architecture of some embodiments of the invention, processing loads may be distributed across multiple devices such that operations of the interactive controller may be dedicated to the interactive application and the processes of the process controller and/or chance-based controller are not burdened by the requirements of the interactive application.

In another embodiment of the invention, a self-reconfiguring wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like. In many such embodiments, one or more components of a self-reconfiguring wagering system are distributed in close proximity to each other and communicate using a local area network and/or a communication bus. In several embodiments, an interactive controller and a process controller of a self-reconfiguring wagering system are in a common location and communicate with an external chance-based controller. In some embodiments, a process controller and a chance-based controller of a self-reconfiguring wagering system are in a common location and communicate with an external interactive controller. In many embodiments, an interactive controller, a process controller, and a chance-based controller of a self-reconfiguring wagering system are located in a common location. In some embodiments, a session/management controller is located in a common location with a process controller and/or a chance-based controller. In various embodiments, these multiple devices can be constructed from or configured using a single device or a plurality of devices such that a self-reconfiguring wagering system is executed as a system in a virtualized space such as, but not limited to, where a chance-based controller and a process controller are large scale centralized servers in the cloud operatively connected to widely distributed interactive controllers via a wide area network such as the Internet or a local area network. In such embodiments, the components of a self-reconfiguring wagering system may communicate using a networking protocol or other type of device-to-device communications protocol.

In another embodiment of the invention, a centralized chance-based controller is operatively connected to, and communicates with, one or more process controllers using a communication link. The centralized chance-based controller can generate chance outcomes for wagers in accordance with one or more chance-based propositions. The centralized chance-based controller can determine a number of simultaneous or pseudo-simultaneous chance outcomes in accordance with a variety of chance-based propositions that one or more distributed self-reconfiguring wagering systems can use.

In another embodiment of the invention, a centralized process controller is operatively connected to one or more interactive controllers and one or more chance-based controllers using a communication link. The centralized process controller can perform the functionality of a process controller across various self-reconfiguring wagering systems.

In another embodiment of the invention, an interactive application server provides a host for managing head-to-head play operating over a network of interactive controllers connected to the interactive application server using a communication link. The interactive application server provides an environment where users can compete directly with one another and interact with other users.

In many embodiments, a self-reconfiguring electronic gaming machine, includes an interactive controller constructed to communicate with a process controller, wherein the interactive controller is further constructed to: determine a skill outcome for two or more skill objectives presented to a user and communicate to the process controller the skill outcome. The self-reconfiguring electronic gaming machine further includes a chance-based controller constructed to communicate with the process controller, wherein the chance based controller is further constructed to: generate an ordered set of chance components having one or more chance outcomes using a random number generator and a paytable, and communicate the ordered set of chance components to the process controller. The process controller is further constructed to: receive the ordered set of chance components, reorder the ordered set of chance components on the basis of a testing skill outcome and an actual use skill outcome, receive the skill outcome from the interactive controller and update one or more credit meters using the skill outcome and the ordered set of chance components.

In another embodiment, the interactive controller and the process controller are constructed from the same device, and the process controller is operatively connected to the chance-based controller using a communication link.

In some embodiments, the chance-based controller and the process controller are constructed from the same device, and the process controller is operatively connected to the interactive controller using a communication link.

In various embodiments, the self-reconfiguring electronic gaming machine further includes an enclosure constructed to mount: a user input device operatively connected to the interactive controller, a user output device operatively connected to the interactive controller, a credit input device operatively connected to the chance-based controller, and a credit output device operatively connected to the chance-based controller.

In many embodiments, the self-reconfiguring electronic gaming machine of is further constructed to: communicate with the credit input device to receive a credit input, and communicate with the credit output device to generate a credit output based on credits transferred off of the one or more credit meters.

In some embodiments, the interactive controller is further constructed to provide skill-based game to the user and the skill objectives are presented to the user as components of the skill-based game.

In some embodiments, the skill-based game is a virtual pinball game.

In various embodiments, the skill-based game is a catapult game.

In some embodiments, the skill-based game is a multiuser game provided to two or more users.

In many embodiments, the skill-based game is a word creation game.

DETAILED DESCRIPTION

Figure 1:
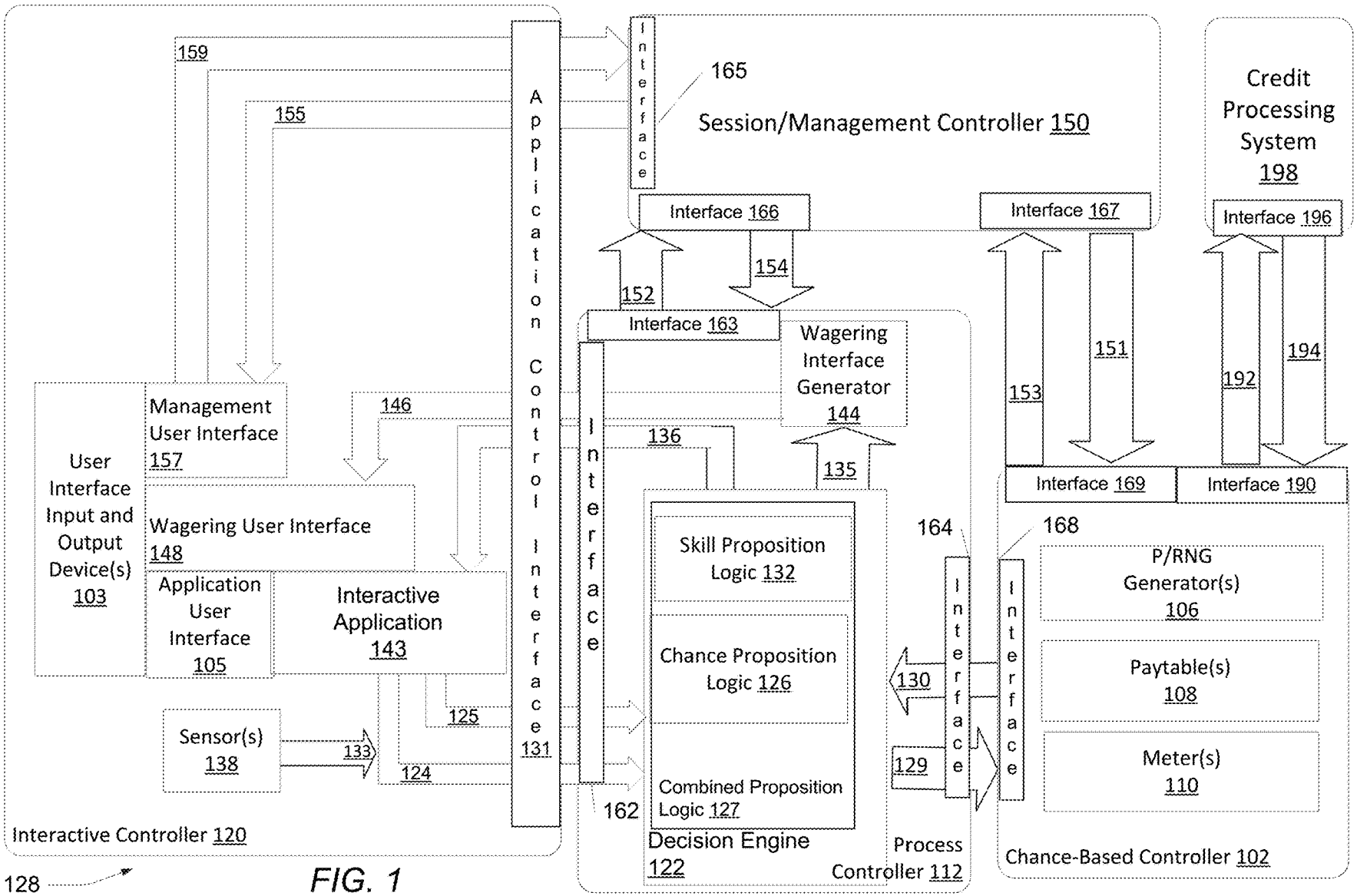
FIG. 1 is a diagram of a structure of a self-reconfiguring wagering system in accordance with various embodiments of the invention.

A self-reconfiguring wagering system allows for the management of a combined wagering proposition having one or more skill propositions combined with one or more chance propositions. In some embodiments of a self-reconfiguring wagering system, an interactive application executed by an interactive controller provides skill proposition components of the self-reconfiguring wagering system. The interactive controller is operatively connected to a process controller that manages and configures the interactive controller and the interactive application, and determines how chance outcomes determined by a chance-based controller should be combined with skill outcomes determined by the interactive application. The process controller is further operatively connected to a chance-based controller that provides the chance outcomes for chance-based propositions.

In some embodiments, the interactive controller also provides a wagering user interface that is used to receive commands and display data for a combined wagering process and combined wagering outcome determined from a chance outcome and a skill outcome in accordance with a combined wagering proposition. The content of the wagering user interface is controlled by the process controller and includes content provided by the chance-based controller and the interactive controller.

In various embodiments, an interactive controller provides a management user interface used to manage a user profile.

Many different types of interactive applications may be utilized with the self-reconfiguring wagering system. In some embodiments, the interactive application reacts to the physical activity of a user. In these embodiments, the interactive application senses user interactions with the interactive application through one or more sensors that monitor the user's physical activities. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors.

In some embodiments, the interactive application implements a skill-based game and interacts with the user by sensing skillful interactions with an interactive display generated by the interactive application.

In some embodiments, the interactive application is a tool used to achieve some useful goal.

In many embodiments, the interactive application generates various types of interactive elements in an interactive application environment. In some embodiments, these interactive elements are interactive application resources utilized within the interactive application environment to provide an interactive experience for a user. Chance outcomes of credits or interactive elements are determined in accordance with a chance-based proposition and initiation of automatic resolution of the chance-based proposition is achieved by interaction with one or more of the interactive elements of the interactive application. Chance outcomes of chance-based propositions of credits or interactive elements can cause consumption, loss or accrual of respective credits and/or interactive elements.

In accordance with some embodiments, chance outcomes of chance-based propositions events can influence interactive elements in the interactive application environment such as, but not limited to, automatically providing one or more new interactive elements, automatically restoring one or more consumed interactive elements, automatically causing the loss of one or more interactive elements, and automatic restoration or placement of one or more fixed interactive elements.

In various embodiments, the chance outcomes may be determined using one or more types of credits.

In some embodiments, credits can be one or more credits that are purchased using, and redeemed in, a real world currency having a real world value.

In many embodiments, credits can be one or more credits in a virtual currency. Virtual currency is an alternate currency that can be acquired, purchased or transferred by or to a user, but does not necessarily directly correlate to a real world currency. In many such embodiments, credits in a virtual currency are allowed to be purchased using a real world currency but are prevented from being redeemed in a real world currency having a real world value.

In several embodiments, interaction with the interactive elements of the interactive application, application credits can be optionally consumed and/or accrued within the interactive application as a result of interaction with the interactive elements. Application credits can be in the form of, but not limited to, application environment credits, experience points, and points generally.

In various embodiments, application credits are awarded on the basis of skillful interactions with the interactive elements of a skill-based interactive application. The skill-based interactive application can have one or more scoring criteria, embedded within a process controller and/or an interactive controller that provides the skill-based interactive application, that can be used to determine user performance against one or more goals of the skill-based interactive application in accordance with a skill proposition.

In many embodiments, application credits can be used to purchase in-application items, including but not limited to, application interactive elements that have particular properties, power ups for existing items, and other item enhancements.

In some embodiments, application credits may be used to earn entrance into a sweepstakes drawing, to earn entrance in a tournament with prizes, to score in the tournament, and/or to participate and/or score in any other game event.

In several embodiments, application credits can be stored on a user-tracking card or in a network-based user tracking system where the application credits are attributed to a specific user.

In many embodiments, a chance-based proposition includes utilization of application credits for a chance outcome of a randomly generated payout of interactive application credits, interactive elements, and/or interactive application objects in accordance with the chance-based proposition.

In a number of embodiments, a chance-based proposition utilizing an amount of credits results in a chance outcome of a payout of application credits, interactive elements, and/or interactive application objects that have a credit value if cashed out.

In some embodiments, such as when an interactive application is a skill-based interactive application, interactive application objects include in-application objects that may be utilized to enhance interactions with the skill-based interactive application. Such objects include, but are not limited to, power-ups, enhanced in-application items, and the like. In some embodiments, the interactive application objects include objects that are detrimental to interactions with the skill-based interactive application such as, but not limited to, obstructions in the skill-based interactive application space, a temporary handicap, an enhanced opponent, and the like.

In some embodiments, interactive elements in an interactive application include, but are not limited to, enabling interactive elements (EIE) that are interactive application environment resources utilized during interaction with an interactive application and whose utilization automatically initiates resolution of a chance-based proposition. In some embodiments, interactive elements in an interactive application include, but are not limited to, a reserve enabling interactive element (REIE), that is an interactive element that is automatically converted into one or more enabling interactive elements upon occurrence of a release event during an interactive session of an interactive application. In yet another embodiment, interactive elements in an interactive application include, but are not limited to, an actionable interactive element (AIE) that is an interactive element that is acted upon during a session of the interactive application to automatically initiate resolution of a chance-based proposition and may or may not be restorable during normal interaction with the interactive application. In yet another embodiment, interactive elements in an interactive application include a common enabling interactive element (CEIE) that is an interactive element that the interactive application shares between two or more users and causes a wagering event to be automatically determined in accordance with a self-reconfiguring when interacted with by one or more of the two or more users during a session. In some embodiments, a user can utilize interactive elements during interactions with a controlled entity (CE) provided by an interactive application to a user.

In accordance with some embodiments of a self-reconfiguring wagering system, the initiation of resolution of a chance-based proposition can be dependent upon an interactive application environment variable such as, but not limited to, a required object (RO), a required environmental condition (REC), or a controlled entity characteristic (CEC). A RO is a specific interactive application object in an interactive application acted upon for an AE to be completed. A non-limiting example of an RO is a specific key needed to open a door. An REC is an interactive application state present within an interactive application for an AE to be completed. A non-limiting example of an REC is daylight whose presence enables a character to walk through woods. A CEC is a status of a controlled entity (CE) within an interactive application for an AE to be completed. A non-limiting example of a CEC is requirement that a CE have full health points before entering battle. Although various interactive application resources such as, but not limited to, the types of interactive application interactive elements as discussed herein may be used to automatically initiate resolution of a chance-based proposition in accordance with a chance-based proposition, one skilled in the art will recognize that any interactive application resource can be utilized in a self-reconfiguring wagering system to automatically initiate resolution of a chance-based proposition.

In several embodiments, a self-reconfiguring wagering system can utilize a process controller to continuously monitor use of the interactive application executed by an interactive controller in order to detect a wagering event and automatically initiate resolution of a combination proposition based on the wagering event.

In several embodiments, a wagering event occurrence can be determined by a process controller from one or more application environment variables within an interactive application environment that are used to initiate resolution of a combination proposition. Application environment variables can include, but are not limited to, passage of a period of time during self-reconfiguring wagering system interactive application use, a result from a self-reconfiguring wagering system interactive application session (such as, but not limited to, achieving a goal or a particular score), consumption of an interactive element, or an interaction that achieves a combination of interactive elements to be associated with a user profile.

In numerous embodiments, an interactive application instruction is an instruction by a process controller to an interactive controller and/or an interactive application of the interactive controller to modify a state of an interactive application or modify one or more interactive application resources or interactive elements. In some embodiments, the interactive application commands may be automatically generated by the process controller using one or more of a chance outcome and/or application environment variables. An interactive application instruction can be used by a process controller control many processes of an interactive application, such as, but not limited to, an causing an addition of a period of time available for a current interactive application session for the interactive application, an addition of a period of time available for a future self-reconfiguring wagering system interactive application session or any other modification to the interactive application interactive elements that can be utilized during an interactive application session. In some embodiments, an interactive application instruction can be used by the process controller to modify a type of an interactive element.

In several embodiments, a process controller of a self-reconfiguring wagering system may provide for a communications interface for asynchronous communications between a chance-based controller and an interactive application provided by an interactive controller, by operatively connecting the interactive controller, and thus the interactive controller's interactive application, with the chance-based controller.

In some embodiments, asynchronous communications provided for by a self-reconfiguring wagering system may reduce an amount of idle waiting time by an interactive controller of the self-reconfiguring wagering system, thus increasing an amount of processing resources that the interactive controller may provide to an interactive application or other processes of the interactive controller. In many embodiments, asynchronous communications provided for by a self-reconfiguring wagering system reduces an amount of idle waiting time by a chance-based controller, thus increasing an amount of processing resources that the chance-based controller may provide to determining chance outcomes, and other processes provided by the chance-based controller.

In some embodiments, a chance-based controller of a self-reconfiguring wagering system may be operatively connected to a plurality of interactive controllers through one or more process controllers and the asynchronous communications provided for by the one or more process controllers allows the chance-based controller to operate more efficiently by providing chance outcomes to a larger number of interactive controllers than would be achievable without the one or more process controllers of the self-reconfiguring wagering system.

In some embodiments, a self-reconfiguring wagering system including a process controller operatively connected to a chance-based controller and operatively connected to an interactive controller may provide for simplified communication protocols for communications of the interactive controller as the interactive controller may communicate interactions with an interactive application provided by the interactive controller to the process controller without regard to a nature of a chance-based proposition to be self-reconfiguring with processes of the interactive application.

In various embodiments, a self-reconfiguring wagering system including a process controller operatively connected to a chance-based controller and operatively connected to an interactive controller may provide for simplified communication protocols for communications of the chance-based controller as the chance-based controller may receive requests and communicate chance outcomes without regard to a nature of an interactive application provided by the interactive controller.

In some embodiments, a self-reconfiguring wagering system including a process controller operatively connecting a chance-based controller to an interactive controller may provide for reduced processing requirement for the interactive controller by offloading the execution of a random number generator from the interactive controller to the chance-based controller. In various such embodiments, additional processing resources may be made available to graphics processing or other processing intensive operations by the interactive controller because of the offloaded random number processing.

In various embodiments, a self-reconfiguring wagering system including a process controller operatively connecting a chance-based controller to an interactive controller provides for operation of the interactive controller in an unsecure location or manner, while providing for operation of the chance-based controller in a secure location or manner.

In some embodiments, a self-reconfiguring wagering system including a process controller operatively connecting a chance-based controller to an interactive controller allows the self-reconfiguring wagering system to have regulated components coupled to unregulated components in a heterogeneous regulated environment. For example, in several such embodiments, the interactive controller may be a device that is not regulated by a wagering regulatory agency whereas the chance-based controller is regulated by the wagering regulatory agency. A process controller of a self-reconfiguring wagering system may provide for isolation of the processing of the interactive controller from the processing of the chance-based controller. In such a heterogeneous regulatory environment, the process controller may or may not be itself a regulated by the wagering regulatory authority. In addition, components of an interactive application executed by the interactive controller may be either regulated or unregulated by the wagering regulatory agency.

Self-Reconfiguring Wagering Systems

FIG. 1 is a diagram of a structure of a self-reconfiguring wagering system in accordance with various embodiments of the invention. The self-reconfiguring wagering system 128 includes an interactive controller 120, a process controller 112, and a chance-based controller 102. The interactive controller 120 is operatively connected to, and communicates with, the process controller 112. The process controller 112 is also operatively connected to, and communicates with, the chance-based controller 102.

In some embodiments, a self-reconfiguring wagering system includes a session/management controller 150 operatively connected to one or more other components of the self-reconfiguring wagering system.

In many embodiments, a self-reconfiguring wagering system includes a credit processing system 198 operatively connected to one or more other components of the self-reconfiguring wagering system.

In various embodiments, the chance-based controller 102 includes one or more interfaces, such as interfaces 168, 169 and 190, that operatively connect the chance-based controller 102 to one or more session management servers, such as session/management controller 150, to one or more process controllers, such as process controller 112, and/or to a credit processing system 198, by their respective interfaces.

In some embodiments, one or more of the chance-based controller interfaces implement a chance-based controller interprocess communication protocol so that the chance-based controller 102 and one or more process controllers, one or more credit processing systems and/or one or more session/management controllers may be implemented on the same device. In operation, the chance-based controller interfaces provide application programming interfaces or the like that are used by the chance-based controller to communicate outgoing data and receive incoming data by passing parameter data to another process or application running on the same device.

In some embodiments, one or more of the chance-based controller interfaces implement a chance-based controller communication protocol employing an interdevice communication protocol so that the chance-based controller may be implemented on a device separate from one or more process controllers, one or more credit processing systems and/or one or more session/management controllers. The interdevice protocol may utilize a wired communication bus or wireless connection as a physical layer.

In various embodiments, one or more of the chance-based controller interfaces implement a chance-based controller communication protocol employing a networking protocol so that the chance-based controller may be operatively connected to one or more session/management controllers, one or more credit processing systems and/or one or more process controllers by a network. The networking protocol may utilize a wired communication bus or wireless connection as a physical layer. In many such embodiments, the networking protocol operates over a computer network and/or a telephone network or the like. During operation, the one or more chance-based controller interfaces communicate outgoing data to an external device or server by encoding the data into a signal and transmitting the signal to the external device or server. The one or more chance-based controller interfaces receive incoming data from an external device or server by receiving a signal transmitted by the external device or server and decoding the signal to obtain the incoming data.

In several embodiments, the chance-based controller 102 is a controller for providing one or more chance-based propositions provided by the self-reconfiguring wagering system 128 and automatically determines chance outcomes in accordance with the chance-based propositions as instructed by the process controller 112. Types of value utilized in a chance-based proposition can be one or more of several different types. Types of value of a chance-based proposition can include, but are not limited to, a chance-based proposition of an amount of credits corresponding to a real currency or a virtual currency, a chance-based proposition of an amount of application credits earned through interaction with an interactive application, a chance-based proposition of an amount of interactive elements of an interactive application, and a chance-based proposition of an amount of objects used in an interactive application. A chance outcome determined for a chance-based proposition can increase or decrease an amount of the type of value used in the chance-based proposition, such as, but not limited to, increasing or decreasing an amount of credits for a chance-based proposition of credits. In various embodiments, a chance outcome determined for a chance-based proposition can increase or decrease an amount of a type of value that is different than a type of value of the chance-based proposition, such as, but not limited to, increasing an amount of an object of an interactive application for a chance-based proposition of credits.

In many embodiments, the chance-based controller 102 includes one or more random number generators (RNGs) 106 for generating random results, one or more paytables 108 for determining a chance outcome from the random results, and one or more credit meters 110 for storing data about amounts of stored, wagered and won credits.

In several embodiments, the chance-based controller 102 is operatively connected to the credit processing system 198 via interface 190. The chance-based controller 102 communicates with the credit processing system 198 to receive incoming credit data 194 from the credit processing system 198. The chance-based controller 102 uses the incoming credit data 194 to transfer credits into the self-reconfiguring wagering system and onto the one or more credit meters 110. The chance-based controller 102 communicates outgoing credit data 192 to the credit processing system 198 to transfer credits off of the one or more credit meters 110 and out of the self-reconfiguring wagering system.

In many embodiments, the credit processing system 198 includes one or more credit input devices for generating incoming credit data 192 from a credit input. Credit inputs can include, but are not limited to, credit items used to transfer credits. The incoming credit data 194 are communicated to the chance-based controller 102. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validator and/or coin validators that receive and validate paper and/or coin currency or tokens.

In various embodiments, the credit processing system 198 includes one or more credit output devices for generating a credit output based on outgoing credit data 192 communicated from the chance-based controller. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the credit processing system 198 are operatively connected to, and communicate with, a TITO controller or the like to determine incoming credit data 194 representing amounts of credits to be transferred into the self-reconfiguring wagering system and to determine outgoing credit data 192 representing amounts of credits to be transferred out of the self-reconfiguring wagering system. In operation, the credit processing system 198 communicate with a connected credit input device, such as a bill validator/ticket scanner, used to scan a credit input in the form of a TITO ticket having indicia of credit account data of a credit account of the TITO controller. The credit processing system 198 communicates the credit account data to the TITO controller. The TITO controller uses the credit account data to determine an amount of credits to transfer to the credit processing system 198, and thus to the chance-based controller 102 of the self-reconfiguring wagering system 128. The TITO controller communicates the amount of credits to the credit processing system 198. The credit processing system 198 communicates the amount of credits as incoming credit data 194 to the chance-based controller 102 and the chance-based controller 102 credits one or more credit meters with the amount of credits so that the credits can be used when a user makes wagers using the self-reconfiguring wagering system 128.

In many embodiments, the credit processing system 198 includes a bill validator/ticket scanner as one of the one or more credit input devices. The credit processing system 198 communicates with the bill validator/ticket scanner to scan currency used as a credit input to determine an amount of credits as incoming credit data 194 to transfer credit to one or more credit meters 110 associated with one or more users. The chance-based controller 102 credits the one or more credit meters 110 with the amount of credits so that the credits can be used when a user makes wagers using the self-reconfiguring wagering system 128.

In some embodiments, the credit processing system 198 can use a TITO controller along with a ticket or voucher printer as one of the one or more credit output devices to generate a TITO ticket as a credit output for a user. In operation, the credit processing system 198 communicates, as outgoing credit data 192, data of an amount of credits to be credited to a credit account on the TITO controller. The TITO controller receives the amount of credits and creates the credit account and credits the credit account with the amount of credits. The TITO controller generates credit account data for the credit account and communicates the credit account data to the credit processing system 198. The credit processing system 198 uses the ticket or voucher printer to print indicia of the credit account data onto a TITO ticket as a credit output.

In various embodiments, the credit processing system 198 provides an interface to an electronic payment management system (not shown) such an electronic wallet or the like. The electronic payment system provides credit account data that is used for generating incoming credit data 194 as a credit input and outgoing credit data 192 as a credit output.

In several embodiments, during operation, the chance-based controller 102 communicates with the credit processing system 198 to receive incoming credit data 194 from the credit processing system 198 and adds credits onto the one or more credit meters 110 at least partially on the basis of the incoming credit data 194. The one or more RNGs 106 execute processes that generate random results. The chance-based controller uses the one or more paytables 108 to map the random results to a chance outcome. The chance-based controller 102 adds credits to, or deducts credits from, the one or more credit meters 110 based in part on the chance outcome. For example, in some embodiments, the chance-based controller 102 adds an amount of credits to the one or more credit meters 110 when the chance outcome indicates a win and deducts an amount of credits from the one or more credit meters 110 when the chance outcome indicates a loss or a partial win. At an end of a wagering session, the chance-based controller 102 transfers credits off of the one or more credit meters 110 and out of the self-reconfiguring wagering system by communicating outgoing credit data 192 to the credit processing system 198.

In various embodiments, the chance-based controller 102 includes one or more paytables 108. The one or more paytables 108 are used to implement one or more chance-based propositions in conjunction with one or more random outputs of the one or more RNGs 106.

In many embodiments, the chance-based controller 102 generates random numbers by continuously generating pseudo random numbers using a pseudo random number generator. A most current pseudo random number is stored in a buffer thus constantly refreshing the buffer. In many embodiments, the buffer is refreshed at a rate exceeding 100 times per second. When the chance-based controller receives a request for a chance outcome, the chance-based controller retrieves the stored most current pseudo random number from the buffer. As timing between requests for a chance outcome is not deterministic, the resulting output from the buffer is a random number. The random number is used along with a paytable that the chance-based controller selects from the one or more paytables 108. The selected paytable includes a mapping of values in a range of values of the random number to specified multipliers to be applied to an amount of credits to determine an amount of credits to be added to one or more credit meters associated with the chance-based proposition. A multiplier is selected from the paytable based on the random number and the selected multiplier is used along with an amount of credits to determine a chance outcome as an amount of credits.

In various embodiments, a chance outcome can include, but is not limited to, an amount of credits, application credits, and/or interactive elements or objects won as a function of the self-reconfiguring wagering system use and a type and amount of credits, application credits and/or interactive application objects wagered. A multiplier taken from the one or more paytables 108 is applied to the amount of credits, application credits and/or interactive application objects wagered and the resultant outcome is a chance outcome for a chance-based proposition.

In some embodiments, a range of the value of the random number is mapped to one or more symbols representing one or more random elements of a traditional chance-based proposition, and the mapped to one or more symbols are used in conjunction with a paytable selected from the one or more paytables 108. In one such embodiment, a random number is mapped to a virtual card of a deck of virtual cards. In another such embodiment, the random number is mapped to a virtual face of a virtual die. In yet another such embodiment, the random number is mapped to symbol of a virtual reel strip on a virtual reel slot machine. In yet another such embodiment, the random number is mapped to a pocket of a virtual roulette wheel. In some embodiments, two or more random numbers are mapped to appropriate symbols to represent a completed chance-based proposition. In one such embodiment, two or more random numbers are mapped to faces of two or more virtual dice to simulate a random outcome generated by throwing two or more dice. In another such embodiment, multiple random numbers are mapped to virtual cards from a virtual deck of cards without replacement. In yet another such embodiment, two or more random numbers are mapped to two or more virtual reel strips to create stop positions for a virtual multi-reel slot machine.

In some embodiments, a chance-based controller resolves a chance proposition by executing chance proposition determination commands that define processes of a chance-based proposition where the chance proposition determination commands are formatted in a scripting language. In operation, a decision engine of a process controller generates the chance proposition determination commands in the form of a script written in the scripting language. The script includes the chance proposition determination commands that describe how the chance-based controller is to resolve the chance-based proposition. The completed script is encoded as chance proposition determination command data and communicated to the chance-based controller by the process controller. The chance-based controller receives the chance proposition determination command data and parses the script encoded in the chance proposition determination command data and executes the commands included in the script to resolve the chance-based proposition to determine a chance outcome.

In some embodiments, a chance-based controller resolves a chance-based proposition by executing chance proposition determination commands that define processes of the wagering user interface. In operation, a decision engine of a process controller generates the chance proposition determination commands and encodes the chance proposition determination commands into chance proposition determination command data that are communicated to the chance-based controller by the process controller. The chance-based controller receives the chance proposition determination command data and executes the commands encoded in the chance proposition determination command data to resolve the chance-based proposition.

In various embodiments, the interactive controller 120 executes an interactive application 143 and provides one or more user interface input and output devices 103 so that a user can interact with the interactive application 143. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The interactive controller 120 provides for user interactions with the interactive application 143 by executing the interactive application 143 that generates an interactive application user interface 105 that utilizes the user interface input devices 103 to detect user interactions with the interactive controller and generates portions of the interactive application user interface that are presented to the user utilizing the user interface output devices 103.

In some embodiments, one or more components an interactive controller are housed in an enclosure such as a housing, cabinet, casing or the like. The enclosure further includes one or more user accessible openings or surfaces that constructed to mount the user interface input devices and/or the user interface output devices 103.

The interactive controller 120 is operatively connected to, and communicates with, the process controller 112. The interactive controller communicates application telemetry data 124 and skill outcome data 125 to the process controller 112 and receives skill proposition data, application instruction data and resource data 136 from the process controller 112. Via the communication of the skill proposition data, application instruction data, and/or resource data 136, the process controller 112 can control the operation of the interactive controller 120 by communicating control parameters to the interactive application 143 during the interactive application's execution by the interactive controller 120.

In some embodiments, during execution of the interactive application 143 by the interactive controller 120, the interactive controller 120 communicates, as application telemetry data 124, user interactions with the interactive application user interface 105 of the interactive application to the process controller 112. The application telemetry data 124 includes, but is not limited to, utilization of the interactive elements in the interactive application 143.

In some embodiments, the interactive application 143 is a skill-based interactive application. In such embodiments, execution of the skill-based interactive application 143 by the interactive controller 120 is based on a user's skillful interaction with the skill-based interactive application, such as, but not limited to, the user's utilization of the interactive elements of the skill-based interactive application during the user's skillful interaction with the skill-based interactive application. In such an embodiment, the process controller 112 communicates with the interactive controller 120 in order to allow the coupling of the skill-based interactive application to chance outcomes determined in accordance with a chance-based proposition of the chance-based controller 102. In some embodiments, the skill-based interactive application determines skill outcomes 125 based on a skill proposition and a user's skillful interactions with the skill-based interactive application. The skill outcomes 125 are communicated to the process controller 112.

In some embodiments, the interactive controller 120 includes one or more sensors 138 that sense various aspects of the physical environment of the interactive controller 120. Examples of sensors include, but are not limited to: global positioning sensors (GPSs) for sensing communications from a GPS system to determine a position or location of the interactive controller; temperature sensors; accelerometers; pressure sensors; and the like. Sensor telemetry data 133 is communicated by the interactive controller to the process controller 112 as part of the application telemetry data 124. The process controller 112 receives the sensor telemetry data 133 and uses the sensor telemetry data to make chance-based proposition decisions.

In many embodiments, the interactive controller 120 includes a wagering user interface 148 used to display wagering data, via one or more of the user interface input and output devices 103, to one or more users.

In various embodiments, an application control interface 131 resident in the interactive controller 120 provides an interface between the interactive controller 120 and the process controller 112.

In some embodiments, the application control interface 131 implements an interactive controller to process controller communication protocol employing an interprocess communication protocol so that the interactive controller and the process controller may be implemented on the same device. In operation, the application control interface 131 provides application programming interfaces that are used by the interactive processing application 143 of the interactive controller 120 to communicate outgoing data and receive incoming data by passing parameter data to another process or application.

In some embodiments, the application control interface 131 implements an interactive controller to process controller communication protocol employing an interdevice communication protocol so that the interactive controller and the process controller may be implemented on different devices. The interdevice protocol may utilize a wired communication bus or wireless connection as a physical layer.

In various embodiments, the application control interface 131 implements an interactive controller to process controller communication protocol employing a networking protocol so that the interactive controller and the process controller may be implemented on different devices connected by a network. The networking protocol may utilize a wired communication bus or wireless connection as a physical layer. In many such embodiments, the network includes a cellular telephone network or the like and the interactive controller is a mobile device such as a smartphone or other device capable of using the telephone network. During operation, the application control interface 131 communicates outgoing data to an external device by encoding the data into a signal and transmitting the signal to an external device. The application control interface receives incoming data from an external device by receiving a signal transmitted by the external device and decoding the signal to obtain the incoming data.

In various embodiments, the process controller 112 includes one or more interfaces, 162, 163 and 164, that operatively connect the process controller 112 to one or more interactive controllers, such as interactive controller 120, to one or more session management servers, such as session/management controller 150, and/or to one or more chance-based controllers, such as chance-based controller 102, respectively.

In some embodiments, one or more of the process controller interfaces implement a process controller to device or server communication protocol employing an interprocess communication protocol so that the process controller and one or more of an interactive controller, a chance-based controller, and/or a session/management controller may be implemented on the same device. In operation, the process controller interfaces provide application programming interfaces or the like that are used by the process controller to communicate outgoing data and receive incoming data by passing parameter data to another process or application running on the same device.

In some embodiments, one or more of the process controller interfaces implement a process controller communication protocol employing an interdevice communication protocol so that the process controller may be implemented on a device separate from the one or more interactive controllers, the one or more session/management controllers and/or the one or more chance-based controllers. The inter-device protocol may utilize a wired communication bus or wireless connection as a physical layer. In various embodiments, one or more of the process controller interfaces implement a process controller communication protocol employing a networking protocol so that the process controller may be operatively connected to the one or more interactive controllers, the one or more session/management controllers, and/or the one or more chance-based controllers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more process controller interfaces communicate outgoing data to an external device or server by encoding the data into a signal and transmitting the signal to the external device or server. The one or more process controller interfaces receive incoming data from an external device or server by receiving a signal transmitted by the external device or server and decoding the signal to obtain the incoming data.

In many embodiments, process controller 112 provides an interface between the interactive application 143 provided by the interactive controller 120 and a chance-based proposition provided by the chance-based controller 102.

The process controller 112 includes a rule-based decision engine 122 that receives telemetry data, such as application telemetry data 124, skill outcome data 125, and sensor telemetry data 133, from the interactive controller 120. The rule-based decision engine 122 has combined wager logic 127 including skill proposition logic 132 and chance proposition logic 126. The decision engine 122 uses the telemetry data, along with chance proposition logic 126 to generate chance proposition determination commands 129 that are used by the process controller 112 to command the chance-based controller 102 to resolve a chance-based proposition. The chance proposition determination command data is communicated by the process controller 112 to the chance-based controller 102. The chance-based controller 102 receives the chance proposition determination command data 129 and automatically resolves a chance-based proposition to determine a chance outcome in accordance with the chance proposition determination command data 129.

In an embodiment, the application telemetry data 124 used by the decision engine 122 encodes data about the operation of the interactive application 143 executed by the interactive controller 120.

In some embodiments, the application telemetry data 124 encodes interactions of a user, such as a user's interaction with an interactive element of the interactive application 143.

In many embodiments, the application telemetry data 124 includes a state of the interactive application 143, such as values of variables that change as the interactive application 143 executes.

In several embodiments, the decision engine 122 includes one or more rules as part of chance proposition logic 126 used by the decision engine 122 to determine when a chance-based proposition should be automatically resolved. Each rule includes one or more variable values constituting a pattern that is to be matched by the process controller 112 using the decision engine 122 to one or more variable values encoded in the application telemetry data 124. Each rule also includes one or more actions that are to be taken if the pattern is matched. Actions can include automatically generating chance proposition determination command data 129 and communicating the chance proposition determination command data 129 to the chance-based controller 102, thus commanding the chance-based controller to automatically resolve a chance-based proposition as described herein. During operation, the decision engine 122 receives application telemetry data 124 from the interactive controller 124 via interface 160. The decision engine 122 performs a matching process of matching the variable values encoded in the application telemetry data 124 to one or more variable patterns of one or more rules. If a match between the variable values and a pattern of a rule is determined, then the process controller 112 performs the action of the matched rule.

In some embodiments, the application telemetry data 124 includes, but is not limited to, application environment variables that indicate a state of the interactive application 143, interactive controller data indicating a state of the interactive controller 120, and interactions with the interactive application 143 during execution of the interactive application 143 by the interactive controller 120. The chance proposition determination command data 129 may include, but are not limited to, an amount and type of the chance-based proposition, a request for resolution of the chance-based proposition, and a selection of a paytable to be used when resolving the chance-based proposition.

In some embodiments, the process controller 112 receives chance outcome data 130 from the chance-based controller 102. The decision engine 122 uses the chance outcome data 130, in conjunction with the telemetry data 124 and skill proposition logic 132, to automatically generate skill proposition data, interactive application instruction data, and/or resource data 136 that the process controller 112 communicates to the interactive controller 120 via interfaces 160 and 131.

In an embodiment, the chance outcome data 130 used by a decision engine encodes data about the resolution of a chance-based proposition resolved by the chance-based controller 102. In some embodiments, the chance outcome data 130 encodes values of variables including an amount of credits wagered, an amount of credits won and values of credits stored in the one or more meters 110 of the chance-based controller. In many embodiments, the chance outcome data includes a state of the chance-based controller 102, such as values of variables that change as the chance-based controller 102 resolves chance-based propositions. The decision engine 122 includes one or more rules as part of skill proposition logic 132 used by the decision engine 122 to automatically generate the skill proposition data, interactive application instruction data, and/or resource data 136 that is then communicated to the interactive controller 120. Each rule includes one or more variable values constituting a pattern that is to be matched to one or more variable values encoded in the chance outcome data 130. Each rule also includes one or more actions that are to be automatically taken by the process controller 112 if the pattern is matched. Actions can include automatically generating skill proposition data, interactive application instruction data, and/or resource data 136 and using the skill proposition data, interactive application instruction data, and/or resource data 136 to control the interactive controller 120 to affect execution of the interactive application 143 as described herein. During operation, the process controller 112 receives the chance outcome data 130 from the chance-based controller 102 via interface 162. The process controller 112 uses the decision engine 122 to match the variable values encoded in the chance outcome data to one or more patterns of one or more rules of the skill proposition logic 132. If a match between the variable values and a pattern of a rule is found, then the process controller automatically performs the action of the matched rule. In some embodiments, the process controller 112 uses the application telemetry data 124 received from the interactive controller 120 in conjunction with the chance outcome data 130 to generate the interactive application instruction and resource data 136.

The interactive controller receives the skill proposition data, interactive application command data, and resource data 136 and automatically uses the skill proposition data, interactive application instruction data, and/or resource data 136 to configure and command the processes of the interactive application 143.

In some embodiments, the interactive application 143 operates utilizing a scripting language. The interactive application 143 parses scripts written in the scripting language and executes commands encoded in the scripts and sets variable values as defined in the scripts. In operation of such embodiments, the process controller 112 automatically generates skill proposition data, interactive application instruction data, and/or resource data 136 in the form of scripts written in the scripting language that are communicated to the interactive controller 120 during execution of the interactive application 143. The interactive controller 120 receives the scripts and passes them to the interactive application 143. The interactive application 143 receives the scripts, parses the scripts and automatically executes the commands and sets the variable values as encoded in the scripts.

In many embodiments, the interactive application 143 automatically performs processes as instructed by commands communicated from the process controller 112. The commands command the interactive application 143 to perform specified operations such as executing specified commands and/or setting the values of variables utilized by the interactive application 143. In operation of such embodiments, the process controller 112 automatically generates commands that are encoded into the skill proposition data, interactive application instruction data, and/or resource data 136 that are communicated to the interactive controller 120. The interactive controller 120 passes the skill proposition data, interactive application instruction data, and/or resource data 136 to the interactive application 143. The interactive application parses the skill proposition data, interactive application instruction data, and/or resource data and automatically performs operations in accordance with the commands encoded in the skill proposition data, interactive application instruction data, and/or resource data 136.

In many embodiments, the process controller 112 includes a pseudo random or random result generator used to generate random results that are used by the decision engine 122 to generate portions of the skill proposition data, interactive application instruction data, and/or resource data 136.

The interactive application 143 uses the skill proposition data, interactive application instruction data, and/or resource data 136 to generate a skill proposition presented to the user as an interactive application user interface 105 using one or more output devices of the user interface and output device (s) 103. The user skillfully interacts with the interactive application user interface 105 using one or more of input devices of the user interface input and output devices 103. The interactive application 143 determines a skill outcome based on the skillful interactions of the user and communicates data of the determined skill outcome 125 to the process controller 112. In some embodiments, the interactive application 143 also communicates application telemetry data 124 encoding the user's interactions with the interactive application 143.

In various embodiments, the process controller 112 uses the rule-based decision engine 122 to automatically determine an amount of application credits to award based at least in part on the skill outcome data 125 and interactions with the interactive application 143 of the self-reconfiguring wagering system as determined by the process controller 112 from the application telemetry data 124. In some embodiments, the process controller 112 may also use the chance outcome data 130 to determine the amount of application credits that should be awarded. In numerous embodiments, the interactive application 143 is a skill-based interactive application and the application credits is awarded for skillful interaction with the interactive application.

In various embodiments, the process controller 112 uses the decision engine 122 along with self-reconfiguring logic 127 to determine a combined wagering outcome 135 that is communicated to the wagering interface generator 144. The combined wagering outcome is determined on the basis of the skill outcome data 125 received from the interactive controller 120 and the chance outcome data 130 received from the chance-based controller 102.

The process controller 1112 uses the wagering user interface generator 144 to automatically generate wagering telemetry data 146 on the basis of the combined wagering outcome 135. The wagering telemetry data 146 is used by the process controller 112 to command the interactive controller 120 to automatically generate a wagering user interface 148 describing a state of wagered credit accumulation and loss for the self-reconfiguring wagering system.

In some embodiments, the wagering telemetry data 146 may include, but is not limited to, amounts of application credits and interactive elements earned, lost or accumulated through interaction with interactive application, and credits, application credits and interactive elements amounts won, lost or accumulated.

In some embodiments, the skill proposition data, interactive application instruction data, and/or resource data 136 are communicated to the wagering user interface generator 144 and used as a partial basis for generation of the wagering telemetry data 146 communicated to the interactive controller 120.

In various embodiments, the wagering user interface generator 144 also receives chance outcome data 130 that is used as a partial basis for generation of the wagering telemetry data 146 communicated to the interactive controller 120. In some embodiments, the chance outcome data 130 also includes data about one or more states of a chance-based proposition as resolved by the chance-based controller 102. In various such embodiments, the wagering user interface generator 144 generates a wagering process display and/or wagering state display using the one or more states of the chance-based proposition. The wagering process display and/or wagering state display is included in the wagering telemetry data 146 that is communicated to the interactive controller 120. The wagering process display and/or wagering state display is automatically displayed by the interactive controller 120 using the wagering user interface 148. In other such embodiments, the one or more states of the chance-based proposition are communicated to the interactive controller 120 and the interactive controller 120 is instructed to automatically generate the wagering process display and/or wagering state display of the wagering user interface 148 using the one or more states of the chance-based proposition for display.

In some embodiments, the chance outcome data 130 includes game state data about resolution of the chance-based proposition, including but not limited to a final state, intermediate state and/or beginning state of the chance-based proposition. For example, in a chance-based proposition that is based on slot machine math, the final state of the chance-based proposition may be reel positions, in a chance-based proposition that is based on roulette wheel math, the final state may be a pocket where a ball may have come to rest, in a chance-based proposition that is a based on card math, the beginning, intermediate and final states may represent a sequence of cards being drawn from a deck of cards, etc.

In some embodiments, the interactive controller 120 generates a wagering user interface by executing commands that define processes of the wagering user interface where the commands are formatted in a scripting language. In operation, a wagering user interface generator of a process controller generates commands in the form of a script written in the scripting language. The script includes commands that describe how the interactive controller is to display combined wagering outcome data. The completed script is encoded as wagering telemetry data and communicated to the interactive controller by the process controller. The interactive controller receives the wagering telemetry data and parses the script encoded in the wagering telemetry data and executes the commands included in the script to generate the wagering user interface.

In many embodiments, an interactive controller generates a wagering user interface based on a document written in a document markup language that includes commands that define processes of the wagering user interface. In operation, a wagering user interface generator of a process controller generates a document composed in the document markup language. The document includes commands that describe how the interactive controller is to display combined wagering outcome data. The completed document is encoded as wagering telemetry data and communicated to the interactive controller by the process controller. The interactive controller receives the wagering telemetry data and parses the document encoded in the wagering telemetry data and executes the commands encoded into the document to generate the wagering user interface.

In some embodiments, an interactive controller generates a wagering user interface by executing commands that define processes of the wagering user interface. In operation, a wagering user interface generator of a process controller generates the commands and encodes the commands into wagering telemetry data that is communicated to the interactive controller by the process controller. The interactive controller receives the wagering telemetry data and executes the commands encoded in the wagering telemetry data to generate the wagering user interface.

In various embodiments, an interactive controller includes a data store of graphic and audio display resources that the interactive controller uses to generate a wagering user interface as described herein.

In many embodiments, a process controller communicates graphic and audio display resources as part of wagering telemetry data to an interactive controller. The interactive controller uses the graphic and audio display resources to generate a wagering user interface as described herein.

When a user interacts with the wagering user interface 148, wagering user interface telemetry data is generated by the wagering user interface 148 and communicated by the interactive controller 120 to the process controller 112 using interfaces 131 and 160.

The process controller 112 can further operatively connect to the chance-based controller 102 to determine an amount of credit or interactive elements available and other wagering metrics of a chance-based proposition. Thus, the process controller 112 may affect an amount of credits in play for participation in the a chance-based proposition provided by the chance-based controller 102 in some embodiments. The process controller 112 may additionally include various audit logs and activity meters. In some embodiments, the process controller 112 can also couple to a centralized session and/or management controller 150 for exchanging various data related to the user and the activities of the user during game play of a self-reconfiguring wagering system.

In many embodiments, one or more users can be engaged in using the interactive application 143 executed by the interactive controller 120. In various embodiments, a self-reconfiguring wagering system can include an interactive application 143 that provides a skill-based interactive application that includes head-to-head play between a single user and a computing device, between two or more users against one another, or multiple users playing against a computer device and/or each other. In some embodiments, the interactive application 143 can be a skill-based interactive application where the user is not skillfully playing against the computer or any other user such as skill-based interactive applications where the user is effectively skillfully playing against himself or herself.

In some embodiments, the operation of the process controller 112 does not affect the provision of a chance-based proposition by the chance-based controller 102 except for user choice parameters that are allowable in accordance with the chance-based proposition.

In various embodiments, chance outcome data 130 communicated from the chance-based controller 102 can also be used to convey a status operation of the chance-based controller 102.

In a number of embodiments, communication of the chance proposition determination commands 129 between the chance-based controller 102 and the process controller 112 can further be used to communicate various wagering control factors that the chance-based controller 102 uses as input. Examples of wagering control factors include, but are not limited to, an amount of credits, application credits, interactive elements, or objects consumed per wagering event, and/or the user's election to enter a jackpot round.

In some embodiments, the process controller 112 utilizes the wagering user interface 148 to communicate certain interactive application data to the user, including but not limited to, club points, user status, control of the selection of choices, and messages which a user can find useful in order to adjust the interactive application experience or understand the wagering status of the user in accordance with the chance-based proposition in the chance-based controller 102.

In some embodiments, the process controller 112 utilizes the wagering user interface 148 to communicate aspects of a chance-based proposition to the user including, but not limited to, odds of certain chance outcomes, amount of credits, application credits, interactive elements, or objects in play, and amounts of credits, application credits, interactive elements, or objects available.

In a number of embodiments, the chance-based controller 102 can accept chance-based proposition factors from the process controller 112, including, but not limited to, modifications in the amount of credits, application credits, interactive elements, or objects wagered on each individual wagering event, a number of chance-based propositions per minute the chance-based controller 102 can resolve, entrance into a bonus round, and other factors. An example of a varying a wager amount that the user can choose can include, but is not limited to, using a more difficult interactive application level associated with an amount of a wager. These factors can increase or decrease an amount wagered per individual combination proposition in the same manner that a standard slot machine user can decide to wager more or less credits for each pull of the handle. In several embodiments, the chance-based controller 102 can communicate a number of factors back and forth to the process controller 112, via an interface, such that an increase/decrease in a wagered amount can be related to the change in user profile of the user in the interactive application. In this manner, a user can control a wager amount per wagering event in accordance with the self-reconfiguring with the change mapping to a parameter or component that is applicable to the interactive application experience.

In some embodiments, a session/management controller 150 is used to regulate a self-reconfiguring wagering system session.

In various embodiments, the session/management controller 150 includes one or more interfaces, 165, 166 and 167 that operatively connect the session/management controller 150 to one or more interactive controllers, such as interactive controller 120, to one or more process controllers, such as process controller 112, and/or to one or more chance-based controllers, such as chance-based controller 102, through their respective interfaces.

In some embodiments, one or more of the session/management controller interfaces implement a session/management controller to device or server communication protocol employing an interprocess communication protocol so that the session/management controller and one or more of an interactive controller, a chance-based controller, and/or a process controller may be implemented on the same device. In operation, the session/management controller interfaces provide application programming interfaces or the like that are used by the session/management controller to communicate outgoing data and receive incoming data by passing parameter data to another process or application running on the same device.

In some embodiments, one or more of the session/management controller interfaces implement a session/management controller communication protocol employing an interdevice communication protocol so that the session/management controller may be implemented on a device separate from the one or more interactive controllers, the one or more process controllers and/or the one or more chance-based controllers. The interdevice protocol may utilize a wired communication bus or wireless connection as a physical layer. In various embodiments, one or more of the session/management controller interfaces implement a session/management controller communication protocol employing a networking protocol so that the process session/management controller may be operatively connected to the one or more interactive controllers, the one or more process controllers, and/or the one or more chance-based controllers by a network. The networking protocol may utilize a wired communication bus or wireless connection as a physical layer. In many such embodiments, the network includes a cellular telephone network or the like and the one or more interactive controllers include a mobile device such as a smartphone or other device capable of using the telephone network. During operation, the one or more session/management controller interfaces communicate outgoing data to an external device or server by encoding the data into a signal and transmitting the signal to the external device or server. The one or more session/management controller interfaces receive incoming data from an external device or server by receiving a signal transmitted by the external device or server and decoding the signal to obtain the incoming data.

In various embodiments, the process controller 112 communicates outgoing session data 152 to the session/management controller. The session data 152 may include, but is not limited to, user, interactive controller, process controller and chance-based controller data from the process controller 112. The session/management controller 150 uses the user, interactive controller, process controller and chance-based controller data to regulate a self-reconfiguring wagering system session.

In some embodiments, the session/management controller 150 may also assert control of a self-reconfiguring wagering system session by communicating session control data 154 to the process controller. Such control may include, but is not limited to, commanding the process controller 112 to end a self-reconfiguring wagering system session, initiating wagering in a self-reconfiguring wagering system session, ending wagering in a self-reconfiguring wagering system session but not ending a user's use of the interactive application portion of the self-reconfiguring wagering system, and changing from real credit wagering in a self-reconfiguring wagering system to virtual credit wagering, or vice versa.

In many embodiments, the session/management controller 150 manages user profiles for a plurality of users. The session/management controller 150 stores and manages data about users in order to provide authentication and authorization of users of the self-reconfiguring wagering system 128. In some embodiments, the session/management controller 150 also manages geolocation information to ensure that the self-reconfiguring wagering system 128 is only used by users in jurisdictions were wagering is approved. In various embodiments, the session/management controller 150 stores application credits that are associated with the user's use of the interactive application of the self-reconfiguring wagering system 128.

In some embodiments, the session/management controller 150 communicates user and session management data 155 to the user using a management user interface 157 of the interactive controller. The user 140 interacts with the management user interface 157 and the management user interface generates management telemetry data 159 that is communicated to the session/management controller 150.

In some embodiments, the chance-based controller 102 communicates wagering session data 153 to the session/management controller 150. In various embodiments, the session/management controller communicates wagering session control data 151 to the chance-based controller 102.

In some embodiments, a process controller operates as an interface between an interactive controller and a chance-based controller. By virtue of this construction, the chance-based controller is isolated from the interactive controller allowing the interactive controller to operate in an unregulated environment will allowing the chance-based controller to operate in a regulated environment.

In some embodiments, a single chance-based controller may provide services to two or more interactive controllers and/or two or more process controllers, thus allowing a self-reconfiguring wagering system to operate over a large range of scaling.

In various embodiments, multiple types of interactive controllers using different operating systems may be interfaced to a single type of process controller and/or chance-based controller without requiring customization of the process controller and/or the chance-based controller.

In many embodiments, an interactive controller may be provided as a user device under control of a user while maintaining the chance-based controller in an environment under the control of a regulated operator of wagering equipment.

In several embodiments, data communicated between the controllers may be encrypted to increase security of the self-reconfiguring wagering system.

In some embodiments, a process controller isolates chance proposition logic and skill proposition logic as unregulated logic from a regulated chance-based controller, thus allowing errors in the skill proposition logic and/or chance proposition logic to be corrected, new skill proposition logic and/or chance proposition logic to be used, or modifications to be made to the skill proposition logic and/or chance proposition logic without a need for regulatory approval.

In various embodiments, an interactive application may require extensive processing resources from an interactive controller leaving few processing resources for the functions performed by a process controller and/or a chance-based controller. By virtue of the architecture described herein, processing loads may be distributed across multiple devices such that operations of the interactive controller may be dedicated to the interactive application and the processes of the process controller and/or chance-based controller are not burdened by the requirements of the interactive application.

In many embodiments, a self-reconfiguring wagering system operates with its components being distributed across multiple devices. These devices can be connected by communication channels including, but not limited to, local area networks, wide area networks, local communication buses, and/or the like. The devices may communicate using various types of protocols, including but not limited to, networking protocols, device-to-device communications protocols, and the like.

In some embodiments, one or more components of a self-reconfiguring wagering system are distributed in close proximity to each other and communicate using a local area network and/or a communication bus. In several embodiments, an interactive controller and a process controller of a self-reconfiguring wagering system are in a common location and communicate with an external chance-based controller. In some embodiments, a process controller and a chance-based controller of a self-reconfiguring wagering system are in a common location and communicate with an external interactive controller. In many embodiments, an interactive controller, a process controller, and a chance-based controller of a self-reconfiguring wagering system are located in a common location. In some embodiments, a session/management controller is located in a common location with a process controller and/or a chance-based controller.

In various embodiments, these multiple devices can be constructed from or configured using a single device or a plurality of devices such that a self-reconfiguring wagering system is executed as a system in a virtualized space such as, but not limited to, where a chance-based controller and a process controller are large scale centralized servers in the cloud operatively connected to widely distributed interactive controllers via a wide area network such as the Internet or a local area network. In such embodiments, the components of a self-reconfiguring wagering system may communicate using a networking protocol or other type of device-to-device communications protocol.

In some embodiments, a self-reconfiguring wagering system is deployed over a local area network or a wide area network in an interactive configuration. An interactive configuration of a self-reconfiguring wagering system includes an interactive controller operatively connected by a network to a process controller and a chance-based controller.

In some embodiments, a self-reconfiguring wagering system is deployed over a local area network or a wide area network in a mobile configuration. A mobile configuration of a self-reconfiguring wagering system is useful for deployment over wireless communication network, such as a wireless local area network or a wireless telecommunications network. A mobile configuration of a self-reconfiguring wagering system 194 includes an interactive controller operatively connected by a wireless network to a process controller and a chance-based controller.

In many embodiments, a centralized chance-based controller is operatively connected to, and communicates with, one or more process controllers using a communication link. The centralized chance-based controller can generate chance outcomes for wagers in accordance with one or more chance-based propositions. The centralized chance-based controller can resolve a number of simultaneous or pseudo-simultaneous chance-based propositions in order to generate chance outcomes for a variety of chance-based propositions that one or more distributed self-reconfiguring wagering systems can use.

In several embodiments, a centralized process controller is operatively connected to one or more interactive controllers and one or more chance-based controllers using a communication link. The centralized process controller can perform the functionality of a process controller across various self-reconfiguring wagering systems.

In numerous embodiments, an interactive application server provides a host for managing head-to-head play operating over a network of interactive controllers connected to the interactive application server using a communication link. The interactive application server provides an environment where users can compete directly with one another and interact with other users.

Figure 2A:
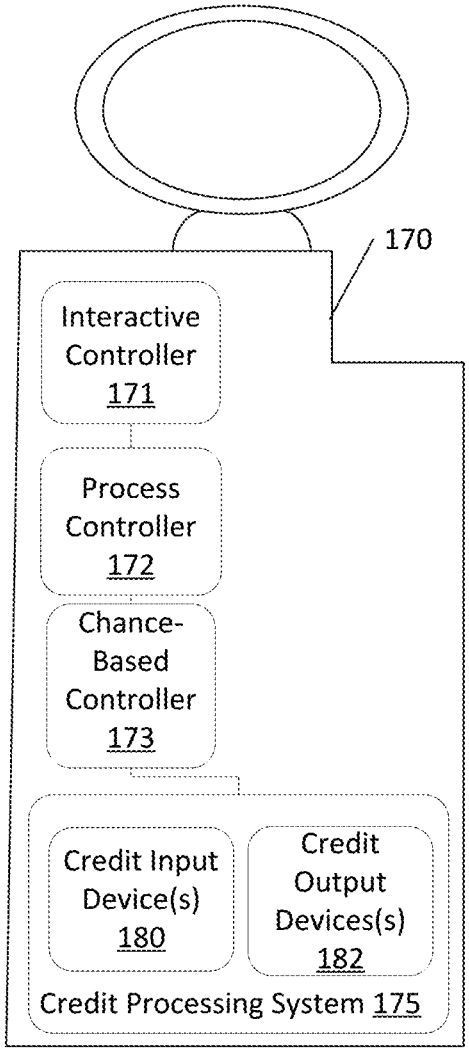
FIG. 2A is a diagram of a land-based configuration of a self-reconfiguring wagering system in accordance with various embodiments of the invention.

FIG. 2A is a diagram of a land-based configuration of a self-reconfiguring wagering system in accordance with various embodiments of the invention. Land-based configurations of a self-reconfiguring wagering system include, but are not limited to, electronic gaming machines such as slot machines, electronic table games and the like. A land-based configuration of a self-reconfiguring wagering system 170 includes an interactive controller 171, a process controller 172 and a chance-based controller 173 contained in an enclosure such as a housing, cabinet, casing or the like. The enclosure may further include one or more user accessible openings or surfaces that may be used to mount one or more user accessible user input devices, one or more user accessible user output devices, and one or more user accessible credit processing systems or credit processing devices. The interactive controller communicates with the user input devices to detect user interactions with the self-reconfiguring wagering system and commands and controls the user output devices to provide a user interface to one or more users of the self-reconfiguring wagering system as described herein. The chance-based controller communicates with the user credit processing systems or user credit processing devices to transfer credits into and out of the self-reconfiguring wagering system as described herein.

In many embodiments, the process controller 172 is operatively connected to an external session/management controller (not shown). The session/management controller may provide session control for a wagering session or may provide services for management of a user account for the storage of player points, application credits and the like.

In various embodiments, the chance-based controller 173 is operatively connected to a credit processing system 175. In many embodiments, the credit processing system 175 includes one or more credit input devices 180 for generating incoming credit data from a credit input. Credit inputs can include, but are not limited to, credit items used to transfer credits. The incoming credit data are communicated to the chance-based controller 173. In various embodiments, the one or more credit input devices and their corresponding credit items include, but are not limited to: card readers for reading cards having magnetic stripes, RFID chips, smart chips, and the like; scanners for reading various types of printed indicia printed on to various types of media such as vouchers, coupons, TITO tickets, rewritable cards, or the like; and bill validators and/or coin validators that receive and validate paper and/or coin currency or tokens.

In various embodiments, the credit processing system 175 includes one or more credit output devices 182 for generating a credit output based on outgoing credit data communicated from the chance-based controller 173. Credit outputs can include, but are not limited to, credit items used to transfer credits. Types of credit output devices and their corresponding credit items may include, but are not limited to: writing devices that are used to write to cards having magnetic stripes, smart chips or the like; printers for printing various types of printed indicia onto vouchers, coupons, TITO tickets, vouchers, rewritable cards or the like; and bill and/or coin dispensers that output paper and/or coin currency or tokens.

In some embodiments, the chance-based controller 173 and/or the credit processing system 175 is operatively connected to, and communicates with, a TITO controller (not shown) or the like to determine incoming credit data representing amounts of credits to be transferred into the self-reconfiguring wagering system 170 and to determine outgoing credit data representing amounts of credits to be transferred out of the self-reconfiguring wagering system 170. In operation, the credit processing system 175 communicates with one of the one or more connected credit input devices 180, such as a bill validator/ticket scanner, used to scan a credit input in the form of a TITO ticket having indicia of credit account data of a credit account of the TITO controller. The credit processing system 175 communicates the credit account data to the TITO controller. The TITO controller uses the credit account data to determine an amount of credits to transfer to the credit processing system 175, and thus to the chance-based controller 173 of the self-reconfiguring wagering system 128. The TITO controller communicates the amount of credits to the credit processing system 175. The credit processing system 175 communicates the amount of credits as incoming credit data to the chance-based controller 173 and the chance-based controller 173 credits one or more credit meters with the amount of credits so that the credits can be used when a user makes wagers using the self-reconfiguring wagering system 170.

In many embodiments, the credit processing system 175 includes a bill validator/ticket scanner as one of the one or more credit input devices 180. The credit processing system 175 communicates with the bill validator/ticket scanner to scan currency used as a credit input to determine an amount of credits as incoming credit data to transfer credit to one or more credit meters associated with one or more users. The chance-based controller 173 credits the one or more credit meters with the amount of credits so that the credits can be used when a user makes wagers using the self-reconfiguring wagering system 170.

In some embodiments, the credit processing system 175 can use a TITO controller along with a ticket or voucher printer as one of the one or more credit output devices 182 to generate a TITO ticket as a credit output for a user. In operation, the credit processing system 175 communicates, as outgoing credit data, data of an amount of credits to be credited to a credit account on the TITO controller. The TITO controller receives the amount of credits and creates the credit account and credits the credit account with the amount of credits. The TITO controller generates credit account data for the credit account and communicates the credit account data to the credit processing system 175. The credit processing system 175 uses the ticket or voucher printer to print indicia of the credit account data onto a TITO ticket as a credit output.

In various embodiments, the credit processing system provides an interface to an electronic payment management system (not shown) such an electronic wallet or the like. The electronic payment system provides credit account data that is used for generating incoming credit data as a credit input and outgoing credit data as a credit output.

In some embodiments, the chance-based controller 173 is further operatively connected to a central determination controller (not shown). In operation, when the chance-based controller 173 needs to determine a chance outcome, the chance-based controller 173 communicates a request to the central determination controller for the chance outcome. The central determination controller receives the chance outcome request and generates a chance outcome in response to the chance outcome request. The central determination controller communicates data of the chance outcome to the chance-based controller 173. The chance-based controller 173 receives the data of the chance outcome and utilizes the chance outcome as described herein. In some embodiments, the chance outcome is drawn from a pool of pre-determined chance outcomes. In some embodiments, the chance outcome is a random result that is utilized by the chance-based controller along with paytables to determine a chance outcome as described herein.

In various embodiments, the chance-based controller 173 may be operatively connected to a progressive controller along (not shown) with one or more other chance-based controllers of one or more other self-reconfiguring wagering systems. The progressive controller provides services for the collection and provision of credits used by the chance-based controller 173 to provide chance outcomes that have a progressive or pooling component.

FIGS. 2B, 2C, 2D, and 2E are illustrations of interactive controllers of a self-reconfiguring wagering system in accordance with various embodiments of the invention. An interactive controller, such as interactive controller 120 of FIG. 1, may be constructed from or configured using one or more processing devices that perform the operations of the interactive controller. An interactive controller in a self-reconfiguring wagering system may be constructed from or configured using any processing device having sufficient processing and communication capabilities that may be that perform the processes of an interactive controller in accordance with various embodiments of the invention. In some embodiments, the construction or configuration of the interactive controller may be achieved through the use of an application control interface, such as application control interface 131 of FIG. 1, and/or through the use of an interactive application, such as interactive application 143 of FIG. 1.

Figure 2B:
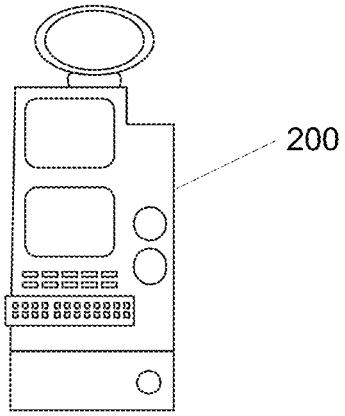
FIGS. 2B, 2C, 2D, and 2E are illustrations of interactive controllers of a self-reconfiguring wagering system in accordance with various embodiments of the invention.

In some embodiments, an interactive controller may be constructed from or configured using an electronic gaming machine 200 as shown in FIG. 2B. The electronic gaming machine 200 may be physically located in various types of gaming establishments.

Figure 2C:
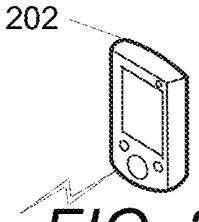

In many embodiments, an interactive controller may be constructed from or configured using a portable device 202 as shown in FIG. 2C. The portable device 202 is a device that may wirelessly connect to a network. Examples of portable devices include, but are not limited to, a tablet computer, a personal digital assistant, and a smartphone.

Figure 2D:
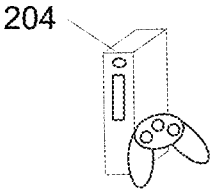

In some embodiments, an interactive controller may be constructed from or configured using a gaming console 204 as shown in FIG. 2D.

Figure 2E:
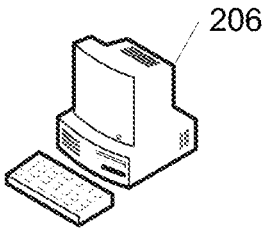

In various embodiments, an interactive controller may be constructed from or configured using a personal computer 206 as shown in FIG. 2E.

In some embodiments, a device, such as the devices of FIGS. 2B, 2C, 2D, and 2E, may be used to construct a complete self-reconfiguring wagering system and may be operatively connected using a communication link to a session and/or management controller, such as session and/or management controller 150 of FIG. 1.

Figure 3A:
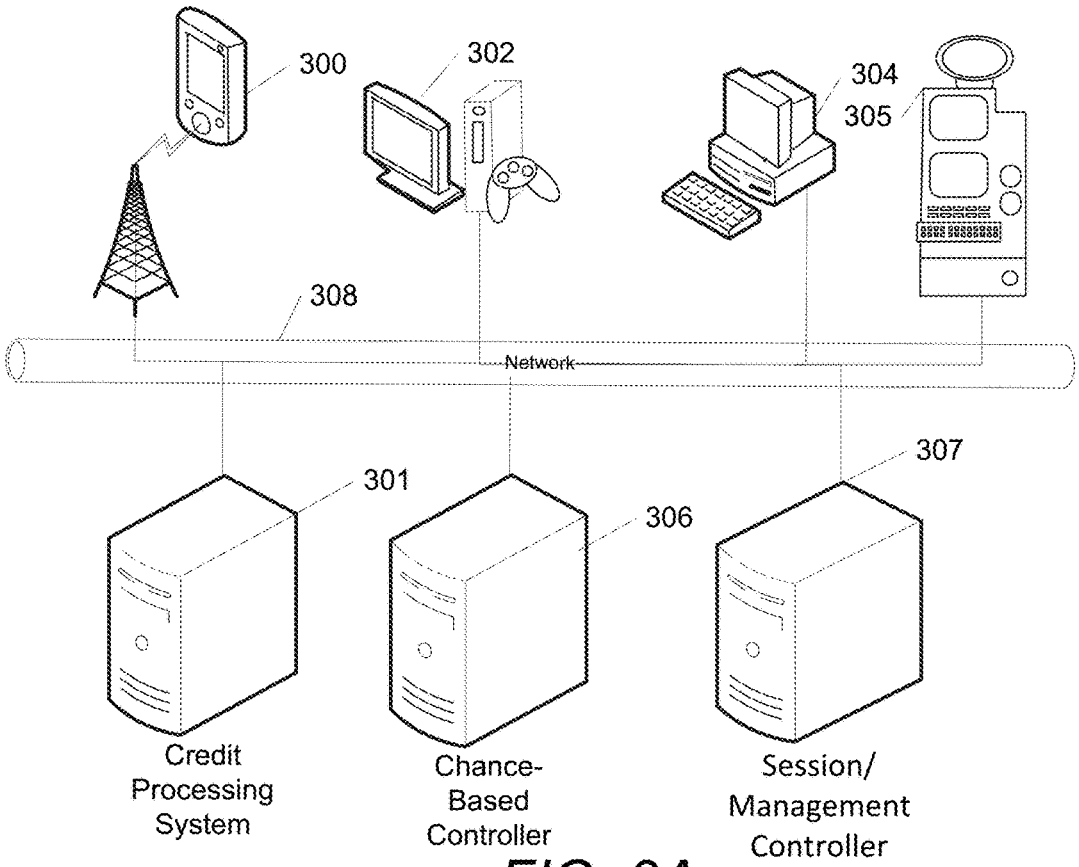
FIGS. 3A, 3B and 3C are diagrams of distributed self-reconfiguring wagering systems in accordance with various embodiments of the invention.
Figure 3B:
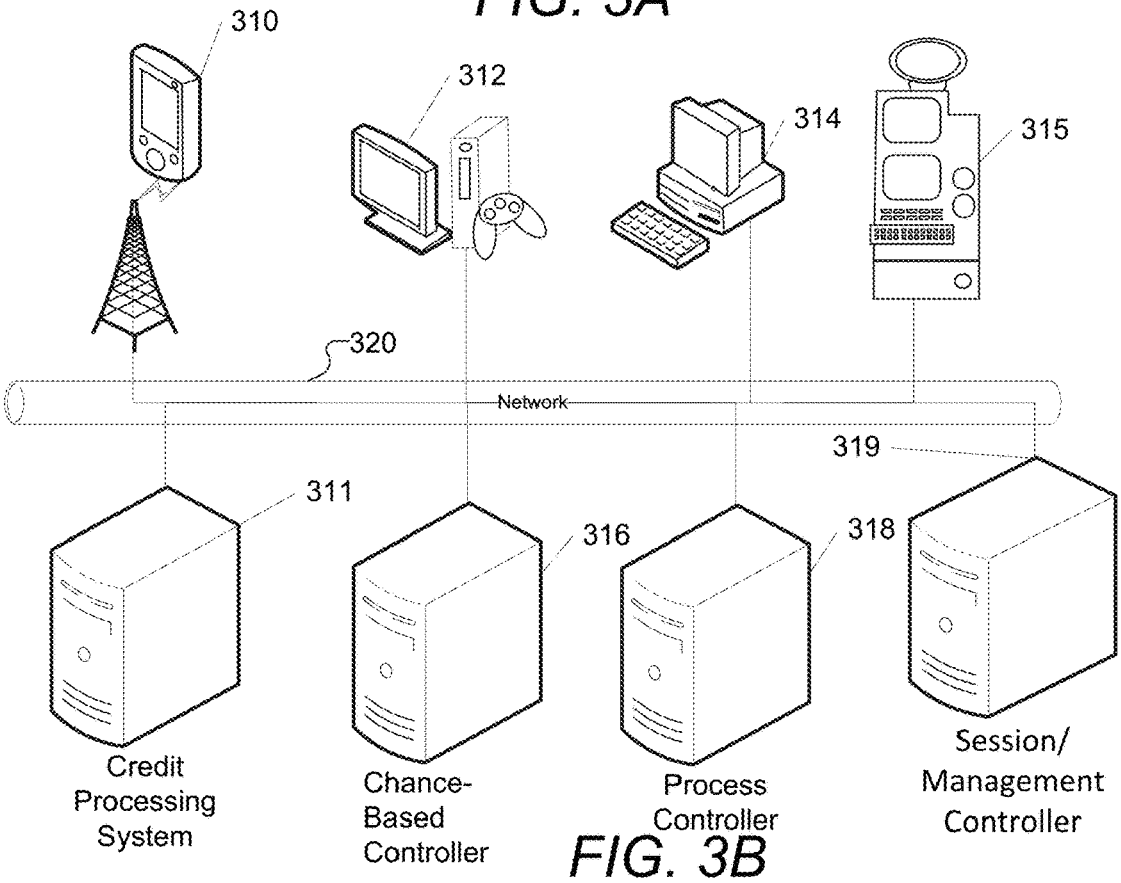
Figure 3C:
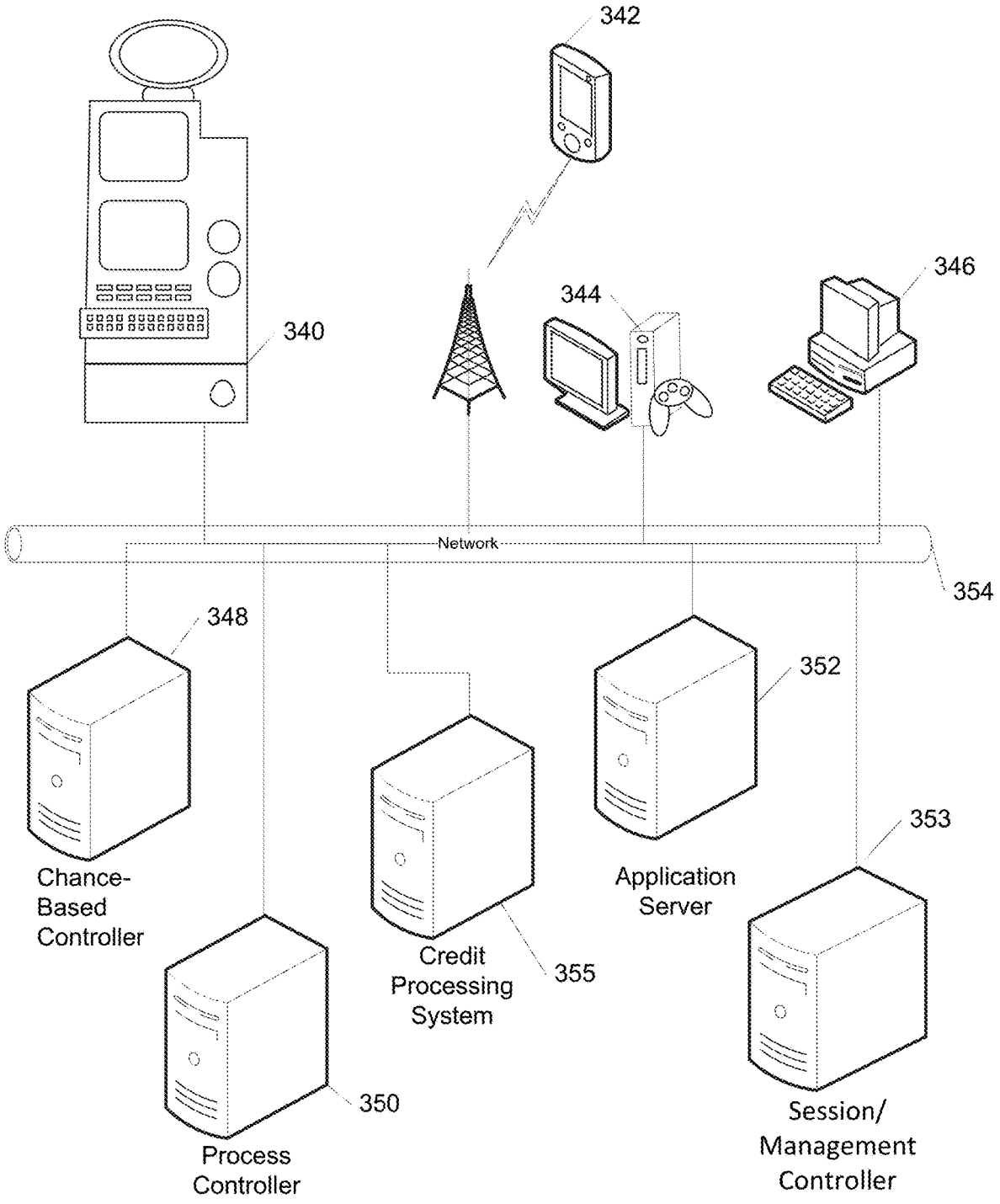

Some self-reconfiguring wagering systems in accordance with many embodiments of the invention can be distributed across a plurality of devices in various configurations. FIGS. 3A, 3B and 3C are diagrams of distributed self-reconfiguring wagering systems in accordance with various embodiments of the invention. Turning now to FIG. 3A, one or more interactive controllers of a distributed self-reconfiguring wagering system, such as but not limited to, a mobile or wireless device 300, a gaming console 302, a personal computer 304, and an electronic gaming machine 305, are operatively connected with a chance-based controller 306 of a distributed self-reconfiguring wagering system using a communication link 308. Communication link 308 is a communications link that allows processing systems to communicate with each other and to share data. Examples of the communication link 308 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of an interactive controller and a process controller as described herein are executed on the individual interactive controllers 300, 302, 304 and 305 while one or more processes of a chance-based controller as described herein can be executed by the chance-based controller 306.

In many embodiments, a distributed self-reconfiguring wagering system and may be operatively connected using a communication link to a session and/or management controller 307, that performs the processes of a session and/or management controller as described herein.

In several embodiments, a distributed self-reconfiguring wagering system and may be operatively connected using a communication link to credit processing system 306, that performs the processes of one or more credit processing systems as described herein.

A distributed self-reconfiguring wagering system in accordance with another embodiment of the invention is illustrated in FIG. 3B. As illustrated, one or more interactive controllers of a distributed self-reconfiguring wagering system, such as but not limited to, a mobile or wireless device 310, a gaming console 312, a personal computer 314, and an electronic gaming machine 315, are operatively connected with a chance-based controller 316 and a process controller 318 over a communication link 320. Communication link 320 is a communication link that allows processing systems to communicate and share data. Examples of the communication link 320 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, the processes of an interactive controller as described herein are executed on the individual interactive controllers 310, 312, 314 and 315. One or more processes of a chance-based controller as described herein are executed by the chance-based controller 316, and one or more processes of a process controller as described herein are executed by the process controller 318.

In many embodiments, a distributed self-reconfiguring wagering system and may be operatively connected using a communication link to a session and/or management controller 319, that performs the processes of a session and/or management controller as described herein.

In several embodiments, a distributed self-reconfiguring wagering system and may be operatively connected using a communication link to credit processing system 311, that performs the processes of one or more credit processing systems as described herein.

A distributed self-reconfiguring wagering systems in accordance with still another embodiment of the invention is illustrated in FIG. 3C. As illustrated, one or more interactive controllers of a distributed self-reconfiguring wagering system, such as but not limited to, a mobile device 342, a gaming console 344, a personal computer 346, and an electronic gaming machine 340 are operatively connected with a chance-based controller 348 and a process controller 350, and an interactive application server 352 using a communication link 354. Communication link 354 is a communications link that allows processing systems to communicate and to share data. Examples of the communication link 354 can include, but are not limited to: a wired or wireless interdevice communication link, a serial or parallel interdevice communication bus; a wired or wireless network such as a Local Area Network (LAN), a Wide Area Network (WAN), or the link; or a wired or wireless communication network such as a wireless telecommunications network or plain old telephone system (POTS). In some embodiments, one or more processes of a display and user interface of an interactive controller as described herein are executed on the individual interactive controllers 340, 342, 344 and 346. One or more processes of a chance-based controller as described herein can be executed by the chance-based controller 348. One or more processes of a process controller as described herein can be executed by the process controller server 350 and one or more processes of an interactive controller excluding the display and user interfaces can be executed by the interactive application server 352.

In many embodiments, a distributed self-reconfiguring wagering system and may be operatively connected using a communication link to a session and/or management controller 353, that performs the processes of a session and/or management controller as described herein.

In several embodiments, a distributed self-reconfiguring wagering system and may be operatively connected using a communication link to credit processing system 355, that performs the processes of one or more credit processing systems as described herein.

In other embodiments, a number of other peripheral systems, such as a user management system, a gaming establishment management system, a regulatory system, and/or hosting servers are also operatively connected with the self-reconfiguring wagering systems using a communication link. Also, other servers can reside outside the bounds of a network within a firewall of the operator to provide additional services for network connected self-reconfiguring wagering systems.

Although various distributed self-reconfiguring wagering systems are described herein, self-reconfiguring wagering systems can be distributed in any configuration as appropriate to the specification of a specific application in accordance with embodiments of the invention. In some embodiments, components of a distributed self-reconfiguring wagering system, such as a process controller, chance-based controller, interactive controller, or other servers that perform services for a process controller, chance-based controller and/or interactive controller, can be distributed in different configurations for a specific distributed self-reconfiguring wagering system application.

Figure 4A:
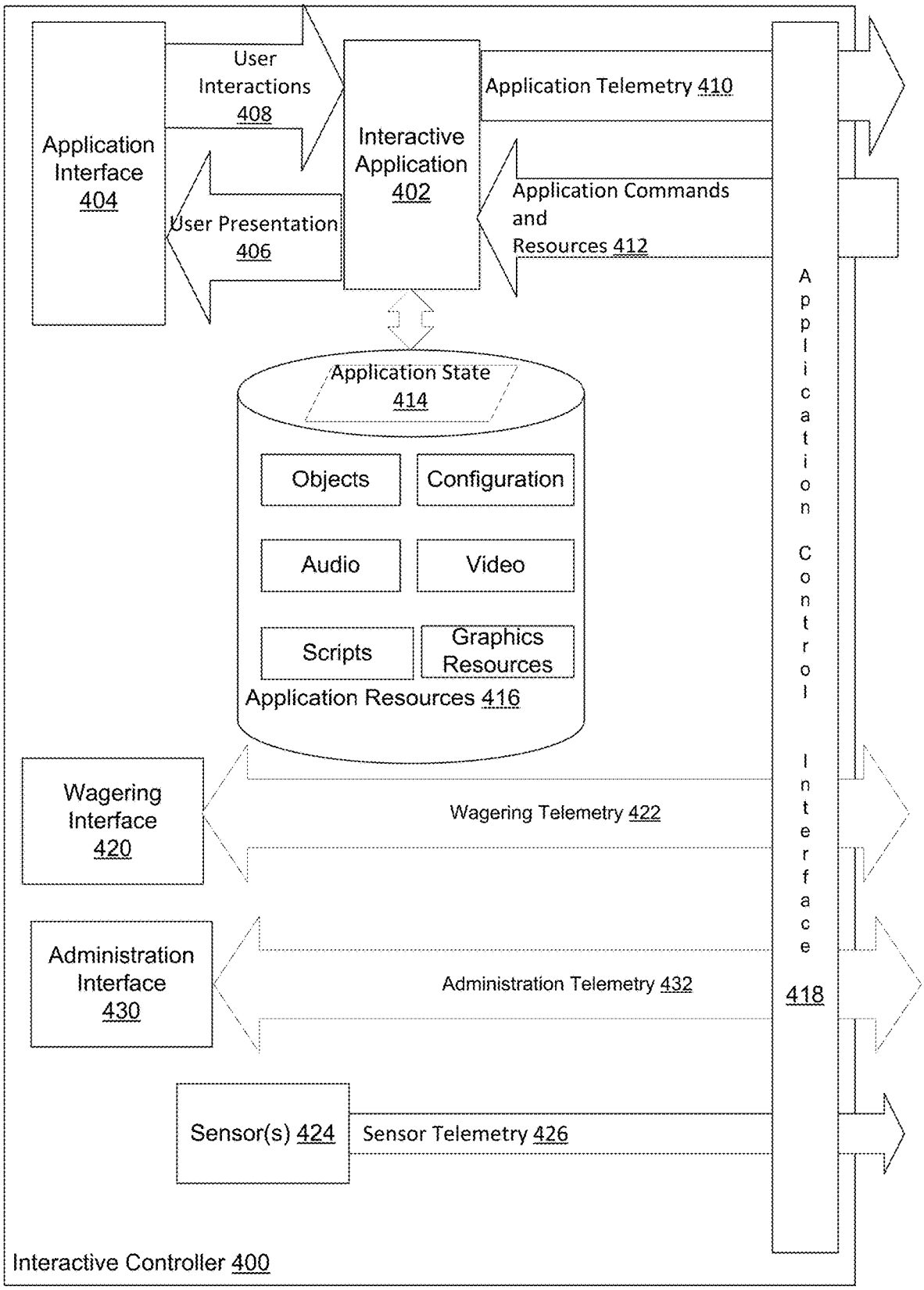
FIGS. 4A and 4B are diagrams of a structure of an interactive controller of a self-reconfiguring wagering system in accordance with various embodiments of the invention.
Figure 4B:
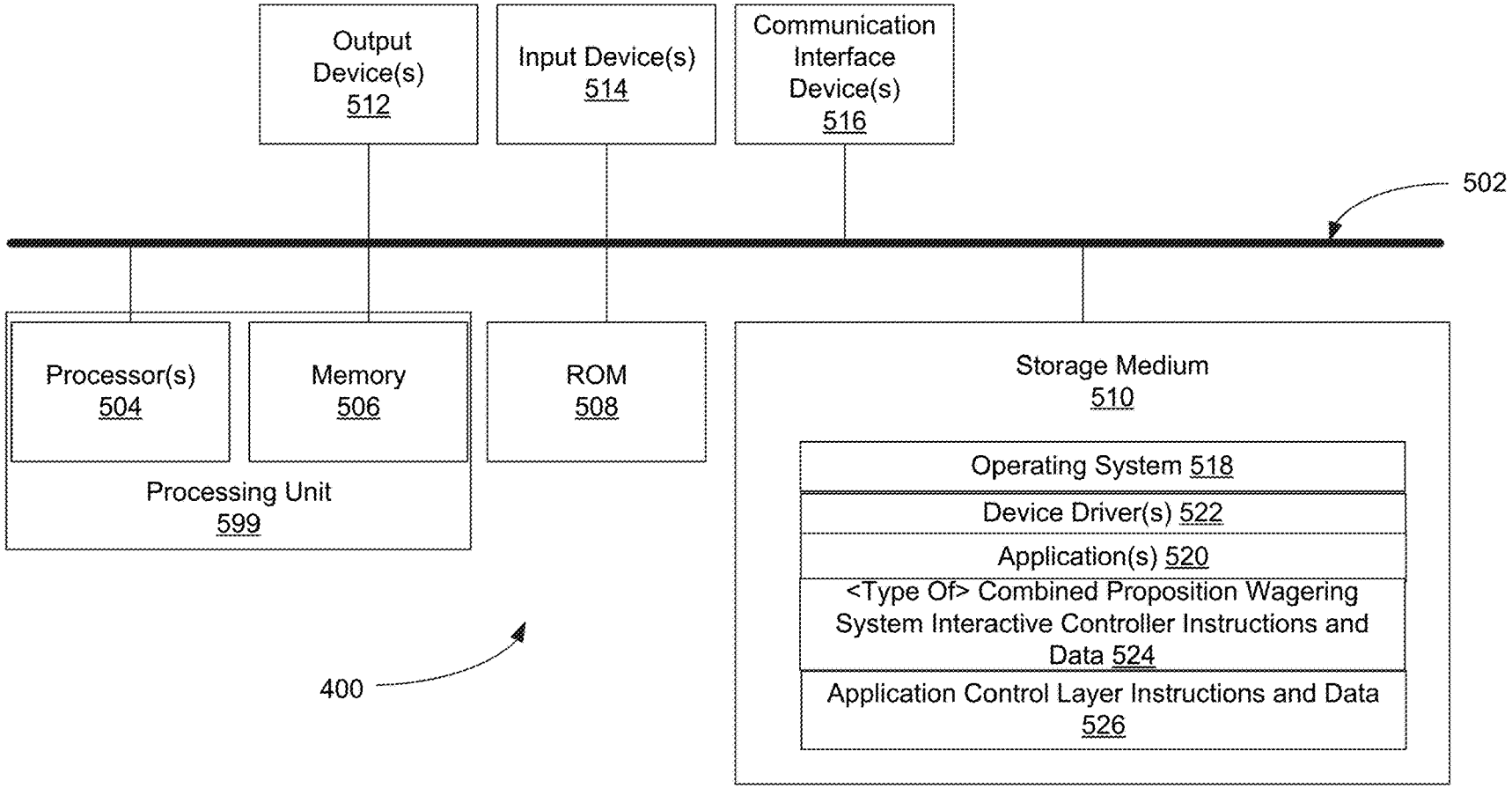

FIGS. 4A and 4B are diagrams of a structure of an interactive controller of a self-reconfiguring wagering system in accordance with various embodiments of the invention. An interactive controller may be constructed from or configured using one or more processing devices that perform the operations of the interactive controller. In many embodiments, an interactive controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 4A, an interactive controller 400, suitable for use as interactive controller 120 of FIG. 1, provides an execution environment for an interactive application 402 of a self-reconfiguring wagering system. In several embodiments, an interactive controller 400 of a self-reconfiguring wagering system provides an interactive application 402 that generates an interactive application user interface 404 for interaction with by a user. The interactive application 402 generates a user presentation 406 that is presented to the user through the interactive application user interface 404. The user presentation 406 may include audio features, visual features or tactile features, or any combination of these features. In various embodiments, the interactive application user interface 404 utilizes one or more user interface input and output devices so that a user can interact with the user presentation. In various embodiments, user interface input devices include, but are not limited to: buttons or keys; keyboards; keypads; game controllers; joysticks; computer mice; track balls; track buttons; touch pads; touch screens; accelerometers; motion sensors; video input devices; microphones; and the like. In various embodiments, user interface output devices include, but are not limited to: audio output devices such as speakers, headphones, earbuds, and the like; visual output devices such as lights, video displays and the like; and tactile devices such as rumble pads, hepatic touch screens, buttons, keys and the like. The user's interactions 408 are included by the interactive application 402 in application telemetry data 410 that is communicated by interactive controller 400 to various other components of a self-reconfiguring wagering system as described herein. The interactive application 402 receives application commands and resources 412 communicated from various other components of a self-reconfiguring wagering system as described herein. In some embodiments, the application telemetry data 410 includes a skill outcome for a skill proposition presented to the user by the interactive application 402.

In some embodiments, various components of the interactive application 402 can read data from an application state 414 in order to provide one or more features of the interactive application. In various embodiments, components of the interactive application 402 can include, but are not limited to: a physics engine; a rules engine; an audio engine; a graphics engine and the like. The physics engine is used to simulate physical interactions between virtual objects in the interactive application 402. The rules engine implements the rules of the interactive application and a random number generator that may be used for influencing or determining certain variables and/or outcomes to provide a randomizing influence on the operations of the interactive application. The graphics engine is used to generate a visual representation of the interactive application state to the user. The audio engine is used to generate an audio representation of the interactive application state to the user.

During operation, the interactive application reads and writes application resources 416 stored on a data store of the interactive controller host. The application resources 416 may include objects having graphics and/or control logic used to provide application environment objects of the interactive application. In various embodiments, the resources may also include, but are not limited to, video files that are used to generate a portion of the user presentation 406; audio files used to generate music, sound effects, etc. within the interactive application; configuration files used to configure the features of the interactive application; scripts or other types of control code used to provide various features of the interactive application; and graphics resources such as textures, objects, etc. that are used by a graphics engine to render objects displayed in an interactive application.

In operation, components of the interactive application 402 read portions of the application state 414 and generate the user presentation 406 for the user that is presented to the user using the user interface 404. The user perceives the user presentation and provides user interactions 408 using the user input devices. The corresponding user interactions are received as user actions or inputs by various components of the interactive application 402. The interactive application 402 translates the user actions into interactions with the virtual objects of the application environment stored in the application state 414. Components of the interactive application use the user interactions with the virtual objects of the interactive application and the interactive application state 414 to update the application state 414 and update the user presentation 406 presented to the user. The process loops continuously while the user interacts with the interactive application of the self-reconfiguring wagering system.

The interactive controller 400 provides one or more interfaces 418 between the interactive controller 400 and other components of a self-reconfiguring wagering system, such as, but not limited to, a process controller and a session/management controller. The interactive controller 400 and the other self-reconfiguring wagering system components communicate with each other using the interfaces. The interface may be used to pass various types of data, and to communicate and receive messages, status data, commands and the like. In certain embodiments, the interactive controller 400 and a process controller communicate application commands and environment resources 412 and application telemetry data 410. In some embodiments, the communications include requests by the process controller that the interactive controller 400 update the application state 414 using data provided by the process controller.

In many embodiments, a communications between a process controller and the interactive controller 400 includes a request that the interactive controller 400 update one or more resources 416 using data provided by the process controller. In a number of embodiments, the interactive controller 400 provides all or a portion of the application state to the process controller. In some embodiments, the interactive controller 400 may also provide data about one or more of the application resources 416 to the process controller. In some embodiments, the communication includes user interactions that the interactive controller 400 communicates to the process controller. The user interactions may be low level user interactions with the user interface 404, such as manipulation of a user input device, or may be high level interactions with game objects as determined by the interactive application. The user interactions may also include resultant actions such as modifications to the application state 414 or game resources 416 resulting from the user's interactions taken in the self-reconfiguring wagering system interactive application. In some embodiments, user interactions include, but are not limited to, actions taken by entities such as non-user characters (NPC) of the interactive application that act on behalf of or under the control of the user.

In various embodiments, the application commands and resources 412 include skill proposition application commands and/or resources used by the interactive application to generate a presentation of a skill proposition presented to a user and to determine a skill outcome based on the user's skillful interaction with the presentation of the skill proposition.

In some embodiments, the interactive controller 400 includes a wagering user interface 420 used to provide self-reconfiguring wagering system telemetry data 422 to and from the user. The self-reconfiguring wagering system telemetry data 422 from the self-reconfiguring wagering system include, but are not limited to, data used by the user to configure credit, application credit and interactive element wagers, and data about the chance-based proposition credits, application credits and interactive element wagers such as, but not limited to, credit, application credit and interactive element balances and credit, application credit and interactive element amounts wagered.

In some embodiments, the interactive controller 400 includes an administration interface 430 used to provide self-reconfiguring wagering system administration telemetry data 432 to and from the user.

In some embodiments, the interactive controller includes one or more sensors 424. Such sensors may include, but are not limited to, physiological sensors that monitor the physiology of the user, environmental sensors that monitor the physical environment of the interactive controller, accelerometers that monitor changes in motion of the interactive controller, and location sensors that monitor the location of the interactive controller such as global positioning sensors (GPSs). The interactive controller 400 communicates sensor telemetry data 426 to one or more components of the self-reconfiguring wagering system.

Referring now to FIG. 4B, interactive controller 400 includes a bus 502 that provides an interface for one or more processors 504, random access memory (RAM) 506, read only memory (ROM) 508, machine-readable storage medium 510, one or more user output devices 512, one or more user input devices 514, and one or more communication interface devices 516.

The one or more processors 504 may take many forms, such as, but not limited to: a central processing unit (CPU); a multi-processor unit (MPU); an ARM processor; a controller; a programmable logic device; or the like.

In the example embodiment, the one or more processors 504 and the random access memory (RAM) 506 form an interactive controller processing unit 599. In some embodiments, the interactive controller processing unit includes one or more processors operatively connected to one or more of a RAM, ROM, and machine-readable storage medium; the one or more processors of the interactive controller processing unit receive instructions stored by the one or more of a RAM, ROM, and machine-readable storage medium via a bus; and the one or more processors execute the received instructions. In some embodiments, the interactive controller processing unit is an ASIC (Application-Specific Integrated Circuit). In some embodiments, the interactive controller processing unit is a SoC (System-on-Chip).

Examples of output devices 512 include, but are not limited to, display screens; light panels; and/or lighted displays. In accordance with particular embodiments, the one or more processors 504 are operatively connected to audio output devices such as, but not limited to: speakers; and/or sound amplifiers. In accordance with many of these embodiments, the one or more processors 504 are operatively connected to tactile output devices like vibrators, and/or manipulators.

Examples of user input devices 514 include, but are not limited to: tactile devices including but not limited to, keyboards, keypads, foot pads, touch screens, and/or trackballs; non-contact devices such as audio input devices; motion sensors and motion capture devices that the interactive controller can use to receive inputs from a user when the user interacts with the interactive controller; physiological sensors that monitor the physiology of the user; environmental sensors that monitor the physical environment of the interactive controller; accelerometers that monitor changes in motion of the interactive controller; and location sensors that monitor the location of the interactive controller such as global positioning sensors.

The one or more communication interface devices 516 provide one or more wired or wireless interfaces for communicating data and commands between the interactive controller 400 and other devices that may be included in a self-reconfiguring wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface, a cellular or satellite telephone network interface; and the like.

The machine-readable storage medium 510 stores machine-executable instructions for various components of the interactive controller, such as but not limited to: an operating system 518; one or more device drivers 522; one or more application programs 520 including but not limited to an interactive application; and self-reconfiguring wagering system interactive controller instructions and data 524 for use by the one or more processors 504 to provide the features of an interactive controller as described herein. In some embodiments, the machine-executable instructions further include application control interface/application control interface instructions and data 526 for use by the one or more processors 504 to provide the features of an application control interface/application control interface as described herein.

In various embodiments, the machine-readable storage medium 510 is one of a (or a combination of two or more of) a hard drive, a flash drive, a DVD, a CD, a flash storage, a solid state drive, a ROM, an EEPROM, and the like.

In operation, the machine-executable instructions are loaded into memory 506 from the machine-readable storage medium 510, the ROM 508 or any other storage location. The respective machine-executable instructions are accessed by the one or more processors 504 via the bus 502, and then executed by the one or more processors 504. Data used by the one or more processors 504 are also stored in memory 506, and the one or more processors 504 access such data during execution of the machine-executable instructions. Execution of the machine-executable instructions causes the one or more processors 504 to control the interactive controller 400 to provide the features of a self-reconfiguring wagering system interactive controller as described herein Although the interactive controller is described herein as being constructed from or configured using one or more processors and instructions stored and executed by hardware components, the interactive controller can be constructed from or configured using only hardware components in accordance with other embodiments. In addition, although the storage medium 510 is described as being operatively connected to the one or more processors through a bus, those skilled in the art of interactive controllers will understand that the storage medium can include removable media such as, but not limited to, a USB memory device, an optical CD ROM, magnetic media such as tape and disks. In some embodiments, the storage medium 510 can be accessed by the one or more processors 504 through one of the communication interface devices 516 or using a communication link. Furthermore, any of the user input devices or user output devices can be operatively connected to the one or more processors 504 vione of the communication interface devices 516 or using a communication link.

In some embodiments, the interactive controller 400 can be distributed across a plurality of different devices. In many such embodiments, an interactive controller of a self-reconfiguring wagering system includes an interactive application server operatively connected to an interactive client using a communication link. The interactive application server and interactive application client cooperate to provide the features of an interactive controller as described herein.

In various embodiments, the interactive controller 400 may be used to construct other components of a self-reconfiguring wagering system as described herein.

In some embodiments, components of an interactive controller and a process controller of a self-reconfiguring wagering system may be constructed from or configured using a single device using processes that communicate using an interprocess communication protocol. In other such embodiments, the components of an interactive controller and a process controller of a self-reconfiguring wagering system may communicate by passing messages, parameters or the like.

Figure 5A:
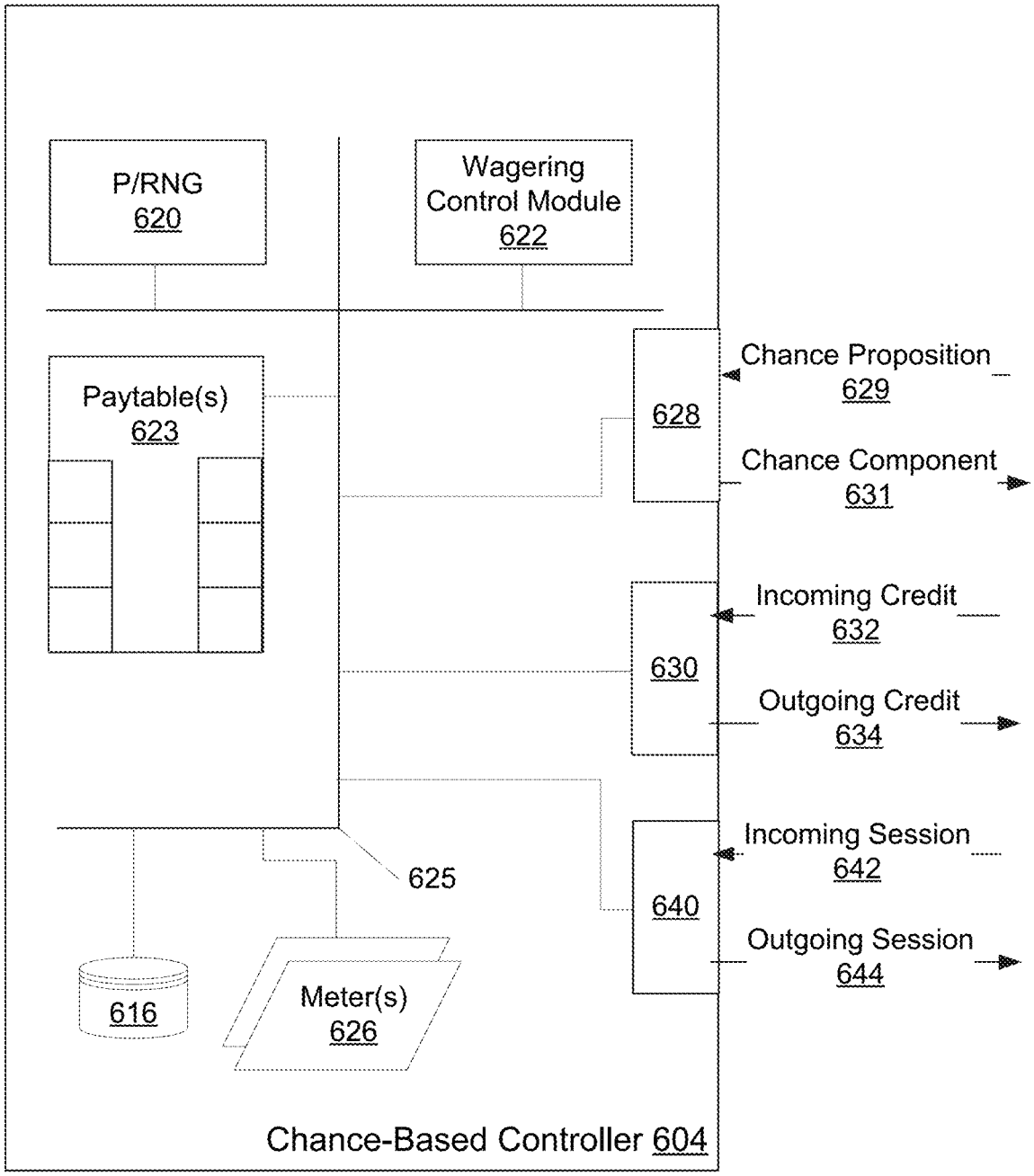
FIGS. 5A and 5B are diagrams of a structure of a chance-based controller of a self-reconfiguring wagering system in accordance with various embodiments of the invention.
Figure 5B:
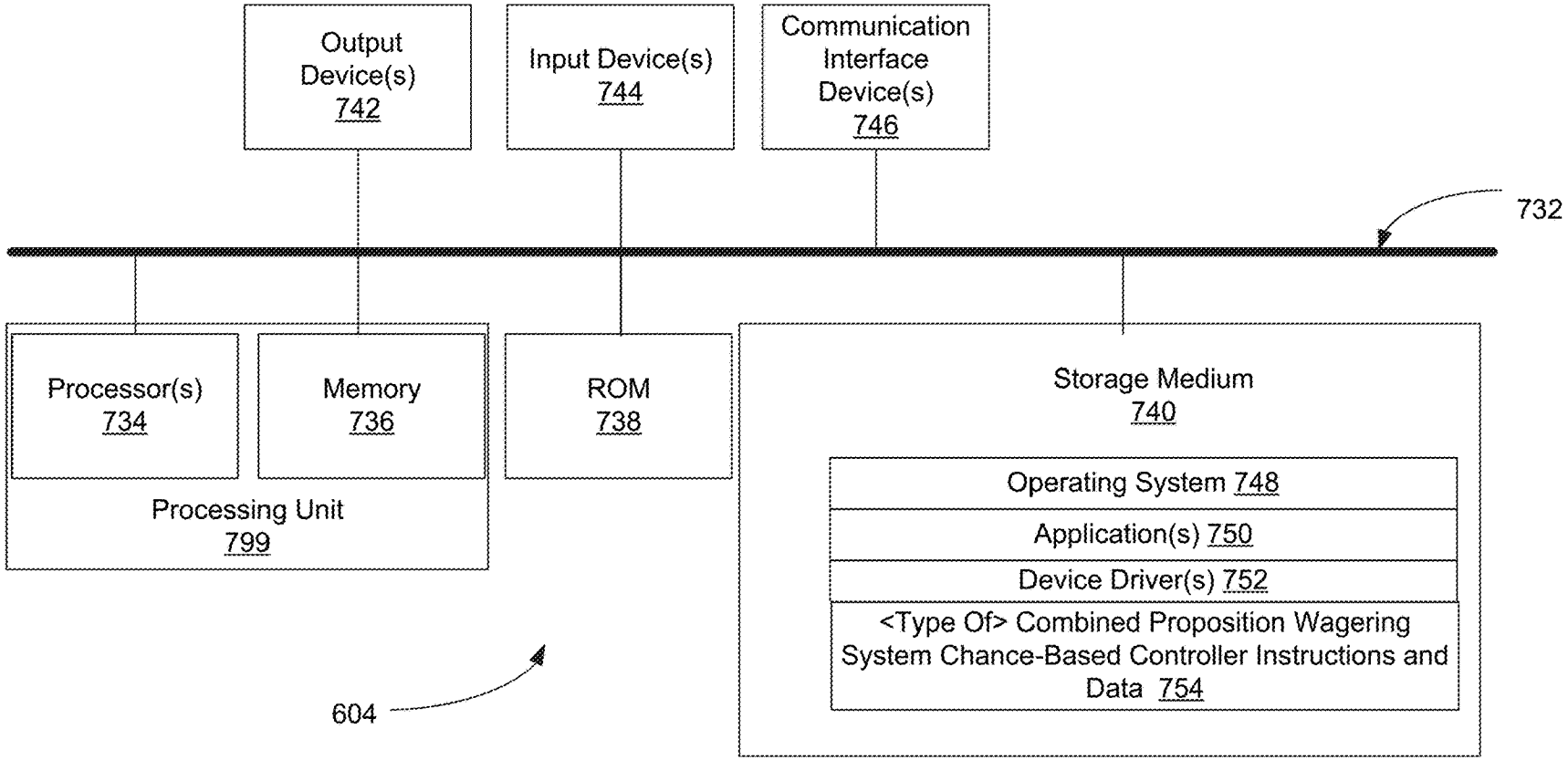

FIGS. 5A and 5B are diagrams of a structure of a chance-based controller of a self-reconfiguring wagering system in accordance with various embodiments of the invention. A chance-based controller may be constructed from or configured using one or more processing devices that perform the operations of the chance-based controller. In many embodiments, a chance-based controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, or the like.

Referring now to FIG. 5A, in various embodiments, a chance-based controller 604, suitable for use as chance-based controller 102 of FIG. 1, includes a random number generator (RNG) 620 to produce random results; one or more paytables 623 which includes a plurality of factors indexed by the random result to be multiplied with an amount of credits, application credits, interactive elements, or objects committed in a wager; and a wagering control module 622 whose processes may include, but are not limited to, generating random results, looking up factors in the paytables, multiplying the factors by an amount of credits, application credits, interactive elements, or objects wagered, and administering one or more credit, application credit, interactive element, or object meters 626. The various chance-based controller components can interface with each other via an internal bus 625 and/or other appropriate communication mechanism.

In some embodiments, an interface 628 allows the chance-based controller 604 to operatively connect to, and communicate with, an external device, such as one or more process controllers as described herein. The interface 628 provides for communication of chance proposition determination commands 629 from the external device that is used to specify chance-based proposition parameters and/or initiate resolution of a chance-based proposition by the chance-based controller 604 as described herein. The interface 628 may also provide for communicating chance outcome data 631 to an external device as described herein. In numerous embodiments, the interface 628 between the chance-based controller 604 and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

In various embodiments, an interface 630 allows the chance-based controller 604 to operatively connect to an external system or device, such as one or more credit processing systems, as described herein. The interface 630 provides for communication of incoming credit data 632 from the external system or device that is used to add credits to the one or more meters 626 as described herein. The interface 630 may also provide for communicating outgoing credit data 634 to an external system or device, such as a credit processing system, as described herein. In numerous embodiments, the interface 630 between the chance-based controller 604 and other systems/devices may be a wide area network (WAN) such as the Internet. However, other methods of communication may be used including, but not limited to, a local area network (LAN), a universal serial bus (USB) interface, and/or some other method by which two electronic devices or systems could communicate with each other.

In various embodiments, an interface 640 allows the chance-based controller 604 to operatively connect to an external system or device, such as one or more session/ management controllers, as described herein. The interface 640 provides for communication of incoming session data 642 from the external system or device as described herein. The interface 640 may also provide for communicating outgoing session data 644 to an external system or device, such as a session/management controller, as described herein. In numerous embodiments, the interface 640 between the chance-based controller 604 and other systems/devices may be a wide area network (WAN) such as the Internet. However, other methods of communication may be used including, but not limited to, a local area network (LAN), a universal serial bus (USB) interface, and/or some other method by which two electronic devices or systems could communicate with each other.

In various embodiments, a chance-based controller 604 may use a random number generator provided by an external system. The external system may be connected to the chance-based controller 604 by a suitable communication network such as a local area network (LAN) or a wide area network (WAN). In some embodiments, the external random number generator is a central deterministic system that provides random results to one or more connected chance-based controllers.

During operation of the chance-based controller, the external system communicates chance proposition determination commands 629 to the chance-based controller 604. The chance-based controller 604 receives the chance proposition determination commands and uses the chance proposition determination commands to initiate resolution of a chance-based proposition in accordance with a chance-based proposition. The chance-based controller 604 executes the chance-based proposition and determines a chance outcome for the chance-based proposition. The chance-based controller communicates chance outcome data 631 of the chance outcome to the external system.

In some embodiments, the chance-based controller uses the chance proposition determination commands to select a paytable 628 to use and/or an amount of credits, application credits, interactive elements, or objects for a chance-based proposition.

In some embodiments, the chance outcome data may include, but is not limited to, an amount of credits, application credits, interactive elements, or objects.

In various embodiments, the chance outcome data may include, but is not limited to, an amount of credits, application credits, interactive elements, or objects in the one or more meters 626.

In some embodiments, the chance outcome data includes state data for the chance-based proposition of the resolved chance-based proposition. The state data may correspond to one or more game states of a chance-based proposition that is associated with the chance-based proposition. Examples of state data include, but are not limited to, reel strips in an operation state or a final state for a reel-based chance-based proposition, one or more dice positions for a dice-based chance-based proposition, positions of a roulette wheel and roulette ball, position of a wheel of fortune, or the like.

In various embodiments, the chance-based proposition control module 622 determines an amount of a chance-based proposition and a paytable to use from the one or more paytables 623. In such embodiments, in response to the chance proposition determination commands initiating resolution of the chance-based proposition, the chance-based proposition control module 622 resolves the chance-based proposition by requesting a random number generator result from the RNG 620; retrieving a paytable from the one or more paytables 623; adjusting the one or more credit meters 626 for an amount of the wager; applying the random number generator result to the retrieved paytable; multiplying the resultant factor from the paytable by an amount wagered to determine a chance outcome; updating the one or more meters 626 based on the chance outcome; and communicating the chance outcome to the external device.

In various embodiments, an external system communicates a request for a random number generator result from the chance-based controller 604. In response, the chance-based controller 604 returns a random number generator result as a function of an internal random number generator or a random number generator external to the external system to which the chance-based controller 604 is operatively connected.

In some embodiments, a communication exchange between the chance-based controller 604 and an external system relate to the external system support for coupling a random number generator result to a particular paytable contained in the chance-based controller 604. In such an exchange, the external system communicates to the chance-based controller 604 as to which of the one or more paytables 623 to use, and requests a result whereby the random number generator result would be associated with the requested paytable 623. The result of the coupling is returned to the external system. In such an exchange, no actual credit, application credit, interactive element, or object chance outcome is determined, but might be useful in coupling certain non-value wagering interactive application behaviors and propositions to the same final resultant chance outcome which is understood for the self-reconfiguring wagering system.

In some embodiments, the chance-based controller 604 may also include storage for statuses, wagers, chance outcomes, meters and other historical events in a storage device 616.

In some embodiments, an authorization access module provides a process to permit access and command exchange with the chance-based controller 604 and access to the one or more credit meters 626 for the amount of credits, application credits, interactive elements, or objects being wagered by the user in the self-reconfiguring wagering system.

In numerous embodiments, communication occurs between various types of a chance-based controller and an external system 630, such as process controller. In some of these embodiments, the purpose of the chance-based controller is to allocate wagers to pools, detect occurrences of one or more events upon which the wagers were made, and determine the chance outcomes for each individual random number generator based on the number of winning chance outcomes and the amount paid into the pool.

In some embodiments, the chance-based controller manages accounts for individual users wherein the users make deposits into the accounts, amounts are deducted from the accounts, and amounts are credited to the users' accounts based on the chance outcomes.

In some embodiments a chance-based controller is a pari-mutuel wagering system such as used for wagering on an events such as horse races, greyhound races, sporting events and the like. In a pari-mutuel wagering system, user's wagers on the outcome of an event are allocated to a pool. When the event occurs, chance outcomes are calculated by sharing the pool among all winning wagers.

In various embodiments, a chance-based controller is a central determination system, such as but not limited to a central determination system for a Class II wagering system or a wagering system in support of a "scratch off" style lottery. In such a wagering system, a user plays against other users and competes for a common prize. In a given set of chance outcomes, there are a certain number of wins and losses. Once a certain chance outcome has been determined, the same chance outcome cannot occur again until a new set of chance outcomes is generated.

In numerous embodiments, communication occurs between various components of a chance-based controller 604 and an external system, such as a process controller.

Referring now to FIG. 5B, chance-based controller 604 includes a bus 732 that provides an interface for one or more processors 734, random access memory (RAM) 736, read only memory (ROM) 738, machine-readable storage medium 740, one or more user output devices 742, one or more user input devices 744, and one or more communication interface and/or network interface devices 746.

The one or more processors 734 may take many forms, such as, but not limited to, a central processing unit (CPU), a multi-processor unit (MPU), an ARM processor, a controller, a programmable logic device, or the like.

In the example embodiment, the one or more processors 734 and the random access memory (RAM) 736 form a chance-based controller processing unit 799. In some embodiments, the chance-based controller processing unit includes one or more processors operatively connected to one or more of a RAM, ROM, and machine-readable storage medium; the one or more processors of the chance-based controller processing unit receive instructions stored by the one or more of a RAM, ROM, and machine-readable storage medium via a bus; and the one or more processors execute the received instructions. In some embodiments, the chance-based controller processing unit is an ASIC (Application-Specific Integrated Circuit). In some embodiments, the chance-based controller processing unit is a SoC (System-on-Chip).

Examples of output devices 742 include, but are not limited to, display screens, light panels, and/or lighted displays. In accordance with particular embodiments, the one or more processors 734 are operatively connected to audio output devices such as, but not limited to speakers, and/or sound amplifiers. In accordance with many of these embodiments, the one or more processors 734 are operatively connected to tactile output devices like vibrators, and/or manipulators.

Examples of user input devices 734 include, but are not limited to, tactile devices including but not limited to, keyboards, keypads, touch screens, and/or trackballs; non-contact devices such as audio input devices; motion sensors and motion capture devices that the chance-based controller can use to receive inputs from a user when the user interacts with the chance-based controller 604.

The one or more communication interface and/or network interface devices 746 provide one or more wired or wireless interfaces for exchanging data and commands between the chance-based controller 604 and other devices that may be included in a self-reconfiguring wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface; a cellular or satellite telephone network interface; and the like.

The machine-readable storage medium 740 stores machine-executable instructions for various components of a chance-based controller, such as but not limited to: an operating system 748; one or more application programs 750; one or more device drivers 752; and self-reconfiguring wagering system chance-based controller instructions and data 754 for use by the one or more processors 734 to provide the features of a self-reconfiguring wagering system chance-based controller as described herein.

In various embodiments, the machine-readable storage medium 740 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 740, the ROM 738 or any other storage location. The respective machine-executable instructions are accessed by the one or more processors 734 via the bus 732, and then executed by the one or more processors 734. Data used by the one or more processors 734 are also stored in memory 736, and the one or more processors 734 access such data during execution of the machine-executable instructions. Execution of the machine-executable instructions causes the one or more processors 734 to control the chance-based controller 604 to provide the features of a self-reconfiguring wagering system chance-based controller as described herein Although the chance-based controller 604 is described herein as being constructed from or configured using one or more processors and machine-executable instructions stored and executed by hardware components, the chance-based controller can be composed of only hardware components in accordance with other embodiments. In addition, although the storage medium 740 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 740 can be accessed by the one or more processors 734 through one of the interfaces or using a communication link. Furthermore, any of the user input devices or user output devices can be operatively connected to the one or more processors 734 vione of the interfaces or using a communication link.

In various embodiments, the chance-based controller 604 may be used to construct other components of a self-reconfiguring wagering system as described herein.

In some embodiments, components of a chance-based controller and a process controller of a self-reconfiguring wagering system may be constructed from or configured using a single device using processes that communicate using an interprocess communication protocol. In other such embodiments, the components of a chance-based controller and a process controller of a self-reconfiguring wagering system may communicate by passing messages, parameters or the like.

It should be understood that there may be many embodiments of a chance-based controller 604 which could be possible, including forms where many modules and components of the chance-based controller are located in various servers and locations, so the foregoing is not meant to be exhaustive or all inclusive, but rather provide data on various embodiments of a chance-based controller 604.

Figure 6A:
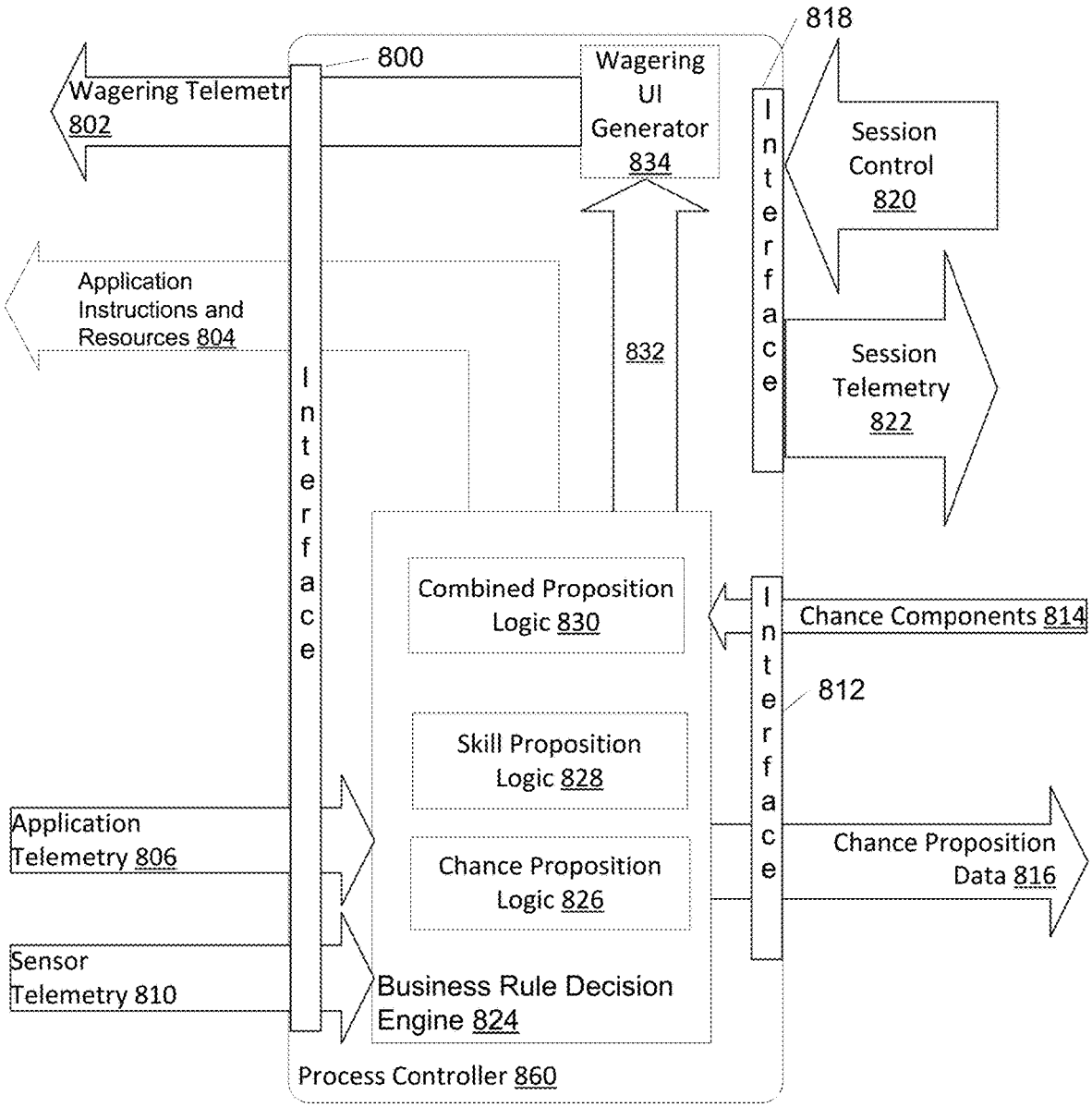
FIGS. 6A and 6B are diagrams of a structure of a process controller of a self-reconfiguring wagering system in accordance with various embodiments of the invention.
Figure 6B:
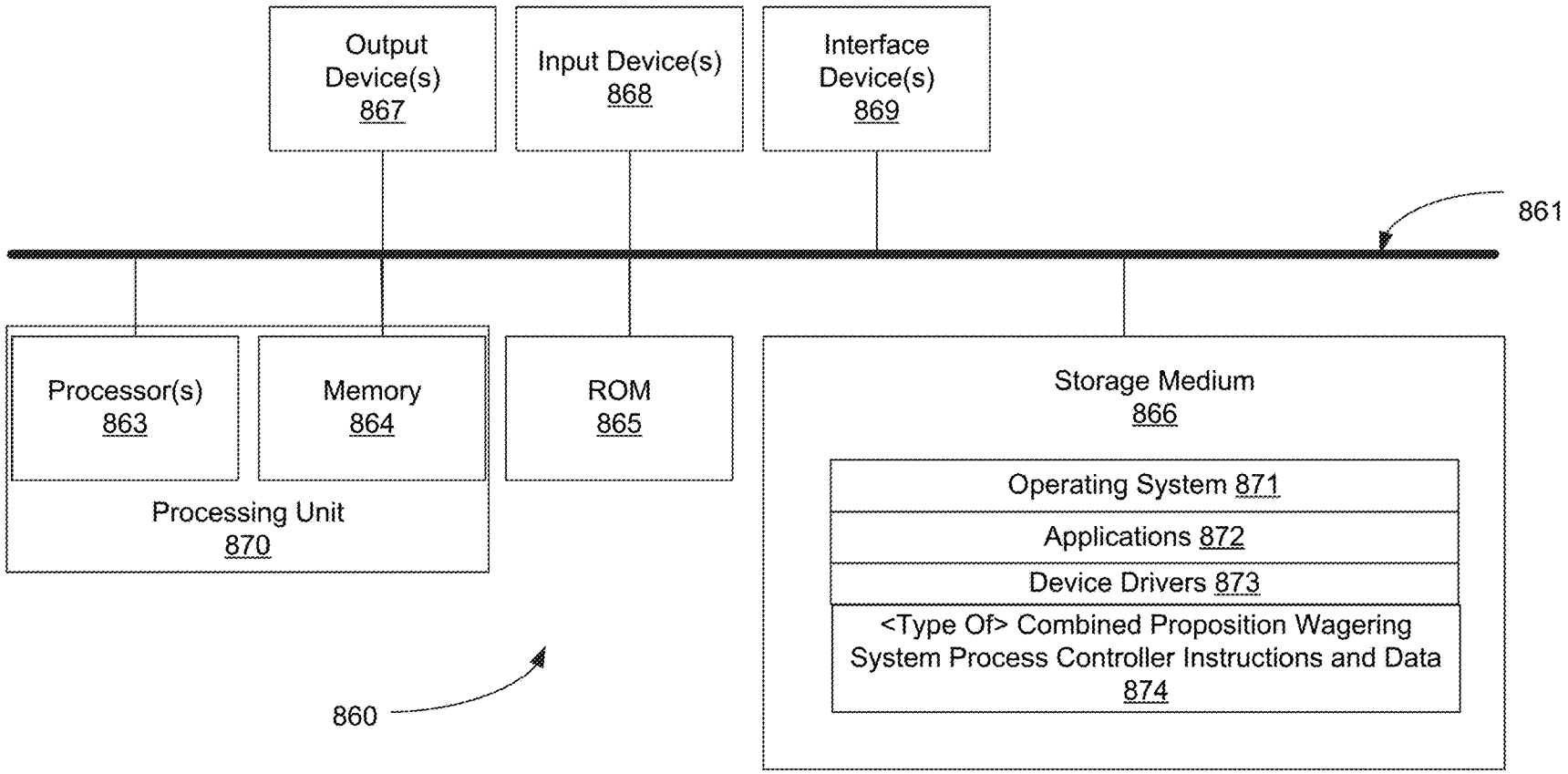

FIGS. 6A and 6B are diagrams of a structure of a process controller of a self-reconfiguring wagering system in accordance with various embodiments of the invention. A process controller may be constructed from or configured using one or more processing devices that perform the operations of the process controller. In many embodiments, a process controller can be constructed from or configured using various types of processing devices including, but not limited to, a mobile device such as a smartphone, a personal digital assistant, a wireless device such as a tablet computer or the like, an electronic gaming machine, a personal computer, a gaming console, a set-top box, a computing device, a controller, or the like.

Referring now to FIG. 6A, in many embodiments, a process controller 860, suitable for use as process controller 112 of FIG. 1, manages operation of a self-reconfiguring wagering system, with a chance-based controller and an interactive controller being support units to the process controller 860. The process controller 860 provides an interface between the interactive application, provided by an interactive controller, and a chance-based proposition, provided by a chance-based controller.

In some embodiments, the process controller 860 includes an interactive controller interface 800 to an interactive controller. The interactive controller interface 800 provides for communication of data between an interactive controller and the process controller 860, including but not limited to wagering telemetry data 802, application instructions and resources 804, application telemetry data 806, and sensor telemetry data 810 as described herein.

In various embodiments, the process controller 860 includes a chance-based controller interface 812 to a chance-based controller. The chance-based controller interface 812 provides for communication of data between the process controller 860 and a chance-based controller, including but not limited to chance outcomes 814 and chance proposition determination commands 816 as described in.

In some embodiments, the process controller 860 includes a session/management controller interface 818 to a session/management controller. The session/management controller interface 818 provides for communication of data between the process controller 860 and a session/management controller, including but not limited to session control data 820 and session telemetry data 822 as described herein.

The process controller 860 includes a rule-based decision engine 824 that receives telemetry data, such as application telemetry data and sensor telemetry data, from an interactive controller. The rule-based decision engine 824 uses the telemetry data, along with chance proposition logic 826 to generate chance proposition data 816 used to command a chance-based controller to initiate resolution of a chance-based outcome. The chance proposition data may include, but are not limited to, an amount and type of the chance-based outcome, a request for resolution of the chance-based outcome, and a selection of a paytable to be used when resolving the chance-based proposition.

In some embodiments, the application telemetry data includes, but is not limited to, application environment variables that indicate the state of an interactive application being used by a user, interactive controller data indicating a state of an interactive controller, and user actions and interactions between a user and an interactive application provided by an interactive controller.

In some embodiments, the rule-based decision engine 824 also receives chance outcome data 814 from a chance-based controller. The decision engine 824 uses the chance outcome data, in conjunction with telemetry data and skill proposition logic 828 to generate application instructions and resources 804 for a skill proposition that is to be presented to a user by an interactive application of an interactive controller. The application instructions and resources 804 are communicated to the interactive application of the interactive controller.

In some embodiments, the application telemetry data 806 may further include a skill outcome determined by the interactive application in response to a user's skillful interactions with the skill proposition that was presented to the user.

In various embodiments, the rule-based decision engine 824 also determines an amount of application credit to award to a user based at least in part on the user's use of an interactive application of the self-reconfiguring wagering system as determined from application telemetry data. In some embodiments, chance outcome data may also be used to determine the amount of application credit that should be awarded to the user.

In numerous embodiments, an interactive application is a skill-based interactive application and the application credit is awarded to the user for the user's skillful play of the skill-based interactive application.

In some embodiments, the business rule decision engine 824 uses self-reconfiguring logic 830 to generate a combined outcome using the skill outcome data included in the application telemetry 806 and the chance outcome data 814. Data of the combined outcome 832 are communicated to a wagering user interface generator 834. The wagering user interface generator 834 receives the combined outcome data 832 and generates wagering telemetry data 802 describing the state of wagering and credit accumulation and loss for the self-reconfiguring wagering system. In some embodiments, the wagering telemetry data 146 may include, but is not limited to, amounts of application credits and interactive elements earned, lost or accumulated by the user through use of the interactive application as determined from the application decisions, and credit amounts won, lost or accumulated as determined from the combined outcome data 832 and one or more credit meters.

The process controller 860 can further operatively connect to a chance-based controller to determine an amount of credit or interactive elements available and other wagering metrics of a chance-based proposition. Thus, the process controller 860 may potentially affect an amount of credits in play for participation in the wagering events of a chance-based proposition provided by the chance-based controller. The process controller 860 may additionally include various audit logs and activity meters. In some embodiments, the process controller 860 can also couple to a centralized server for exchanging various data related to the user and the activities of the user during game play of a self-reconfiguring wagering system.

In some embodiments, the operation of the process controller 860 does not affect the provision of a chance-based proposition by a chance-based controller except for user choice parameters that are allowable in accordance with the chance-based proposition.

In a number of embodiments, communication of chance proposition determination commands between a chance-based controller and the process controller 860 can further be used to communicate various wagering control factors that the chance-based controller uses as input. Examples of wagering control factors include, but are not limited to, an amount of credits, application credits, interactive elements, or objects consumed per wagering event, and/or the user's election to enter a jackpot round.

In some embodiments, the process controller 860 utilizes a wagering user interface to communicate certain interactive application data to the user, including but not limited to, club points, user status, control of the selection of user choices, and messages which a user can find useful in order to adjust the interactive application experience or understand the wagering status of the user in accordance with the chance-based proposition in the chance-based controller.

In some embodiments, the process controller 860 utilizes a wagering user interface to communicate aspects of a chance-based proposition to the user including, but not limited to, odds of certain chance outcomes, amount of credits, application credits, interactive elements, or objects in play, and amounts of credits, application credits, interactive elements, or objects available.

In a number of embodiments, a chance-based controller can accept chance-based proposition factors including, but not limited to, modifications in the amount of credits, application credits, interactive elements, or objects wagered on each individual wagering event, a number of wagering events per minute the chance-based controller can resolve, entrance into a bonus round, and other factors. In several embodiments, the process controller 860 can communicate a number of factors back and forth to the chance-based controller, such that an increase/decrease in a wagered amount can be related to the change in user profile of the user in the interactive application. In this manner, a user can control a chance-based proposition credit amount per wagering event in accordance with the chance-based proposition with the change mapping to a parameter or component that is applicable to the interactive application experience.

Referring now to FIG. 6B, process controller 860 includes a bus 861 providing an interface for one or more processors 863, random access memory (RAM) 864, read only memory (ROM) 865, machine-readable storage medium 866, one or more user output devices 867, one or more user input devices 868, and one or more communication interface and/or network interface devices 869.

The one or more processors 863 may take many forms, such as, but not limited to: a central processing unit (CPU); a multi-processor unit (MPU); an ARM processor; a programmable logic device; or the like.

Examples of output devices 867 include, include, but are not limited to: display screens; light panels; and/or lighted displays. In accordance with particular embodiments, the one or more processors 863 are operatively connected to audio output devices such as, but not limited to: speakers; and/or sound amplifiers. In accordance with many of these embodiments, the one or more processors 863 are operatively connected to tactile output devices like vibrators, and/or manipulators.

In the example embodiment, the one or more processors 863 and the random access memory (RAM) 864 form a process controller processing unit 870. In some embodiments, the process controller processing unit includes one or more processors operatively connected to one or more of a RAM, ROM, and machine-readable storage medium; the one or more processors of the process controller processing unit receive instructions stored by the one or more of a RAM, ROM, and machine-readable storage medium via a bus; and the one or more processors execute the received instructions. In some embodiments, the process controller processing unit is an ASIC (Application-Specific Integrated Circuit). In some embodiments, the process controller processing unit is a SoC (System-on-Chip).

Examples of user input devices 868 include, but are not limited to: tactile devices including but not limited to, keyboards, keypads, foot pads, touch screens, and/or trackballs; non-contact devices such as audio input devices; motion sensors and motion capture devices that the process controller can use to receive inputs from a user when the user interacts with the process controller 860.

The one or more communication interface and/or network interface devices 869 provide one or more wired or wireless interfaces for exchanging data and commands between the process controller 860 and other devices that may be included in a self-reconfiguring wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS), cellular, or satellite telephone network interface; and the like.

The machine-readable storage medium 866 stores machine-executable instructions for various components of the process controller 860 such as, but not limited to: an operating system 871; one or more applications 872; one or more device drivers 873; and self-reconfiguring wagering system process controller instructions and data 874 for use by the one or more processors 863 to provide the features of a process controller as described herein.

In various embodiments, the machine-readable storage medium 870 is one of a (or a combination of two or more of) a hard drive, a flash drive, a DVD, a CD, a flash storage, a solid state drive, a ROM, an EEPROM, and the like.

In operation, the machine-executable instructions are loaded into memory 864 from the machine-readable storage medium 866, the ROM 865 or any other storage location. The respective machine-executable instructions are accessed by the one or more processors 863 via the bus 861, and then executed by the one or more processors 863. Data used by the one or more processors 863 are also stored in memory 864, and the one or more processors 863 access such data during execution of the machine-executable instructions. Execution of the machine-executable instructions causes the one or more processors 863 to control the process controller 860 to provide the features of a self-reconfiguring wagering system process controller as described herein.

Although the process controller 860 is described herein as being constructed from or configured using one or more processors and instructions stored and executed by hardware components, the process controller can be composed of only hardware components in accordance with other embodiments. In addition, although the storage medium 866 is described as being operatively connected to the one or more processors through a bus, those skilled in the art of process controllers will understand that the storage medium can include removable media such as, but not limited to, a USB memory device, an optical CD ROM, magnetic media such as tape and disks. Also, in some embodiments, the storage medium 866 may be accessed by processor 863 through one of the interfaces or using a communication link. Furthermore, any of the user input devices or user output devices may be operatively connected to the one or more processors 863 via one of the interfaces or using a communication link.

In various embodiments, the process controller 860 may be used to construct other components of a self-reconfiguring wagering system as described herein.

In some embodiments, components of an interactive controller and a process controller of a self-reconfiguring wagering system may be constructed from or configured using a single device using processes that communicate using an interprocess communication protocol. In other such embodiments, the components of an interactive controller and a process controller of a self-reconfiguring wagering system may communicate by passing messages, parameters or the like.

Figure 7A:
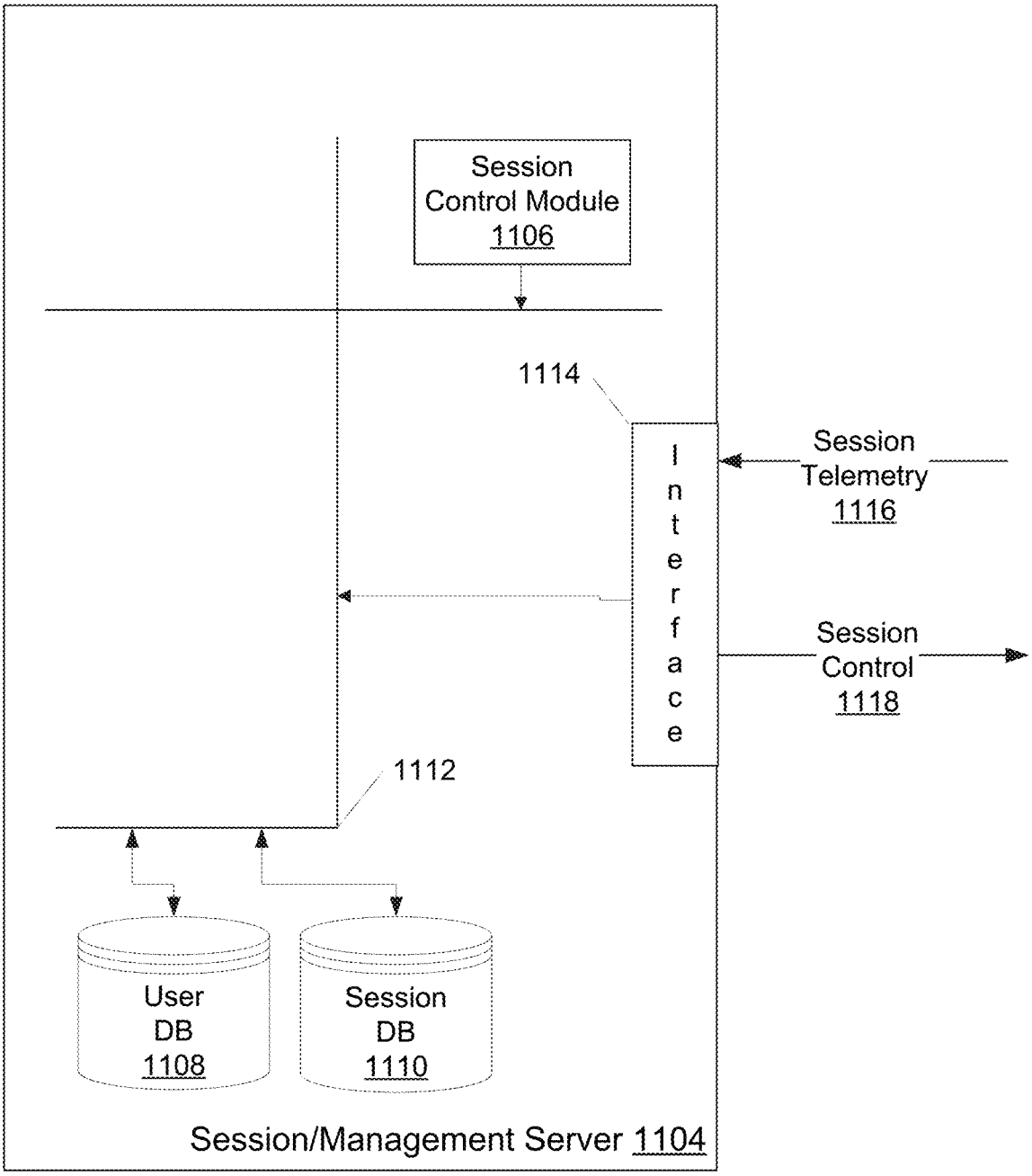
FIGS. 7A and 7B are diagrams of a structure of a session/management controller of a self-reconfiguring wagering system in accordance with various embodiments of the invention.
Figure 7B:
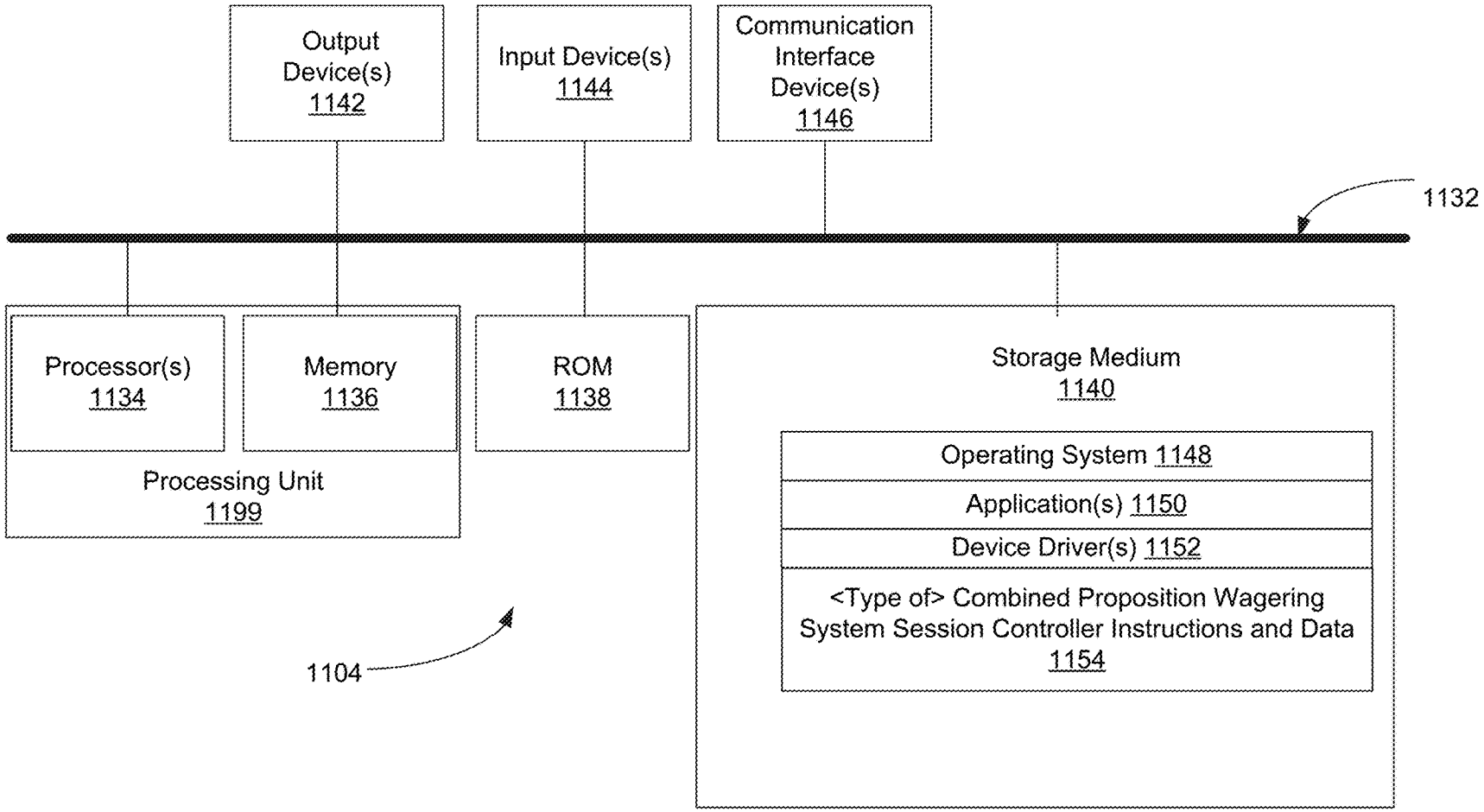

FIGS. 7A and 7B are diagrams of a structure of a session/management controller of a self-reconfiguring wagering system in accordance with various embodiments of the invention. A session/management controller may be constructed from or configured using one or more processing devices that perform the operations of the session/management controller. In many embodiments, a session/management controller can be constructed from or configured using various types of processing devices including, but not limited to, a mobile device such as a smartphone or the like, a personal digital assistant, a wireless device such as a tablet computer or the like, an electronic gaming machine, a personal computer, a gaming console, a set-top box, a computing device, a controller, a server, or the like.

Referring now to FIG. 7A, in various embodiments, a session/management controller 1104, suitable for use as session/management controller 150 of FIG. 1, includes a user management and session control module 1106 whose processes may include, but are not limited to, registering users of a self-reconfiguring wagering system, validating users of a self-reconfiguring wagering system using user registration data, managing various types of sessions for users of the self-reconfiguring wagering system, and the like.

The session/management controller 1104 may further include a datastore 1108 storing user data used to manage user registration and validation. The session/management controller 1104 may further include a datastore 1110 storing session data used to manage one or more sessions.

The various session/management controller components can interface with each other via an internal bus 1112 and/or other appropriate communication mechanism.

An interface 1114 allows the session/management controller 1104 to operatively connect to one or more external devices, such as one or more process controllers, chance-based controllers and/or interactive controllers as described herein. The interface provides for receiving session telemetry data 1116 from the one more external devices as described herein. The session telemetry data includes, but is not limited to, amounts of application credit earned by one or more users, requests for entering into a session as described herein, and telemetry data regarding the progress of one or more users during a session. The interface 1114 may also provide for communicating secession control data 1118 used to manage a session as described herein.

In numerous embodiments, the interface between the session/management controller and other systems/devices may be a wide area network (WAN) such as the Internet. However, other methods of communication may be used including, but not limited to, a local area network (LAN), a universal serial bus (USB) interface, and/or some other method by which two electronic devices could communicate with each other.

During operation of the session/management controller, the external system communicates session telemetry data to the session/management controller. The session/management controller receives the session telemetry data and uses the session telemetry data to generate session control data as described herein. The session/management controller communicates the session control data to the external system.

Referring now to FIG. 7B, session/management controller 1104 includes a bus 1132 that provides an interface for one or more processors 1134, random access memory (RAM) 1136, read only memory (ROM) 1138, machine-readable storage medium 1140, one or more user output devices 1142, one or more user input devices 1144, and one or more communication interface and/or network interface devices 1146.

The one or more processors 1134 may take many forms, such as, but not limited to, a central processing unit (CPU), a multi-processor unit (MPU), an ARM processor, a controller, a programmable logic device, or the like.

In the example embodiment, the one or more processors 1134 and the random access memory (RAM) 1136 form a session/management controller processing unit 1199. In some embodiments, the session/management controller processing unit includes one or more processors operatively connected to one or more of a RAM, ROM, and machine-readable storage medium; the one or more processors of the session/management controller processing unit receive instructions stored by the one or more of a RAM, ROM, and machine-readable storage medium via a bus; and the one or more processors execute the received instructions. In some embodiments, the session/management controller processing unit is an ASIC (Application-Specific Integrated Circuit). In some embodiments, the session/management controller processing unit is a SoC (System-on-Chip).

Examples of output devices 1142 include, but are not limited to, display screens, light panels, and/or lighted displays. In accordance with particular embodiments, the one or more processors 1134 are operatively connected to audio output devices such as, but not limited to speakers, and/or sound amplifiers. In accordance with many of these embodiments, the one or more processors 1134 are operatively connected to tactile output devices like vibrators, and/or manipulators.

Examples of user input devices 1144 include, but are not limited to, tactile devices including but not limited to, keyboards, keypads, touch screens, and/or trackballs; non-contact devices such as audio input devices; motion sensors and motion capture devices that the session/management controller can use to receive inputs from a user when the user interacts with the session/management controller 1104.

The one or more communication interface and/or network interface devices 1146 provide one or more wired or wireless interfaces for exchanging data and commands between the session/management controller 1104 and other devices that may be included in a self-reconfiguring wagering system. Such wired and wireless interfaces include, but are not limited to: a Universal Serial Bus (USB) interface; a Bluetooth interface; a Wi-Fi interface; an Ethernet interface; a Near Field Communication (NFC) interface; a plain old telephone system (POTS) interface; a cellular or satellite telephone network interface; and the like.

The machine-readable storage medium 1140 stores machine-executable instructions for various components of a session/management controller, such as but not limited to: an operating system 1148; one or more application programs 1150; one or more device drivers 1152; and self-reconfiguring wagering system session/management controller instructions and data 1154 for use by the one or more processors 1134 to provide the features of a self-reconfiguring wagering system session/management controller as described herein.

In various embodiments, the machine-readable storage medium 1140 is one of a (or a combination of two or more of) a hard drive, a flash drive, a DVD, a CD, a flash storage, a solid state drive, a ROM, an EEPROM, and the like.

In operation, the machine-executable instructions are loaded into memory 736 from the machine-readable storage medium 1140, the ROM 1138 or any other storage location. The respective machine-executable instructions are accessed by the one or more processors 1134 via the bus 1132, and then executed by the one or more processors 1134. Data used by the one or more processors 1134 are also stored in memory 1136, and the one or more processors 1134 access such data during execution of the machine-executable instructions. Execution of the machine-executable instructions causes the one or more processors 1134 to control the session/management controller 1104 to provide the features of a self-reconfiguring wagering system session/management controller as described herein Although the session/management controller 1104 is described herein as being constructed from or configured using one or more processors and machine-executable instructions stored and executed by hardware components, the session/management controller can be composed of only hardware components in accordance with other embodiments. In addition, although the storage medium 1140 is described as being operatively connected to the one or more processors through a bus, those skilled in the art of processing devices will understand that the storage medium can include removable media such as, but not limited to, a USB memory device, an optical CD ROM, magnetic media such as tape and disks. In some embodiments, the storage medium 1140 can be accessed by the one or more processors 1134 through one of the interfaces or using a communication link. Furthermore, any of the user input devices or user output devices can be operatively connected to the one or more processors 1134 vione of the interfaces or using a communication link.

In various embodiments, the session/management controller 1104 may be used to construct other components of a self-reconfiguring wagering system as described herein.

In some embodiments, components of a session/management controller and a process controller of a self-reconfiguring wagering system may be constructed from or configured using a single device using processes that communicate using an interprocess communication protocol. In other such embodiments, the components of a session/management controller and a process controller of a self-reconfiguring wagering system may communicate by passing messages, parameters or the like.

In some embodiments, components of a session/management controller and a chance-based controller of a self-reconfiguring wagering system may be constructed from or configured using a single device using processes that communicate using an interprocess communication protocol. In other such embodiments, the components of a session/management controller and a process controller of a self-reconfiguring wagering system may communicate by passing messages, parameters or the like.

It should be understood that there may be many embodiments of a session/management controller 1104 which could be possible, including forms where many modules and components of the session/management controller are located in various servers and locations, so the foregoing is not meant to be exhaustive or all inclusive, but rather provide data on various embodiments of a session/management controller 1104.

In numerous embodiments, any of a chance-based controller, a process controller, an interactive controller, or a session/management controller as described herein can be constructed from or configured using multiple processing devices, whether dedicated, shared, or distributed in any combination thereof, or can be constructed from or configured using a single processing device. In addition, while certain aspects and features of self-reconfiguring wagering system processes described herein have been attributed to a chance-based controller, a process controller, an interactive controller, or a session/management controller, these aspects and features can be provided in a distributed form where any of the features or aspects can be provided by any of a session/management controller, a chance-based controller, a process controller, and/or an interactive controller within a self-reconfiguring wagering system without deviating from the spirit of the invention.

Although various components of self-reconfiguring wagering systems are discussed herein, self-reconfiguring wagering systems can be configured with any component as appropriate to the specification of a specific application in accordance with embodiments of the invention. In certain embodiments, components of a self-reconfiguring wagering system, such as a session/management controller, a process controller, a chance-based controller, and/or an interactive controller, can be configured in different ways for a specific self-reconfiguring wagering system.

In some embodiments, components of a session/management controller, an interactive controller, a process controller, and/or a chance-based controller of a self-reconfiguring wagering system may be constructed from or configured using a single device using processes that communicate using an interprocess communication protocol. In many embodiments, the components of a session/management controller, an interactive controller, a process controller and a chance-based controller of a self-reconfiguring wagering system may communicate by passing messages, parameters or the like.

In addition, while certain aspects and features of self-reconfiguring wagering system processes described herein have been attributed to a session/management controller, a chance-based controller, a process controller, or an interactive controller, these aspects and features can be provided in a distributed form where any of the features or aspects can be provided by any of a session/management controller, a chance-based controller, a process controller, and/or an interactive controller within a self-reconfiguring wagering system.

Operation of Self-Reconfiguring Wagering Systems

Figure 8A:
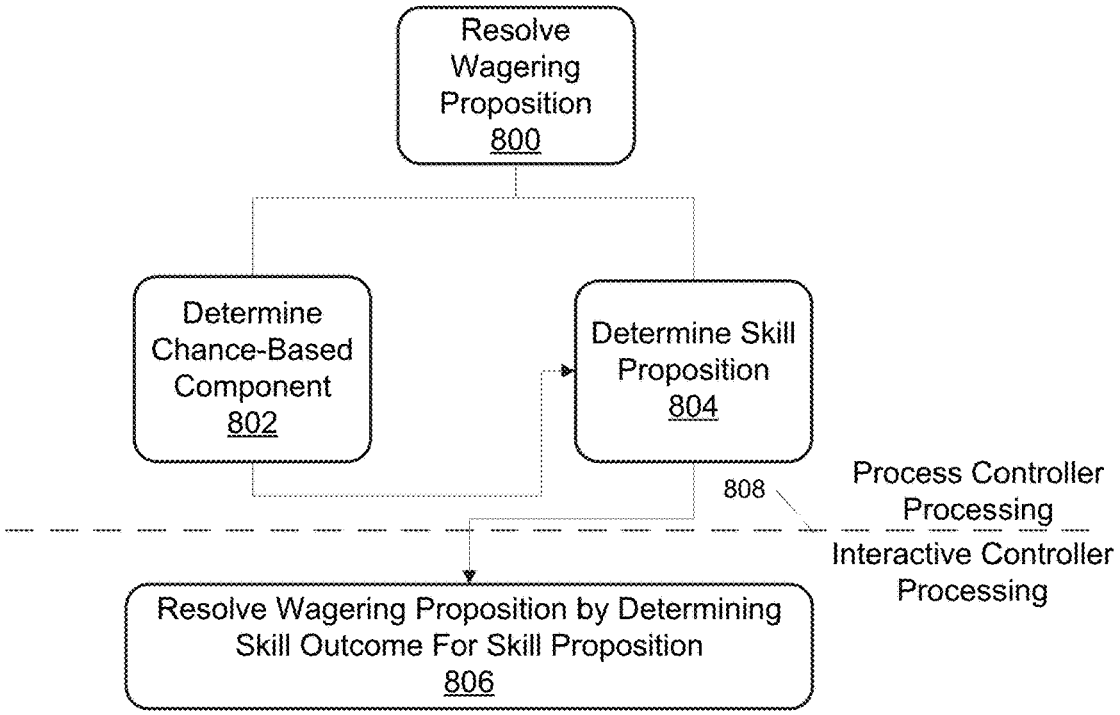
FIGS. 8A and 8B are block diagrams of a process of a self-reconfiguring wagering system in accordance with various embodiments of the present invention.

FIG. 8A is a block diagram of a process of a self-reconfiguring wagering system during a wagering session in accordance with various embodiments of the invention. A self-reconfiguring wagering system resolves 800 a wager proposition by determining 802 a set of chance components using one or more random outcomes. The set of chance components are then used to determine 804 a skill proposition that will be presented to one or more users. The wager is resolved 806 by determining a skill outcome for the skill proposition.

In some embodiments, as indicated by dashed line 808, a process controller of the self-reconfiguring wagering system performs processing for determining 802 the set of chance components and determining 804 the skill proposition while an interactive controller performs processing for determining 806 the skill outcome.

In an example embodiment, a wagering proposition of a self-reconfiguring wagering system is a head-to-head electronic card game played competitively by two users using a set of electronic cards. Each user wagers an amount of credits and the winning user receives all of the wagered credits minus an amount of credits for a hold of an operator of the self-reconfiguring wagering system. A process controller of the self-reconfiguring wagering system determines a random order of the electronic cards in the set of electronic cards as a set of chance components of the wagering proposition. The resultant randomized set of electronic cards are included in a skill proposition of the wagering proposition. The skill proposition may optionally include instructions in accordance with the electronic card game. Data of the skill proposition is communicated to an interactive controller of the self-reconfiguring wagering system. The interactive controller receives the data of the skill proposition. The interactive controller resolves the wagering proposition by determining a skill outcome by executing the electronic card game using skill outcome logic specific to the electronic card game, the randomized set of electronic cards, and optionally any instructions in accordance with the electronic card game received from the process controller. The skill outcome includes information about which user has won the electronic card game.

Figure 8B:
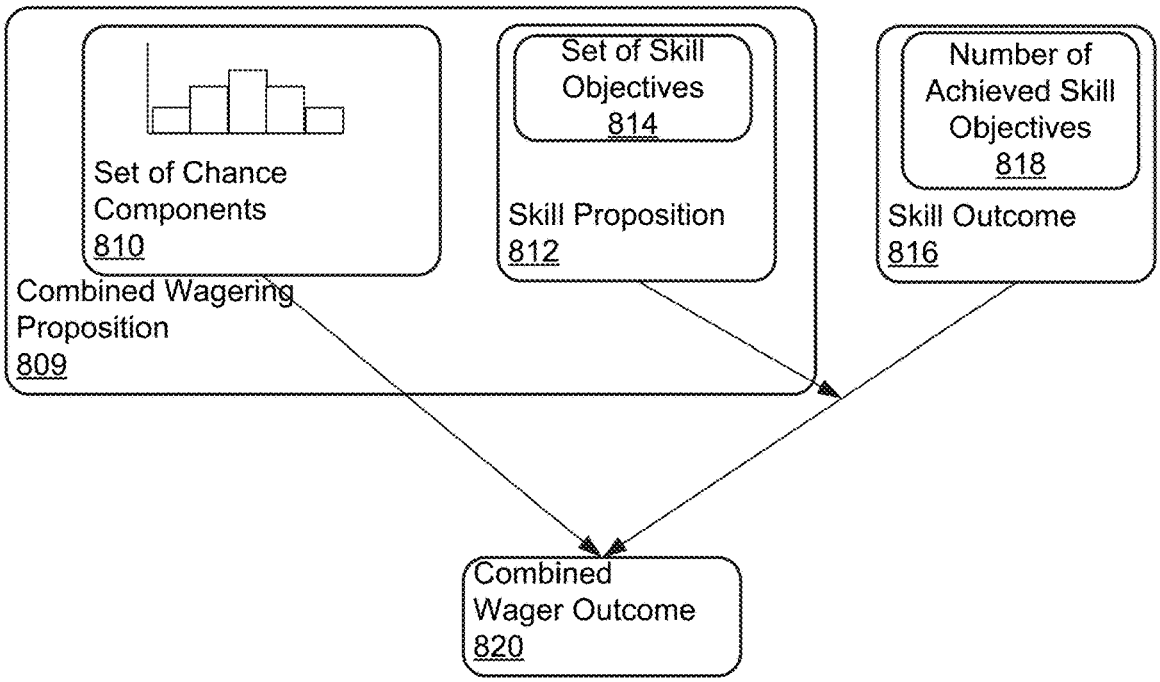

FIG. 8B is a block diagram of a wagering proposition of a self-reconfiguring wagering system during a wagering session in accordance with various embodiments of the invention. A combined wagering proposition 809 includes a set of chance components 810 and a skill proposition 812 having a set of skill objectives 814 that correspond to the set of chance components 810.

During operation, a self-reconfiguring wagering system presents the skill proposition to a user as a set of skill objectives to be achieved by the user. The self-reconfiguring wagering system determines a skill outcome 812 for the skill proposition including a number of skill objectives achieved by the user 812 when presented with the skill proposition. A combined wager outcome 820 is determined by combining the skill outcome 816 with the set of chance components 810 to allocate the chance outcomes of the set of chance outcomes to the user.

Figure 9A:
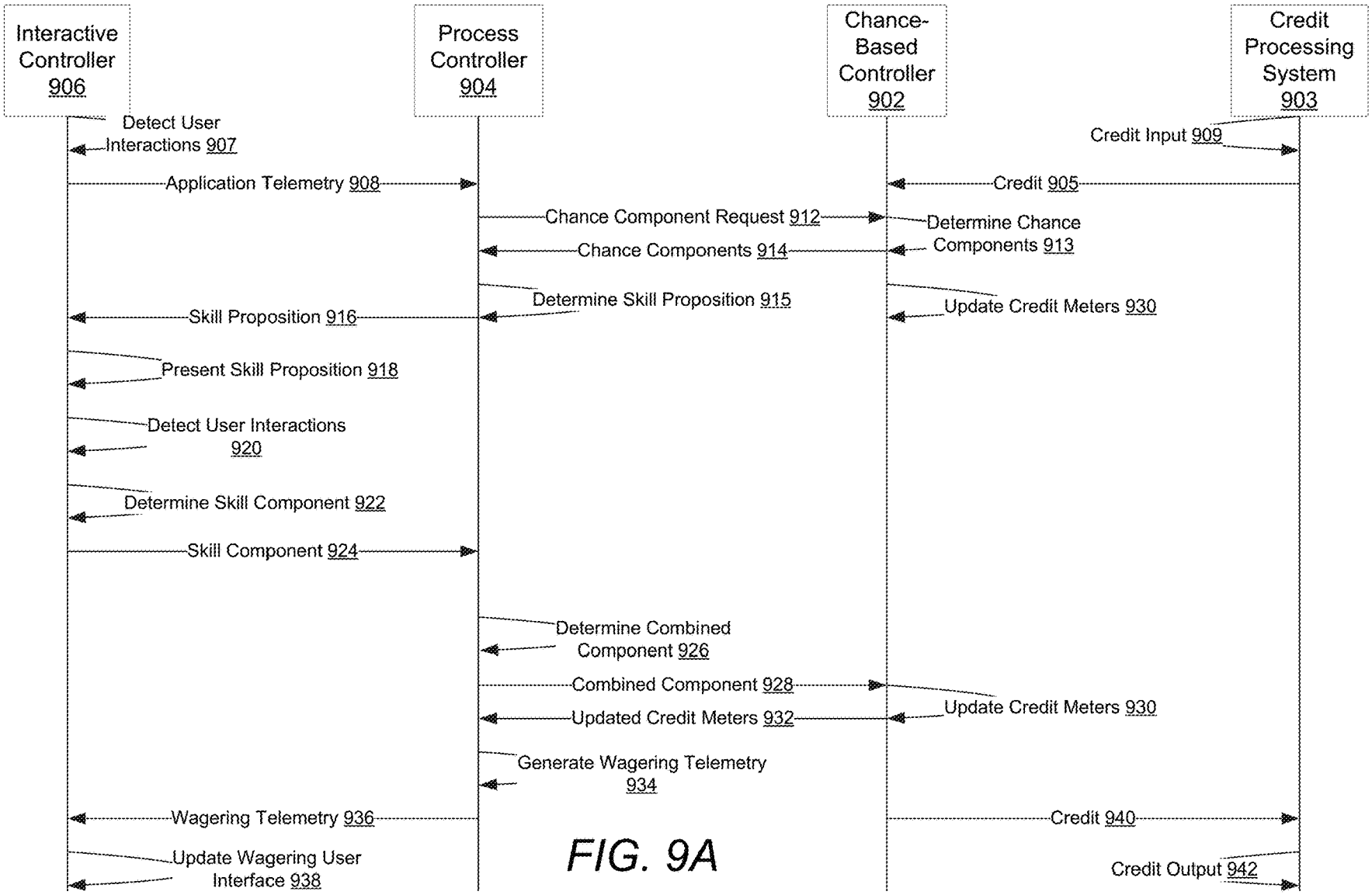
FIG. 9A is a sequence diagram of interactions between components of a self-reconfiguring wagering system in accordance with various embodiments of the invention.

FIG. 9A is a sequence diagram of interactions between components of a self-reconfiguring wagering system during a wagering session in accordance with various embodiments of the invention. The components of the self-reconfiguring wagering system include a chance-based controller 902, such as chance-based controller 102 of FIG. 1, a process controller 904, such as process controller 112 of FIG. 1, an interactive controller, such as interactive controller 120 of FIG. 1, and a credit processing system 903, such as credit processing system 198 of FIG. 1.

In some embodiments, at a beginning of the wagering session, the process includes a credit input 909 to the self-reconfiguring wagering system with chance-based controller 902 communicating with the credit processing system 903 to receive incoming credit data 905. The chance-based controller 902 uses the incoming credit data to transfer credits onto one or more credit meters associated with one or more users of the self-reconfiguring wagering system, thus transferring credits into the self-reconfiguring wagering system and on to the one or more credit meters.

In many embodiments, the interactive controller 906 detects 907 a user performing a user interaction in an interactive application user interface of an interactive application provided by the interactive controller 906. The interactive controller 906 communicates application telemetry data 908 to the process controller 904. The application telemetry data 908 includes, but is not limited to, the user interaction detected by the interactive controller 906.

The process controller 904 receives the application telemetry data 908. Upon determination by the process controller 904 that the user interaction indicates a wagering event in the interactive application, the process controller 904 generates chance outcome request data 912 that the process controller 904 uses to command the chance-based controller 902 to resolve a chance-based proposition. The chance outcome request data 912 may include chance-based proposition terms associated with a chance-based proposition. The process controller 904 communicates the chance outcome request data 912 to the chance-based controller 902.

The chance-based controller 902 receives the chance outcome request data 912 and uses the chance outcome request data to determine 913 a chance outcome for a chance-based proposition. The chance-based controller 902 updates 919 the one or more credit meters associated with the one or more users based on an amount of credits used for the chance-based proposition and stores amounts of credits awarded from the resolved chance-based proposition in one or more intermediate data stores. The chance-based controller 902 communicates data of the chance outcome 914 of the resolved chance-based outcome to the process controller 904.

The process controller 904 receives the chance outcome data 914 and determines 915 a skill proposition based in part on the chance outcome data 914. The skill proposition includes interactive application instruction and resource data that the process controller 904 uses to command the interactive controller 906 to present a skill proposition to a user. The process controller 904 communicates data of the skill proposition 916 to the interactive controller 906.

The interactive controller 906 receives the skill proposition data 916. The interactive application executing on the interactive controller 906 uses the skill proposition data to generate and present 918 a skill proposition to the user. The interactive controller 906 detects 920 skillful user interactions with the skill proposition presentation of the interactive application and determines 922 a skill outcome based on the user's skillful interactions. The interactive controller 906 communicates data of the skill outcome 924 to the process controller 904. The process controller 904 receives the skill outcome data 924 and determines 926 a combined outcome based on the skill outcome data 924 and the chance outcome data 914.

The process controller 904 communicates data of the combined outcome 928 to the chance-based controller 902. The chance-based controller 902 receives the combined outcome data 928 and updates 930 the one or more credit meters based in part on the combined outcome data 928. In some embodiments, if the combined outcome indicates that a user has been awarded credits, the chance-based controller 902 decrements credits stored on the intermediate credit meter and adds credits to the credit meter associated with the user. The chance-based controller communicates data of the updated credit meters 932 to the process controller 904. The process controller 904 receives the updated credit meter data 932 and generates 934 wagering telemetry data 936 using the combined outcome data 928 and the updated credit meter data 932. The process controller 904 communicates the wagering telemetry data 936 to the interactive controller 906. The interactive controller 906 receives the wagering telemetry data 936. The interactive controller 906 updates 936 a wagering user interface on a partial basis of the wagering telemetry data 936.

In many embodiments, upon determining that the wagering session is completed, such as by receiving a cashout communication from one or more users of the self-reconfiguring wagering system, the chance-based controller 902 transfers credits off of the one or more credit meters, generates outgoing credit data 940 on the basis of the credits transferred off of the one or more credit meters, and communicates the outgoing credit data 940 to the credit processing system 903. The credit processing system receives the outgoing credit data 940 and generates 942 a credit output as described herein, thus transferring credits off of the one or more credit meters and out of the self-reconfiguring wagering system.

In some embodiments, at a beginning of the wagering session, the process includes an application credit input to the self-reconfiguring wagering system with the process controller 904 communicating with the credit processing system 903 to receive incoming application credit data. The process controller 902 uses the incoming application credit data to transfer application credits onto one or more application credit meters associated with one or more users of the self-reconfiguring wagering system, thus transferring application credits into the self-reconfiguring wagering system and on to the one or more application credit meters. The process controller 904 uses the skill outcome data 924 to determine an amount of application credit to award to a user based on the user's skillful interactions with an interactive application executed by the interactive controller 905. Upon determining that the wagering session is completed, such as by receiving a cashout communication from one or more users of the self-reconfiguring wagering system, the process controller 904 transfers application credits off of the one or more application credit meters, generates outgoing application credit data on the basis of the application credits transferred off of the one or more application credit meters, and communicates the outgoing application credit data to the credit processing system 903. The credit processing system receives the outgoing application credit data and generates an application credit output as described herein, thus transferring application credits off of the one or more application credit meters and out of the self-reconfiguring wagering system.

Figure 9B:
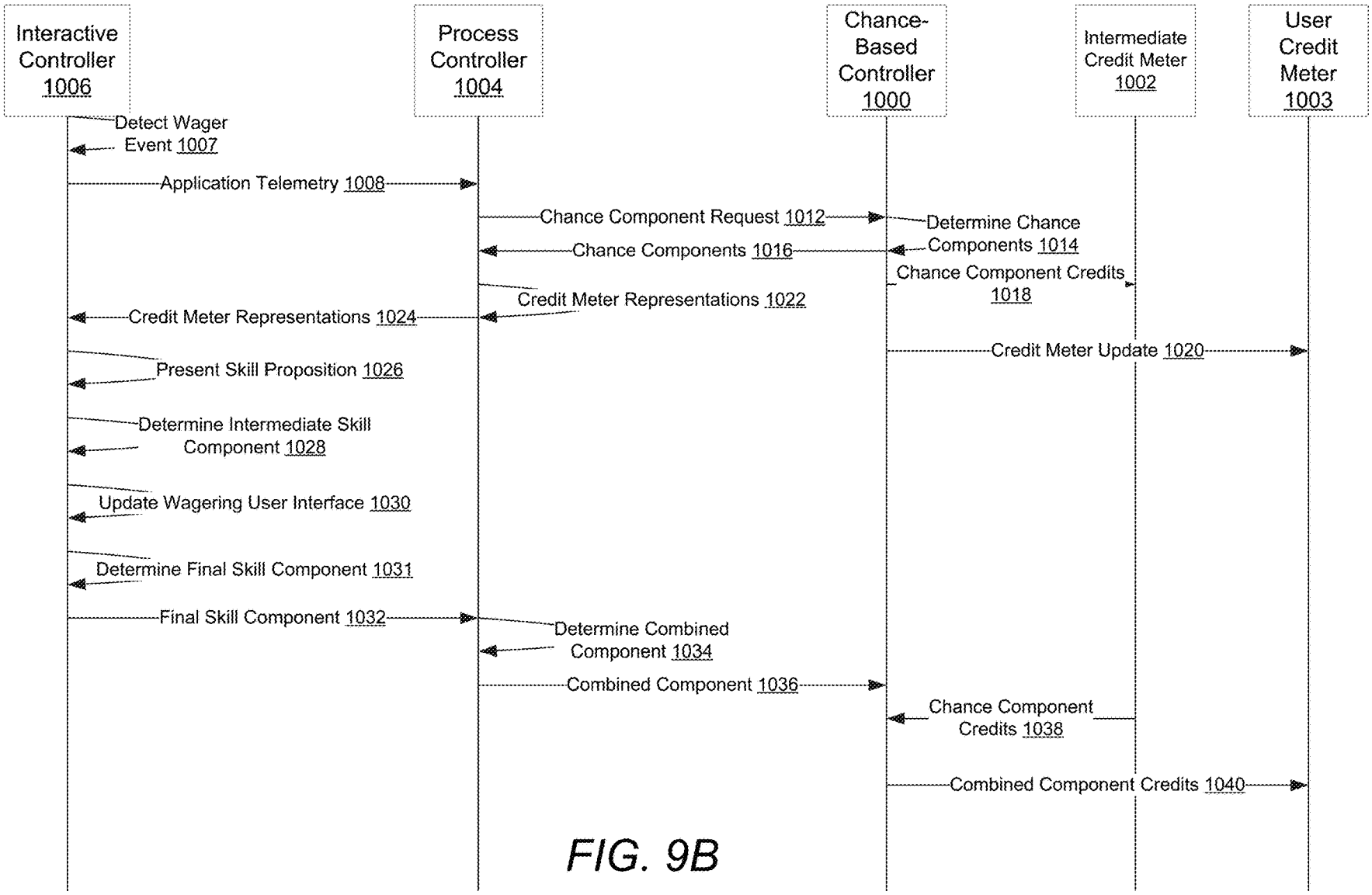
FIG. 9B is a sequence diagram of interactions between components of a self-reconfiguring wagering system in accordance with various embodiments of the invention.

FIG. 9B is another sequence diagram of interactions between components of a self-reconfiguring wagering system in accordance with various embodiments of the invention. An interactive controller 1006 detects 1007 a wager event in an interactive application of the interactive controller 1006. The interactive controller 1006 communicates application telemetry data 1008 to a process controller 1004 with the application telemetry data 1008 including wager event data. The process controller 1004 receives the application telemetry data 1008 and generates a chance component request on the basis of the wager event data included in the application telemetry data 1008. The process controller 1004 communicates data of the chance component request 1012 to a chance based controller 1000. The chance-based controller 1000 receives the chance component request data and determines 1014 an ordered set of chance components. The chance-based controller updates 1018 an intermediate credit meter with an amount of credits in accordance with the ordered set of chance components. The chance-based controller 1000 updates 1020 a user credit meter 1003 by an amount of credits utilized by the chance-based controller 1000 to determine the ordered set of chance components. The chance-based controller 1000 communicates data of the chance components 1022 to the process controller 1004.

The process controller 1004 receives the ordered set of chance components data 1016 from the chance-based controller 1000. The process controller 1004 uses the ordered set of chance components data 1016 to determine 1022 one or more ordered sets of credit meter representations. The process controller 1004 communicates data of the one or more ordered sets of credit meter representations 1024 to the interactive controller 1006.

The interactive controller 1006 receives the one or more ordered sets of credit meter representations data 1024 for use by the interactive application of the interactive controller 1006. The interactive application of the interactive controller 1006 presents 1026 a skill proposition to a user. The skill proposition includes one or more skill objectives that are associated with the one or more sets of credit meter representations provided by the process controller 1004. The interactive application of the interactive controller 1006 determines 1028 one or more intermediate skill outcomes for the one or more skill objectives. After each determination of an intermediate skill outcome, the interactive controller 1006 updates 1030 a wagering user interface using a respective one or more credit meter representations of the one or more ordered sets of credit meter representations. The interactive controller 1006 determines 1031 a final skill outcome based on the previous determined intermediate skill outcomes and communicates data of the final skill outcome 1032 to the process controller 1004.

The process controller 1004 receives the final skill outcome data 1032 and determines 1034 a combined outcome using the final skill outcome and the ordered set of chance outcomes. The process controller 1004 communicates data of the combined outcome 1036 to the chance-based controller 1000.

The chance-based controller 1000 receives the combined outcome data 1036 and recalls data of the chance component credits 1038 stored on the intermediate credit meter 1002. The chance-based controller 1000 updates 1040 the user credit meter 1003 based on the combined outcome data 1036 and the chance component credit data 1038 using combined outcome credit data.

Figure 10:
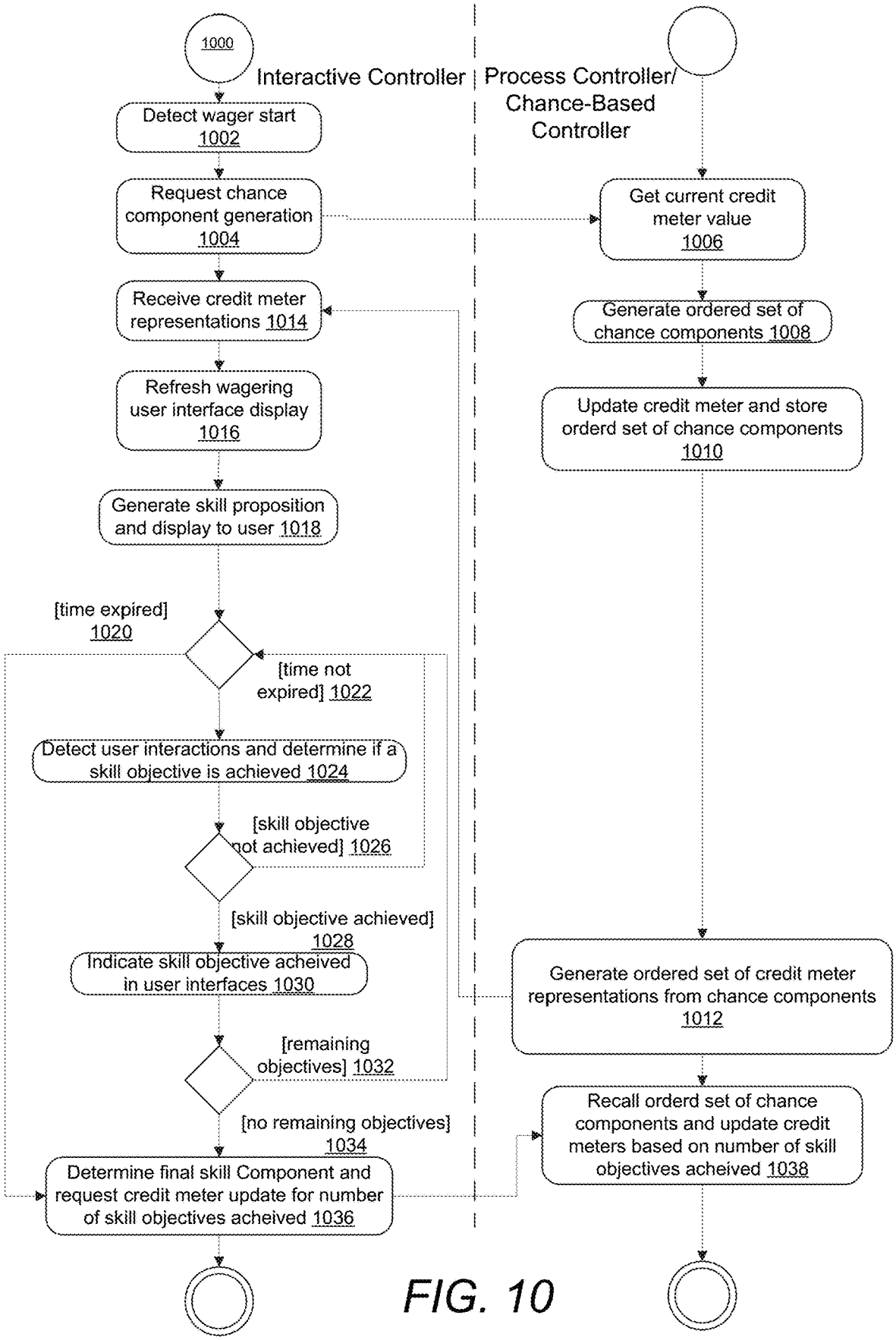
FIG. 10 is an activity diagram of interactions between components of a self-reconfiguring wagering system in accordance with various embodiments of the invention

FIG. 10 is an activity diagram of a process of an interactive application and a wagering user interface of a self-reconfiguring wagering system in accordance with various embodiments of the invention. An interactive controller starts 1000 by detecting a wager start event 1002 based on a user's interactions with an interactive application of the interactive controller. The interactive controller requests 1004 chance component generation from a process controller/chance-based controller. In response to the request for chance components, the process controller/chance-based controller gets 1006 current credit meter data values from one or more credit meters associated with the user. The process controller/chance-based controller generates 1008 an ordered set of chance components. The process controller/chance-based controller updates 1010 one or more intermediate credit meters based on the ordered set of chance components and decrements the one or more credit meters associated with the user of an amount of credits utilized by the process controller/chance-based controller to generate the ordered set of chance components. The process controller/chance-based controller generates one or more sets of ordered credit meter representations using the ordered set of chance components. The process controller/chance-based controller communicates data of the sets of ordered credit meter representations to the interactive controller.

The interactive controller receives the one or more ordered sets of credit meter representations and updates a wagering user interface display using the one or more ordered sets of credit meter representations. The interactive controller generates and presents a skill proposition in an interactive application user interface to a user. The skill proposition includes a specified number of skill objectives and a specified period of time that a user is provided to achieve the specified number of skill objectives. While the interactive controller determines that the specified period of time has not expired, the interactive controller detects user interactions with the interactive application user interface and determines from the user interactions whether or not the user has achieved a skill objective. If the interactive controller determines the user has not achieved a skill objective, the interactive controller continues to detect user interactions with the interactive application user interface as long as the interactive controller determines the specified period of time has not expired. If the interactive controller determines a skill objective has been achieved by the user, the interactive controller generates a display in the interactive application user interface indicating that a skill objective has been achieved and updates the wagering user interface using respective credit meter representations included in the one or more ordered sets of credit meter representations. If the interactive controller determines there are more skill objectives to be achieved, and the interactive controller determines the specified time period has not expired, the interactive controller continues to detect user interactions with the interactive application user interface to determine if a skill objective has been achieved.

If the interactive controller determines that the specified time period has expired and/or that there are no more remaining skill objectives to be achieved, the interactive controller communicates data of a final skill outcome including data of a number of skill objectives achieved by the user. The process controller/chance-based controller receives the final skill outcome data and uses the final skill outcome data and the ordered set of chance components to update one or more credit meters associated with the user.

Figure 11:
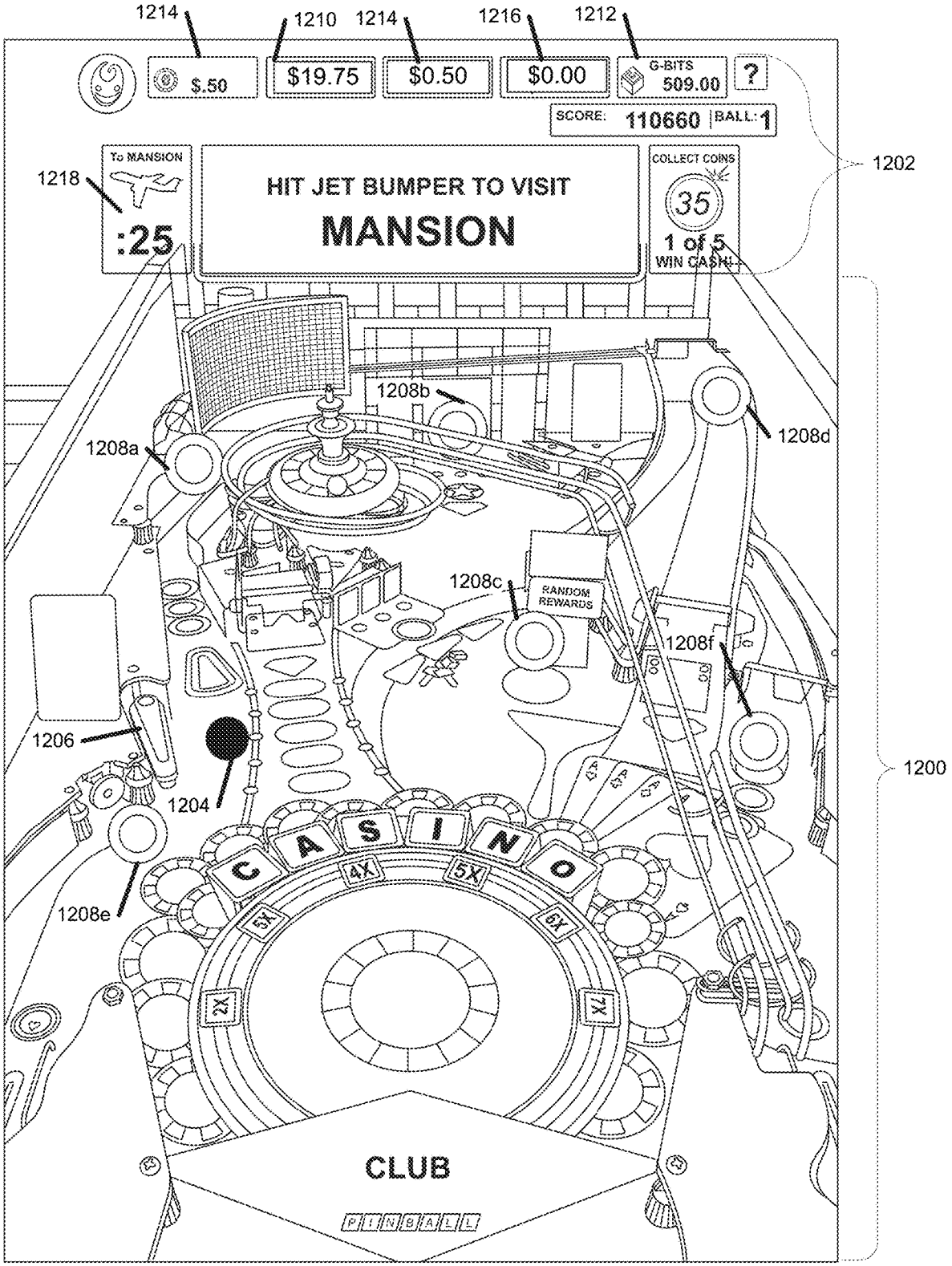
FIG. 11 is an illustration of a user interface an interactive application and a wagering user interface of a self-reconfiguring wagering system in accordance with various embodiments of the invention.

FIG. 11 is an illustration of an interactive application user interface 1200 and a wagering user interface 1202 in accordance with various embodiments of the invention. The interactive application user interface is an implementation of a pinball-style game wherein a user directs one or more movable objects 1204, such as a virtual pinball, using one or more user-operated actuators 1206, such as a virtual flipper. The skill proposition includes one or more skill objective objects, 1208*a*, 1208*b*, 1208*c*, 1208*d*, 1208*e* and 1208*f* representing one or more skill objectives to be achieved by a user. In this embodiment, the skill objectives include the user directing the movable object using the user-operated actuators to virtually collide with the one or more skill objective objects. During operation, the user uses the user-operated actuators to direct the movable object at the skill objective objects in an attempt to make the movable object collide with the one or more skill objective objects.

A wagering user interface 1202 includes representations of one or more credit meters 1210 and one or more application credit meters 1212 associated with a user as well as amounts of credits wagered 1214 in a self-reconfiguring and an amount of credits awarded 1216 to the user during the user's interactions with the interactive application interface.

From the user's perspective, during operation, an interactive controller detects a wager start event based on a user's utilization of a user actuator (not shown), such as a virtual plunger, that places a virtual pinball into play. The interactive controller requests chance component generation from a process controller/chance-based controller. In response to the request for chance components, the process controller/chance-based controller gets current credit meter data values from one or more credit meters associated with the user. The process controller/chance-based controller generates an ordered set of chance components. The process controller/chance-based controller updates one or more intermediate credit meters based on the ordered set of chance components and decrements the one or more credit meters associated with the user of an amount of credits utilized by the process controller/chance-based controller to generate the ordered set of chance components. The process controller/chance-based controller generates one or more sets of ordered credit meter representations using the ordered set of chance components. The process controller/chance-based controller communicates data of the sets of ordered credit meter representations to the interactive controller.

The interactive controller receives the one or more ordered sets of credit meter representations and updates the wagering user interface display using the one or more ordered sets of credit meter representations. In the illustrated embodiment, a representation of a minimum amount of credits 1214 that can be wagered is displayed, an amount of remaining credits credited to the user after the chance components are generated is displayed 1210, a representation of an amount of credits that were wagered is displayed 1214, an amount of credits awarded to the user is displayed 1216, and a representation of an amount of application credits awarded to the user for the user's skillful play is displayed 1212.

The interactive controller generates and presents a skill proposition in the interactive application user interface to a user. The skill proposition includes a specified number of skill objectives and a specified period of time, displayed in the interactive application user interface in a time remaining display 1218, that a user is provided to achieve the specified number of skill objectives. While the interactive controller determines that the specified period of time has not expired, the interactive controller detects user interactions with the interactive application user interface and determines from the user interactions whether or not the user has achieved a skill objective. If the interactive controller determines the user has not achieved a skill objective, the interactive controller continues to detect user interactions with the interactive application user interface as long as the interactive controller determines the specified period of time has not expired. If the interactive controller determines a skill objective has been achieved by the user, the interactive controller generates a display in the interactive application user interface indicating that a skill objective has been achieved and updates the wagering user interface using respective credit meter representations included in the one or more ordered sets of credit meter representations. If the interactive controller determines there are more skill objectives to be achieved, and the interactive controller determines the specified time period has not expired, the interactive controller continues to detect user interactions with the interactive application user interface to determine if a skill objective has been achieved.

If the interactive controller determines that the specified time period has expired and/or that there are no more remaining skill objectives to be achieved, the interactive controller communicates data of a final skill outcome including data of a number of skill objectives achieved by the user. The process controller/chance-based controller receives the final skill outcome data and uses the final skill outcome data and the ordered set of chance components to update one or more credit meters associated with the user.

Figure 12:
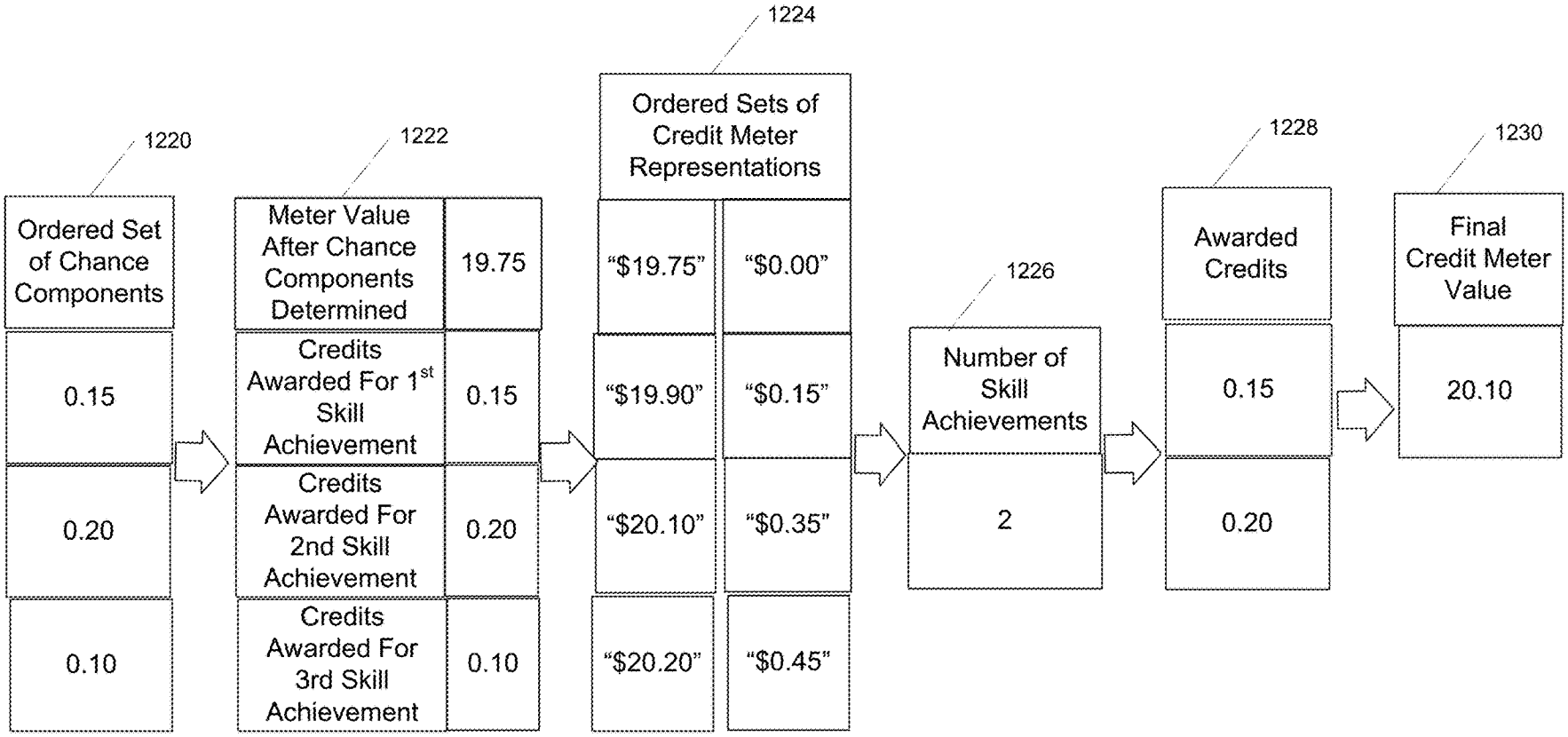
FIG. 12 is a block diagram of a process of a self-reconfiguring wagering system in accordance with various embodiments of the invention.

FIG. 12 is a block diagram of a process of a self-reconfiguring wagering system in accordance with an embodiment of the invention. A self-reconfiguring wagering system generates an ordered set of chance components 1220, as illustrated by the values 0.15, 0.20 and 0.10 that are the credit amounts that will be awarded to a user if the user achieves all of one or more respective skill objectives that are generated by the self-reconfiguring wagering system and presented to the user. The self-reconfiguring wagering system determines 1222 what a credit meter value is after the chance components have been generated and amounts of credits to be awarded to a user for respective 1st, 2nd and 3rd skill objectives are achieved. The self-reconfiguring wagering system generates one or more ordered sets of credit meter representations 1224 that are text string representations of amounts of credits stored in one or more credit meters associated with the user. In the illustrated embodiment, credits are denominated in US dollars and the respective text strings are: "$19.75" is a text string representing the credit meter value after the chance components are determined; "$0.00" is a text string representing an amount of credits awarded to the user before any skill objectives are achieved by the user; "$19.90" is a text string representing an accumulated credit meter value after the user achieves a first skill objective; "$0.15" is a text string representing an accumulated amount of credits awarded to the user after the user achieves the first skill objective; "$20.10" is a text string representing an accumulated credit meter value after the user achieves a second skill objective; "$0.35" is a text string representing an accumulated amount of credits awarded to the user after the user achieves the second skill objective; and "$20.20" is a text string representing an accumulated credit meter value after the user achieves a third skill objective; "$0.45" is a text string representing an accumulated amount of credits awarded to the user after the user achieves the third skill objective.

The self-reconfiguring wagering system determines 1226 a number of skill objectives achieved by the user, in the illustrated embodiment the user has achieved two skill objectives. The self-reconfiguring wagering system determines 1228 form the ordered set of chance components how many credits are to be awarded to the user. In the illustrated embodiment, an amount of credits awarded to the user for achieving the first skill objective is 0.15 and an amount of credits awarded to the user for achieving the second skill objective is 0.20. The self-reconfiguring wagering system augments 1230 the credit meter associated with the user by an amount of credits that is 0.35 resulting in a final credit meter value of 20.10.

Figure 13A:
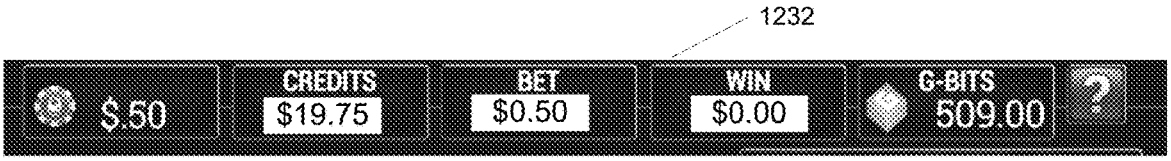
FIGS. 13A, 13B, and 13C illustrate a process of a wagering interface of a process of a self-reconfiguring wagering system in accordance with various embodiments of the invention.
Figure 13B:
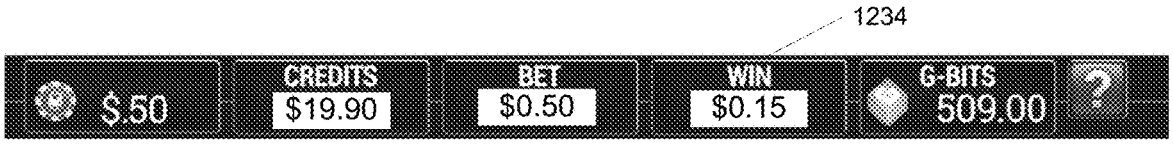
Figure 13C:
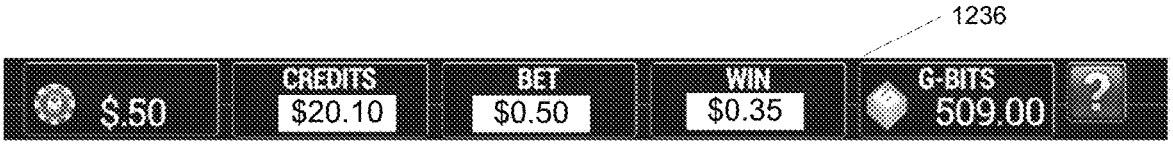

FIGS. 13A, 13B, and 13C illustrate a process of a wagering user interface of a self-reconfiguring wagering system in accordance with various embodiments of the invention. In the illustrated embodiment, the credit representations correspond to the embodiment illustrated in FIG. 12. In FIG. 13A, a state of the wagering user interface 1232 is illustrated after one or more chance components are determined but before a user has achieved any skill objectives. In this state, self-reconfiguring wagering system generates a display in the wagering user interface displaying a text string representation of a credit meter of "$19.75", a text string representation of a wager of an amount of credits of "$0.50", and a text string representation of an accumulated amount of credits awarded to the user of "$0.00". In FIG. 13B, a state of the wagering user interface 1234 is illustrated after the user has achieved a first skill objective. In this state, self-reconfiguring wagering system generates a display in the wagering user interface displaying a text string representation of a credit meter of "$19.90", a text string representation of a wager of an amount of credits of "$0.50", and a text string representation of an accumulated amount of credits awarded to the user of "$0.15". In FIG. 13C, a state of the wagering user interface 1236 is illustrated after the user has achieved a second skill objective. In this state, self-reconfiguring wagering system generates a display in the wagering user interface displaying a text string representation of a credit meter of "$20.10", a text string representation of a wager of an amount of credits of "$0.50", and a text string representation of an accumulated amount of credits awarded to the user of "$0.35".

Figure 14:
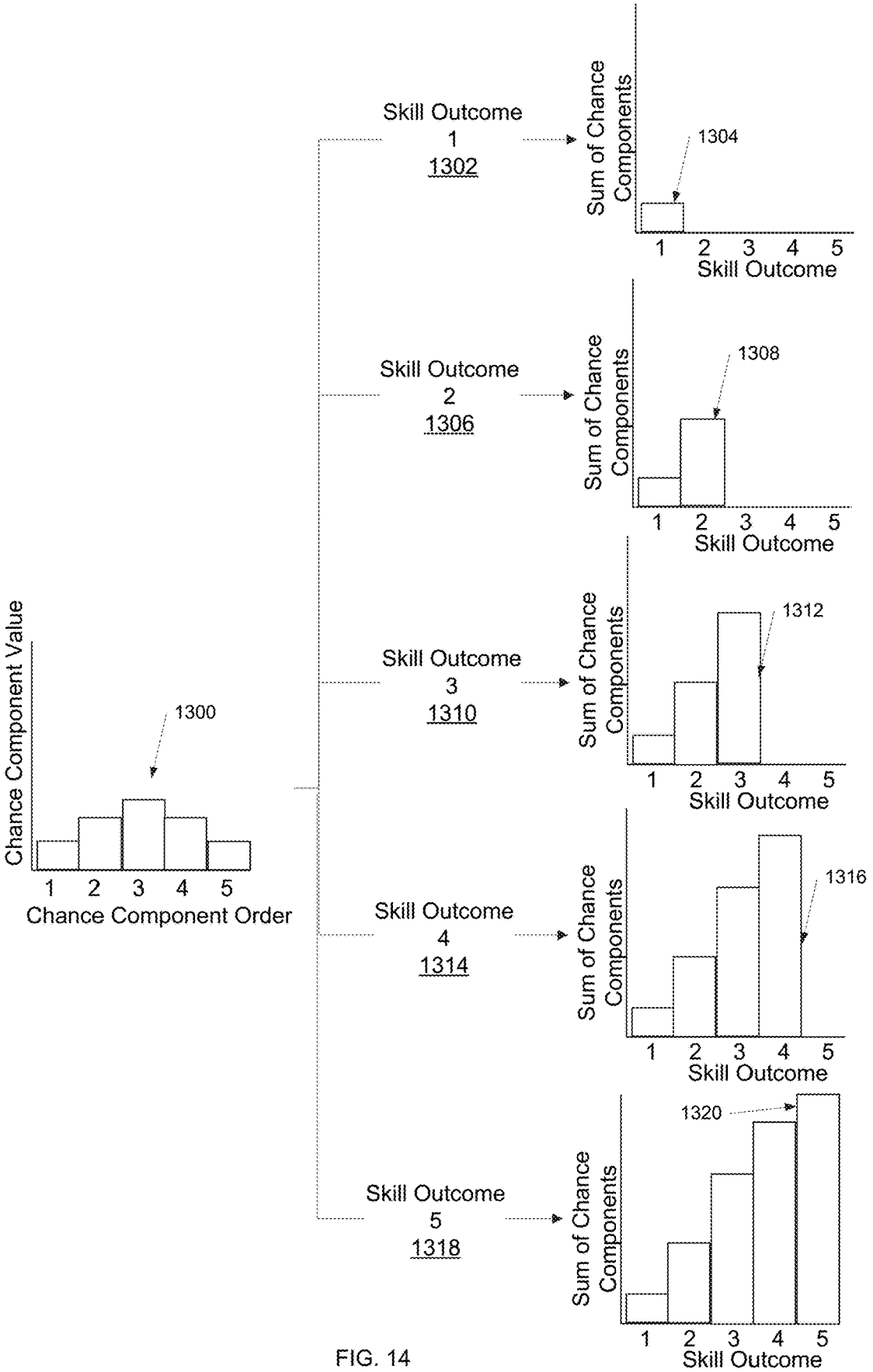
FIG. 14 is an illustration of a summation of an ordered set of chance components for differing skill outcomes in accordance with various embodiments of the invention.

FIG. 14 is an illustration of a summation of an ordered set of chance components for differing skill outcomes in accordance with various embodiments of the invention. An ordered set of chance components 1300 includes a plurality of chance components, wherein a chance component value of the chance components may differ. That is, values in credits that a user may receive for achieving skill objectives associated with respective chance components will differ. In one embodiment as illustrated, there are 5 chance components, ordered one through 5. A first chance component and a fifth chance component have a same chance component value, a second and fourth chance component have a same chance component value that is higher than the chance component values of chance components one and five, and a third chance component has a chance component value that is higher than the chance component values of chance components two and four.

If a self-reconfiguring wagering system determines during a gaming session a skill outcome of 1 1302 for a user, that is the user is able to achieve a first skill objective of a skill proposition presented by the self-reconfiguring wagering system, then the user will earn only a summation of the chance component value of the first chance component 1304. If the self-reconfiguring wagering system determines during a gaming session a skill outcome of 2 1306 for the user, that is the user is able to achieve a first and second skill objective of the skill proposition presented by the self-reconfiguring wagering system, then the user will earn a summation of the chance component value of the first chance component and the second chance component 1308. If the self-reconfiguring wagering system determines during a gaming session a skill outcome of 3 1310 for the user, that is the user is able to achieve a first, second and third skill objective of the skill proposition presented by the self-reconfiguring wagering system, then the user will earn a summation of the chance component values of the first, second and third chance components 1312. If the self-reconfiguring wagering system determines during a gaming session a skill outcome of 4 1314 for the user, that is the user is able to achieve a first, second, third and fourth skill objective of the skill proposition presented by the self-reconfiguring wagering system, then the user will earn a summation of the chance component values of the first, second and third chance components 1316. If the self-reconfiguring wagering system determines during a gaming session a skill outcome of 5 1318 for the user, that is the user is able to achieve a first, second, third, fourth and fifth skill objective of the skill proposition presented by the self-reconfiguring wagering system, then the user will earn a summation of the chance component values of the first, second, third, fourth and fifth chance components 1320. Accordingly, the user achieves a larger amount of the summed value of the chance component values the more skill objectives that the user achieves. Furthermore, as the chance component values of the chance components differs, the user receives differing incremental value as the skill outcome increases from 1 skill objective achieved to 5 skill objectives achieved.

Figure 15A:
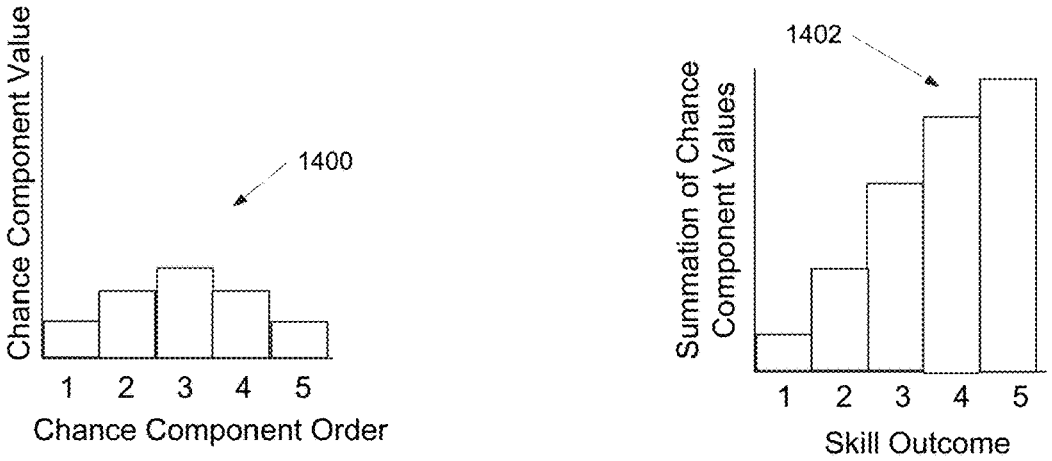
FIGS. 15A, 15B and 15C illustrate advantaging and disadvantaging a user by reordering an ordered set of chance components in accordance with a self-reconfiguring wagering system in accordance with various embodiments of the invention.
Figure 15B:
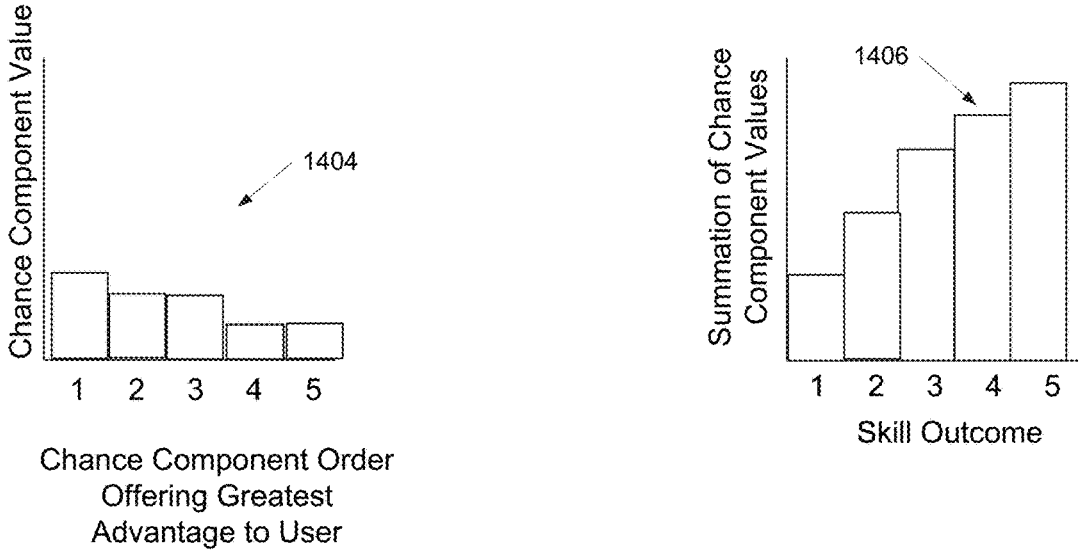
Figure 15C:
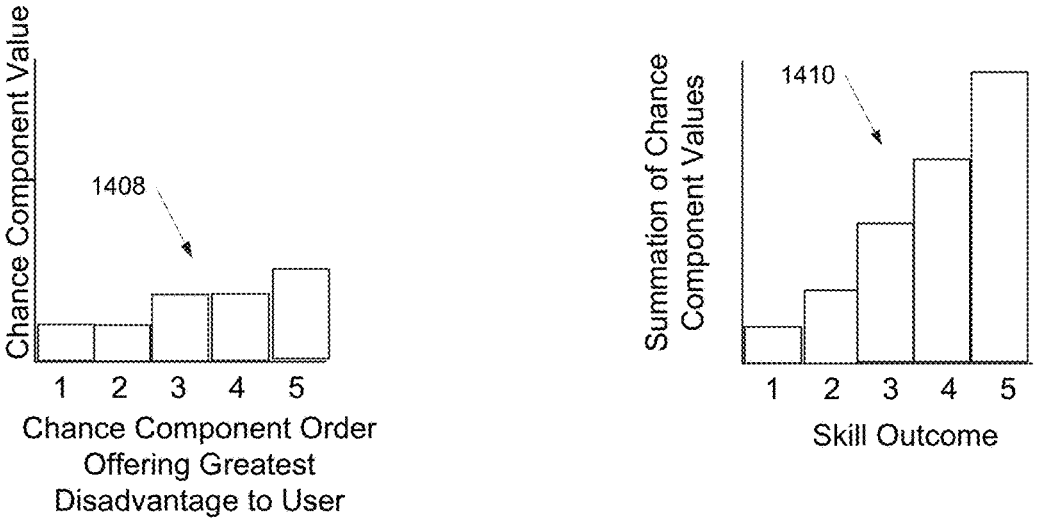

FIGS. 15A, 15B and 15C illustrate advantaging and disadvantaging a user by reordering an ordered set of chance components in accordance with a self-reconfiguring wagering system in accordance with various embodiments of the invention. As illustrated in FIG. 15A, in various embodiments, there are five chance components 1400, ordered one through five. A first chance component and a fifth chance component have a same chance component value, a second and fourth chance component have a same chance component value that is higher than the chance component values of the first and fifth chance components, and a third chance component has a chance component value that is higher than the chance component values of the second and fourth chance components. Accordingly, as a user achieves skill objectives presented in a skill proposition, a sum of chance component values 1402 increases incrementally with each skill objective achieved by the user, as indicated by a skill outcome of the skill proposition.

FIG. 15B is an illustration of a reordered set of chance components 1404 that are reordered using the ordered set of chance components 1400 of FIG. 15A. The reordered set of chance components 1404 has been reordered so that a user is advantaged by having a chance component having a highest chance component value being first in order in the ordered set of chance components, and therefore associated with a lowest skill outcome representing only a single skill objective being achieved of a skill proposition. In such an embodiment, a first chance component has a chance component value that is greater than respective second through fifth chance components. The second and third chance components have chance component values that are greater than chance component values of respective fourth and fifth chance components. The fourth and fifth chance components have a same chance component value, the second and third chance components have a same chance component value that is higher than the chance component values of the fourth and fifth chance components, and the first chance component has a chance component value that is higher than the chance component values of the second and third chance components.

As a user achieves skill objectives presented in a skill proposition, a sum of chance component values 1406 increases incrementally with each skill objective achieved by the user, as indicated by a skill outcome of the skill proposition. As compared to the summation of chance component values 1402 of FIG. 15A, a user who is advantaged by application of the reordered set of chance components 1404 will obtain a summation of chance component values that is higher for the first three skill objectives achieved of the skill proposition achieved by the user than the user would have obtained using the ordered set of chance components 1400 of FIG. 15A, even though a user who achieves all five skill objectives will obtain a summation of chance component values that is the same whether the ordered set of chance components 1400 of FIG. 15A are used or if the reordered set of chance components 1404 are used.

FIG. 15C is an illustration of a reordered set of chance components 1408 that are reordered using the ordered set of chance components 1400 of FIG. 15A. The reordered set of chance components 1408 has been reordered so that a user is disadvantaged by having a chance component having a lowest chance component value being first in order in the ordered set of chance components, and therefore associated with a lowest skill outcome representing only a single skill objective being achieved of a skill proposition. In such an embodiment, first and second chance components have chance component values that are less than chance component values of respective third through fifth chance components. The third and fourth chance components have chance component values that are less than a chance component value of a respective fifth chance component. The first and second chance components have a same chance component value, the third and fourth chance component have a same chance component value that is higher than the chance component values of the first and second chance components, and fifth chance component has a chance component value that is higher than the chance component values of the first through fourth chance components.

As a user achieves skill objectives presented in a skill proposition, a sum of chance component values 1410 increases incrementally with each skill objective achieved by the user, as indicated by a skill outcome of the skill proposition. As compared to the summation of chance component values 1402 of FIG. 15A, a user who is disadvantaged by application of the reordered set of chance components 1408 will obtain a summation of chance component values that is lower for the first four skill objectives achieved of the skill proposition achieved by the user than the user would have obtained using the ordered set of chance components 1400 of FIG. 15A, even though a user who achieves all five skill objectives will obtain a summation of chance component values that is the same whether the ordered set of chance components 1400 of FIG. 15A are used or if the reordered set of chance components 1408 are used.

Figure 16:
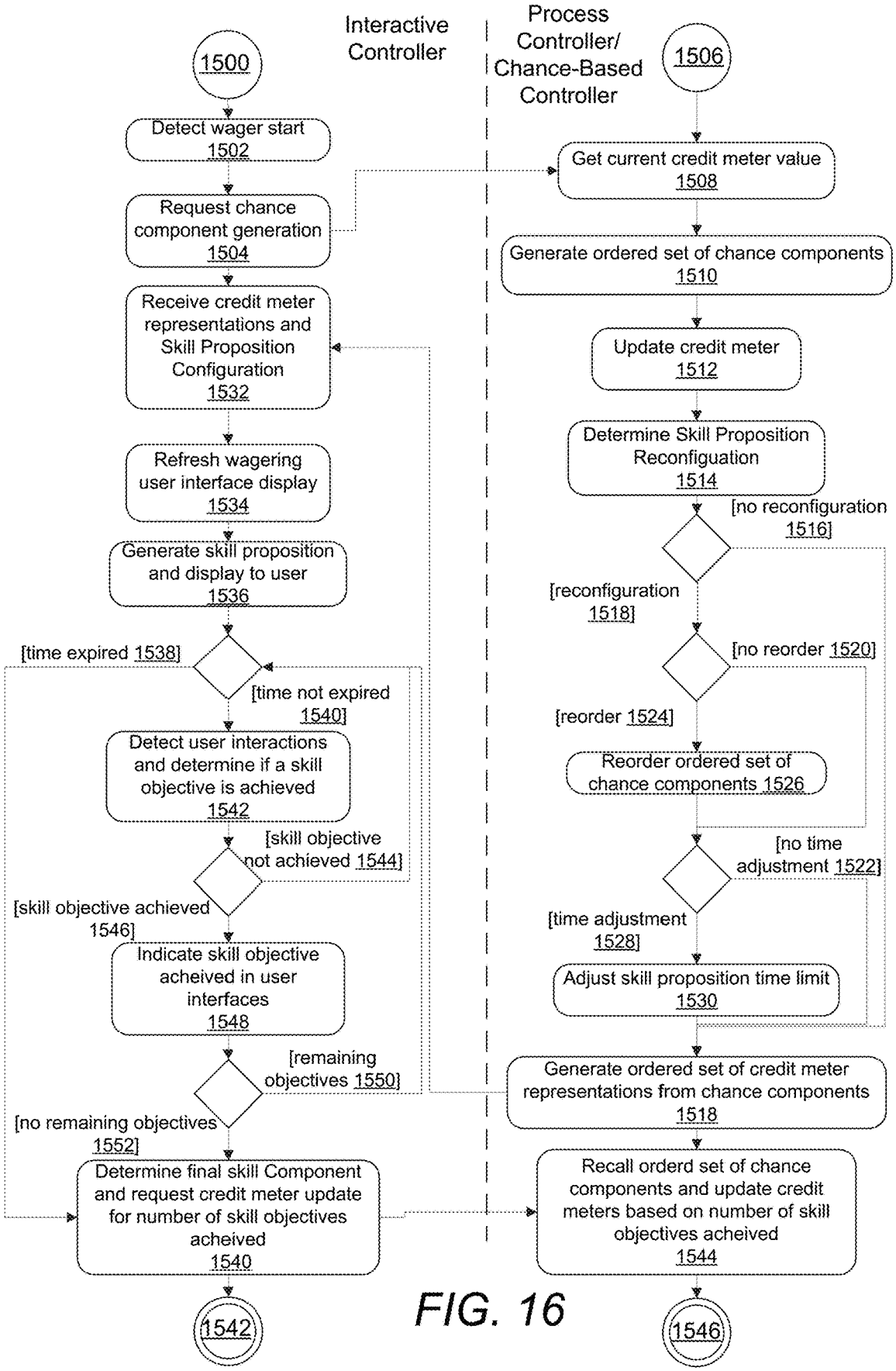
FIG. 16 is another activity diagram for a process of a self-reconfiguring wagering system in accordance with various embodiments of the invention.

FIG. 16 is another activity diagram for a process of a self-reconfiguring wagering system in accordance with various embodiments of the invention. An interactive controller begins 1500 the process by detecting 1502 a wager start. The interactive controller requests 1504 chance component generation from a process controller/chance-based controller. The process controller/chance-based controller receives the request and begins 1506 by determining 1508 a current credit meter value. The process controller/chance-based controller generates 1510 an ordered set of chance components using a random result generated by a random number generator and a paytable. The process controller/chance-based controller updates 1512 the credit meter value based on a number of credits used when generating the ordered set of chance components. The process controller/chance-based controller determines 1512 whether or not a skill proposition needs to be reconfigured. If it is determined 1516 that no reconfiguration is needed, the process controller/chance-based controller generates 1518 an ordered set of credit meter representations from the ordered set of chance components. The process controller/chance-based controller then communicates the ordered set of credit meter representations to the interactive controller.

If the process controller/chance-based controller determines 1518 that reconfiguration of the skill proposition is needed, the process controller/chance-based controller determines if reordering of the ordered set of chance components is possible. If the chance components cannot be reordered 1520, the process controller/chance-based controller determines if a time period allocated to a user to achieve skill objectives can be adjusted. If the process controller/chance-based controller determines that the allocated time period cannot be adjusted 1522, the process controller/chance-based controller proceeds to generate 1518 the ordered set of credit meter representations as described herein.

If the process controller/chance-based controller determines that the ordered set of chance components can be reordered 1524, the process controller/chance-based controller reorders the ordered set of chance components to either provide an advantage to the user or provide a disadvantage to the user as described herein. The process controller/chance-based controller proceeds to generate 1518 the ordered set of credit meter representations as described herein.

If the process controller/chance-based controller determines that the period of time allocated to the user to achieve skill objectives is to be adjusted 1528, the process controller/chance-based controller adjusts the period of time allocated to the user to either provide an advantage to the user or provide a disadvantage to the user as described herein.

The interactive controller receives the one or more ordered sets of credit meter representations 1532 and updates 1534 a wagering user interface display using the one or more ordered sets of credit meter representations. The interactive controller generates 1536 and presents a skill proposition in an interactive application user interface to a user. The skill proposition includes a specified number of skill objectives and a specified period of time that a user is provided to achieve the specified number of skill objectives. While the interactive controller determines that the specified period of time has not expired 1540, the interactive controller detects 1542 user interactions with the interactive application user interface and determines from the user interactions whether or not the user has achieved a skill objective. If the interactive controller determines the user has not achieved a skill objective 1544, the interactive controller continues to detect 1542 user interactions with the interactive application user interface as long as the interactive controller determines the specified period of time has not expired 1540.

If the interactive controller determines a skill objective has been achieved by the user 1546, the interactive controller generates 1548 a display in the interactive application user interface indicating that a skill objective has been achieved and updates the wagering user interface using respective credit meter representations included in the one or more ordered sets of credit meter representations. If the interactive controller determines there are more skill objectives to be achieved 1550, and the interactive controller determines the specified time period has not expired 1540, the interactive controller continues to detect 1542 user interactions with the interactive application user interface to determine if a skill objective has been achieved.

If the interactive controller determines that the specified time period has expired 1538 and/or that there are no more remaining skill objectives to be achieved 1552, the interactive controller determines 1540 a final skill component as a number of a skill objectives achieved by the user and communicates data of the final skill outcome including the data of a number of skill objectives achieved by the user, thus completing 1542 the described process.

The process controller/chance-based controller receives the final skill outcome data and uses 1544 the final skill outcome data and the ordered set of chance components to update one or more credit meters associated with the user.

Although the foregoing description of an embodiment of the invention included five chance components having respective chance component values that differ is the described arrangement, it should be understood that various embodiments of the invention may include ordered sets of chance components and reordered sets of chance components where the set of chance components have two or more chance components where at least one chance of component of a set of two or more chance components has a chance component value that is different than the other respective chance components in the set of two or more chance components.

Accordingly, a self-reconfiguring wagering system may reorder an ordered set of chance components to either provide an advantage to a user, or provide a disadvantage to a user, even though a summation of chance component values associated with the set of chance components remains the same no matter whether the set of chance components is utilized as originally ordered or utilized in a reordered state.

Figure 17:
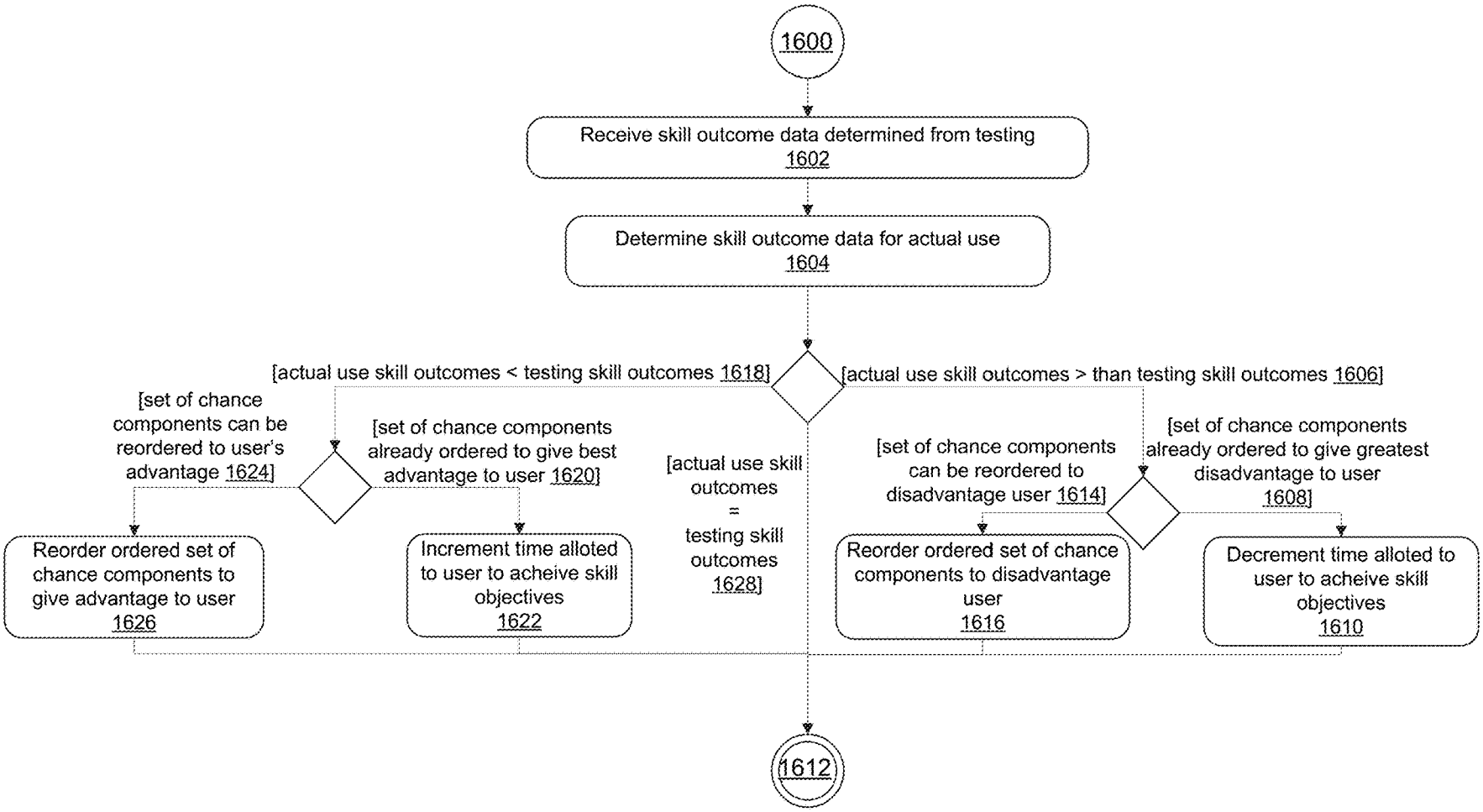
FIG. 17 is an activity diagram of a process of a self-reconfiguring wagering system in accordance with various embodiments of the invention.

In some embodiments, a self-reconfiguring wagering system orders the ordered set of chance components from FIG. 17 is an activity diagram of a process of a self-reconfiguring wagering system in accordance with various embodiments of the invention. The process begins 1600 when the self-reconfiguring wagering system receives 1602 testing skill outcome data for a skill proposition that are determined from testing using a plurality of users. The testing skill outcome data include, but are not limited to, an average or mean value of testing skill outcomes of a number of skill objectives achieved by test users when presented with the skill proposition having a specified number of ordered chance components. In some embodiments, the testing skill outcome data include an average or mean value of testing skill outcomes of a number of skill objectives achieved by test users when presented with the skill proposition having a specified number of ordered chance components for a specified allocated period of time.

The self-reconfiguring wagering system determines 1604 actual skill outcome data for actual use of the self-reconfiguring wagering system by users of the self-reconfiguring wagering system. The actual skill outcome data include, but are not limited to, an average or mean value of actual skill outcomes of a number of skill objectives achieved by actual users when presented with the skill proposition having a specified number of ordered chance components. In some embodiments, the actual skill outcome data include, but are not limited to, an average or mean value of actual skill outcomes of a number of skill objectives achieved by actual users when presented with the skill proposition having a specified number of ordered chance components for a specified allocated period of time.

The self-reconfiguring wagering system compares the test skill outcome data to the actual skill outcome data. If a mean of the actual skill outcomes is greater than a mean of the test skill outcomes 1606, meaning that the actual users are more skillful in achieving the skill objectives than the test users, the self-reconfiguring wagering system determines if a ordered set of chance components is already reordered to give the greatest disadvantage to the actual users. If so 1608, the self-reconfiguring wagering system decrements 1610 an amount of time allocated to the actual users to achieve the skill objectives, thus making the skill proposition effectively more difficult for the actual users and thus also lowering an amount of a wager outcome that the actual users may achieve through skillful operation of the self-reconfiguring wagering system. The process is completed 1612 after the self-reconfiguring wagering system determines a reconfiguration of the skill proposition.

If the ordered set of chance components can be reordered to disadvantage the actual users 1614, the self-reconfiguring wagering system reorders 1616 the ordered set of chance components to disadvantage the actual users as described herein, thus lowering an amount of a wager outcome that the actual users may achieve through skillful operation of the self-reconfiguring wagering system. The process is completed 1612 after the self-reconfiguring wagering system determines a reconfiguration of the skill proposition.

If a mean of the actual skill outcomes is less than a mean of the test skill outcomes 1618, meaning that the actual users are less skillful in achieving the skill objectives than the test users, the self-reconfiguring wagering system determines if a ordered set of chance components is already reordered to give the greatest advantage to the actual users. If so 1620, the self-reconfiguring wagering system increments 1622 an amount of time allocated to the actual users to achieve the skill objectives, thus making the skill proposition effectively less difficult for the actual users and thus also raising an amount of a wager outcome that the actual users may achieve through skillful operation of the self-reconfiguring wagering system. The process is completed 1612 after the self-reconfiguring wagering system determines a reconfiguration of the skill proposition.

If the ordered set of chance components can be reordered to provide an advantage to the actual users 1624, then the self-reconfiguring wagering system reorders 1626 the ordered set of chance components to provide an advantage to the actual users, thus raising an amount of a wager outcome that the actual users may achieve through skillful operation of the self-reconfiguring wagering system. The process is completed 1612 after the self-reconfiguring wagering system determines a reconfiguration of the skill proposition.

If the actual skill outcomes are equal to the testing skill outcomes 1628, then no reconfiguration is performed for the skill proposition.

Figure 18A:
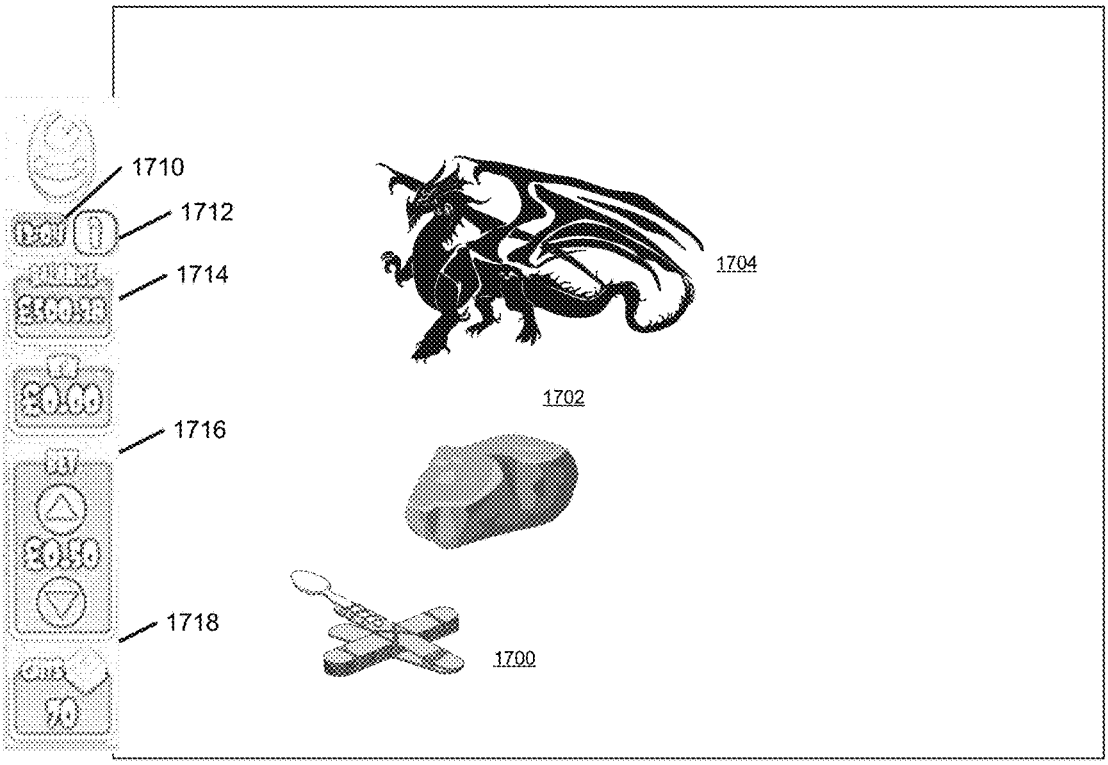
FIGS. 18A, 18B, and 18C illustrate a user interface of a self-reconfiguring wagering system in accordance with various embodiments of the invention.
Figure 18B:
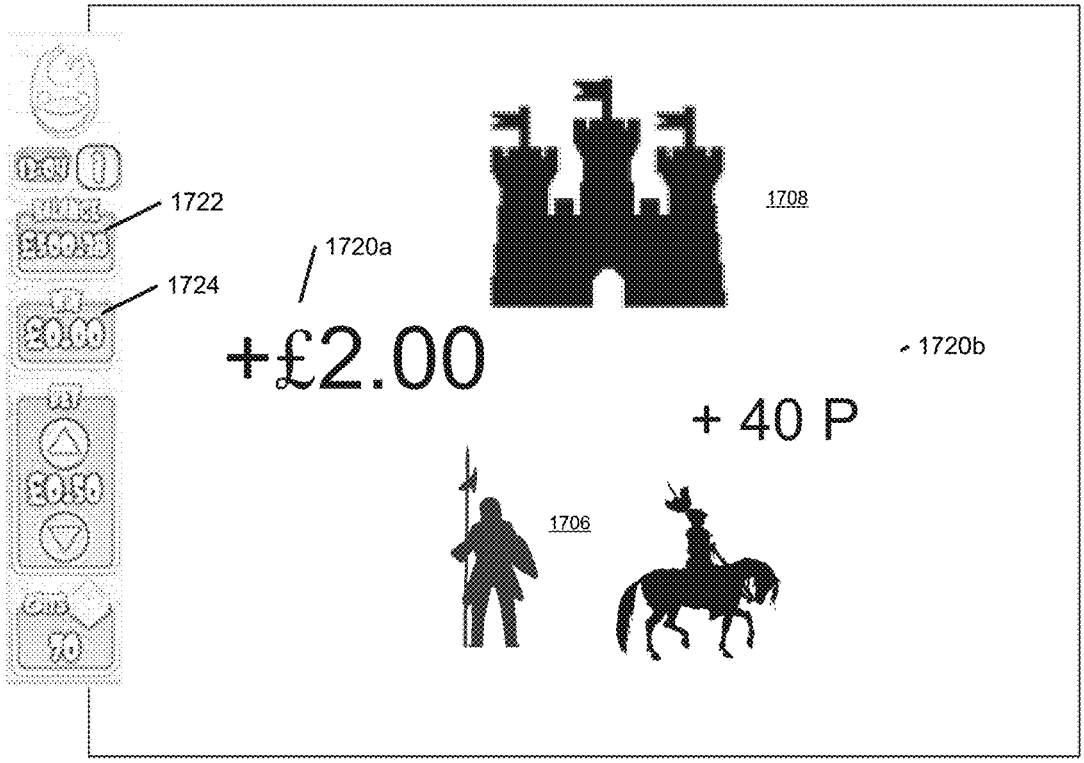
Figure 18C:
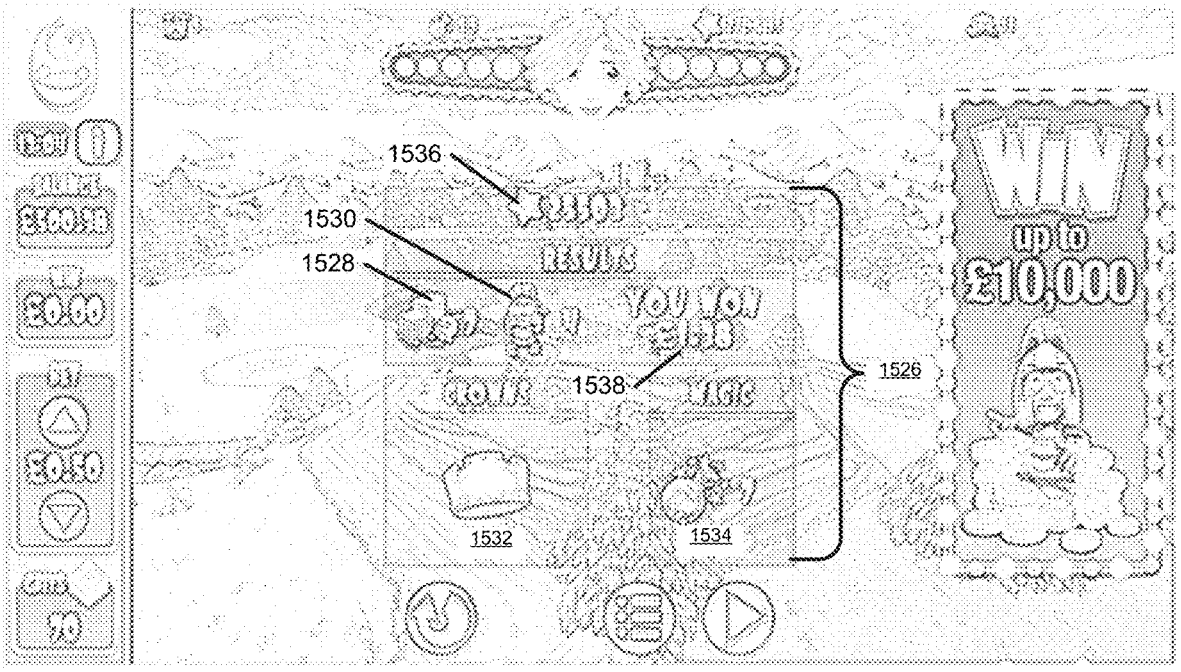

Any skill-based game having skill objectives may be used as a skill-based game of an interactive application of an interactive controller of a self-reconfiguring wagering system. FIGS. 18A, 18B, and 18C illustrate a user interface of a self-reconfiguring wagering system in accordance with various embodiments of the invention. The user interface is for a self-reconfiguring wagering system having a single-user interactive application that is a skill-based game in the form of a catapult game where the skill objectives include striking virtual targets with virtual projectiles launched using a virtual catapult. During gameplay, the user uses a virtual actuator in the form of a catapult (1700 of FIG. 18A) to launch virtual objects (1702 of FIG. 18A) in the form of boulders at a plurality of virtual targets in the form of dragons (1704 of FIG. 18A), knights or warriors (1706 of FIG. 18B) protected by destructible virtual fortifications (1708 of FIG. 18B). A skill objective of the self-reconfiguring wagering system is for the user to knock down as many of the plurality of virtual targets as possible to determine a skill outcome of a self-reconfiguring as described herein. Another skill objective is to knock down as many virtual fortifications as possible in order to acquire application credits. Referring to FIG. 18A, the user interface includes a wagering user interface that includes: a field for displaying the real time 1710; an informational button that when selected provides information to a user of the self-reconfiguring wagering system about the chance-based proposition and skill proposition 1712; a real credit meter field to show a real credit balance for a user 1714; a bet selector field to allow a user to set an amount of credits to wager 1716; and an application credit meter field 1718 for displaying an amount of application credit acquired by the user.

During operation, a user selects a virtual object to launch using the actuator. Upon launching the actuator, a wager is executed as described herein wherein an ordered set of chance components in the form of amounts of credits are determined as described herein.

Referring now to FIG. 18B, as the virtual projectile knocks down the virtual targets, amounts of credit associated with respective chance components of the ordered set of chance components are assigned to the virtual targets and individual amount of credit representations 1720*a* and 1720*b* of the ordered sets of credit meter representations are displayed in the user interface to the user. In addition, the credit meter fields 1722 and 1724 are updated using the ordered sets of credit meter representations as described herein.

Referring to FIG. 18C, after a user has finished a round of the skill proposition, a user interface 1726 is displayed to the user describing the user's skill performance. The user interface includes fields for displaying a skill outcome of the skill proposition, including: a field for displaying a skill outcome for skill objectives that when achieved result in the user acquiring application credit 1728 and 1730; amounts of various types of application credit earned for achieving the skill objectives 1732 and 1734; a field for displaying a skill outcome for skill objectives that when achieved result in the user earning amounts of credit associated with chance components 1736; and a field for displaying an amount of real credit earned by the user for achieving the skill objectives 1738.

Figure 19:
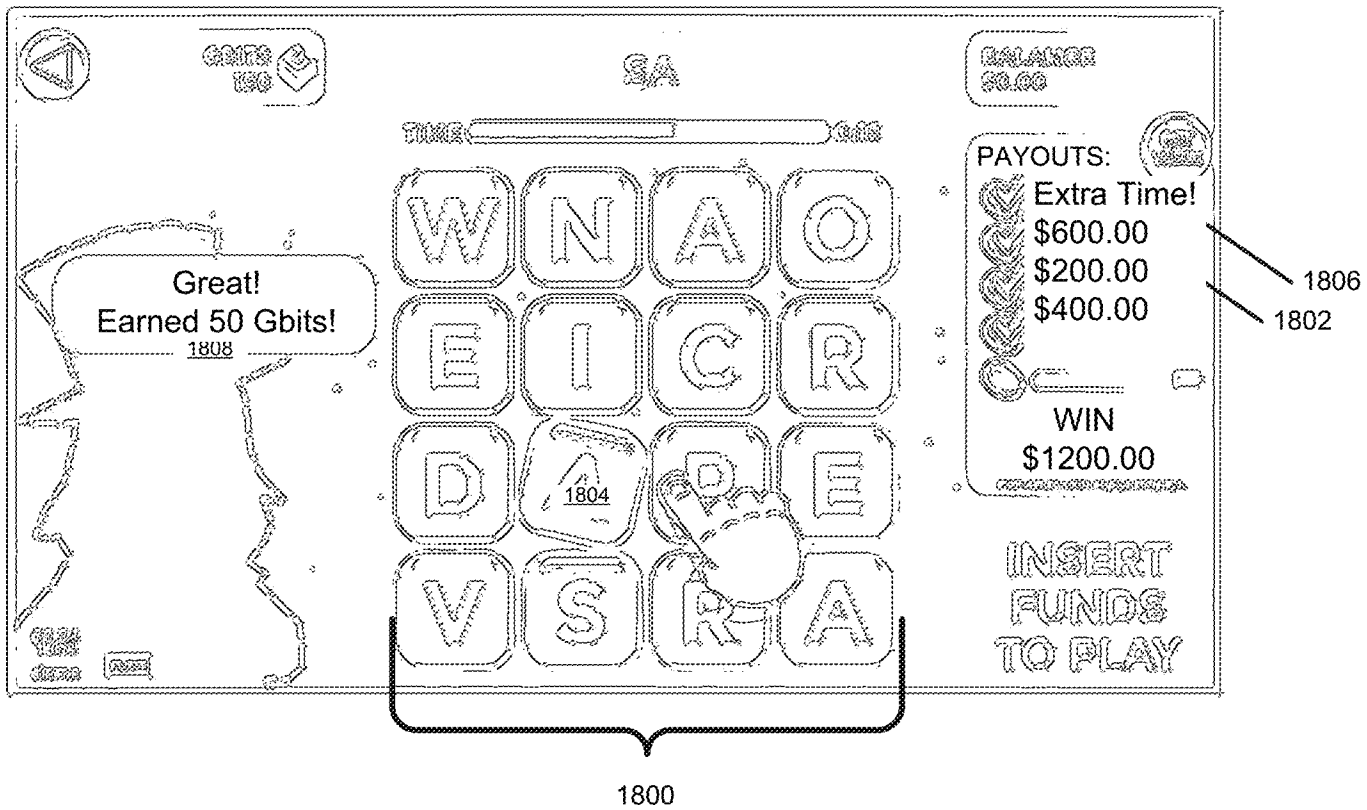
FIG. 19 is an illustration of a user interface of a self-reconfiguring wagering system in accordance with various embodiments of the invention.

FIG. 19 illustrates a user interface of a self-reconfiguring wagering system in accordance with various embodiments of the invention. The user interface is for a self-reconfiguring wagering system having an interactive application that is a skill-based game that is a word creation game. During gameplay, a plurality of chance components are generated and provided to the interactive controller. The interactive controller generates a user presentation for the user wherein the skill objectives of the skill proposition are for the user is to create words from a randomized set of letters placed in a grid 1800. For each word created, the user receives payouts of credit that are associated with the chance components, such as payout 1802.

In one embodiment, some of the letters are in grid positions, such as grid position 1804, that correspond to one or more payouts. If the user creates a word using a letter in one of the grid positions associated with one or more payouts, the user is awarded the one or more payouts.

In another embodiment, the user is timed and the user receives additional time for each word created 1806.

In another embodiment, the user receives application credit 1808 for creating words.

In another embodiment, a count is determined of the combined number of letters in each word created by the user. The user receives one or more payouts in proportion to the count of the combined number of letters.

In another embodiment, the user receives more application credit for each word that exceeds a specified length.

In an example embodiment, an interactive application provides a skill-based puzzle piece drop game to a user, and the user is awarded an amount of credits for achieving skill objectives of positioning dropped puzzle pieces composed of blocks to complete rows. Whether or not a next puzzle piece will allow the user to complete a row is determined by a random outcome used to generate a chance-based component of a skill proposition. Each time the user creates a row of blocks, the user is determined to have completed a skill objective. Sometimes a less skillful user will only be able create a few individual rows and the user will be determined to have achieved only a few skill objectives. Sometimes a skillful user will be able to create multiple rows and the user will be determined to have completed many skill objectives. A user is awarded chance outcomes from a set of ordered chance outcomes based on the number of achieved skill objectives as described herein. In order to give an advantage to the less skilled user, a self-reconfiguring wagering system may reorder the ordered set of chance components that are associated with the skill objectives as described herein. In order to disadvantage to the skillful user, the self-reconfiguring wagering system may reorder the ordered set of chance outcomes as described herein.

In another example embodiment, a skill proposition is implemented in a first person shooter style skill-based game provided by an interactive application. The skill-based game has skill objectives in the form of opponents that are engaged by the user. If a user achieves a skill objective by defeating an opponent, the user is to have achieved a skill objective. Other opponents run away before being defeated, resulting no skill objectives being achieved. Whether or not the opponent stays engaged or runs away is determined by chance-based component generated from a random outcome. A user is awarded chance outcomes from a set of ordered chance outcomes based on the number of achieved skill objectives as described herein. In order to give an advantage to the less skilled user, a self-reconfiguring wagering system may reorder the ordered set of chance components that are associated with the skill objectives as described herein. In order to disadvantage to the skillful user, the self-reconfiguring wagering system may reorder the ordered set of chance outcomes as described herein.

In another embodiment, a racing game is provided as a skill-based game of an interactive application of an interactive controller. In some embodiments, a user wagers on the user's skill in overtaking non-user characters during a simulated race. During the simulated race, a user is presented with one or more skill-objectives of overtaking an opponent non-user character in the form of another racer. If the user is able to overtake and pass the opponent non-user character, the user is determined to have achieved a skill objective. A user is awarded chance outcomes from a set of ordered chance outcomes based on the number of achieved skill objectives as described herein. In order to give an advantage to the less skilled user, a self-reconfiguring wagering system may reorder the ordered set of chance components that are associated with the skill objectives as described herein. In order to disadvantage to the skillful user, the self-reconfiguring wagering system may reorder the ordered set of chance outcomes as described herein.

One skilled in the art of skill-based gaming will understand that any skill-based game having skill objectives may be used as a skill-based game of an interactive application of an interactive controller of a self-reconfiguring wagering system. In various embodiments, skill-based games of an interactive application of an interactive controller of a self-reconfiguring wagering system include, but are not limited to: racing games; first person shooter games; maze games; puzzle games; sports simulation games; board games; strategy games; pattern matching games; etc.

While the above description may include many specific embodiments of the invention, these should not be construed as limitations on the scope of the invention, but rather as examples of embodiments thereof. It is therefore to be understood that the present invention can be practiced otherwise than specifically described, without departing from the scope and spirit of the present invention. Thus, embodiments of the present invention described herein should be considered in all respects as illustrative and not restrictive.

What is claimed:

1. A self-reconfiguring electronic gaming machine, comprising:

an interactive controller constructed to communicate with a process controller, wherein the interactive controller is further constructed to:

provide a skill-based game to a user wherein the skill-based game includes a skill proposition including a set of skill objectives corresponding to a set of ordered chance components;

generate a graphical display of the skill-based game using a display output device;

present the set of skill objectives to the user as components of the skill-based game;

determine a first skill outcome for the set of skill objectives presented to the user, wherein the first skill outcome includes a number of the set of skill objectives achieved by the user during gameplay; and distribute to the process controller the first skill outcome;

receive from the process controller the ordered set of chance components; and update the graphical display to display the ordered set of chance components based on the number of the set of skill objectives achieved by the user during gameplay;

a chance-based controller constructed to communicate with the process controller, wherein the chance based controller is further constructed to:

generate the ordered set of chance components having one or more chance outcomes using a random number generator and a paytable; and distribute the ordered set of chance components to the process controller; and the process controller operatively connecting the interactive controller and the chance-based controller, wherein the process controller is further constructed to:

receive a plurality of skill outcomes for a plurality of actual users;

determine an actual use skill outcome using the received plurality of skill outcomes;

compare a test skill outcome determined for a plurality of test users to the actual use skill outcome;

receive the ordered set of chance components;

in a case where the comparison indicates that the plurality of actual users are more skillful in achieving the set of skill objectives than the test users, reorder the ordered set of chance components to lower an amount of a wager outcome;

in a case where the comparison indicates that the plurality of actual users are less skillful in achieving the set of skill objectives than the test users, reorder the ordered set of chance components to raise an amount of the wager outcome;

receive the first skill outcome from the interactive controller;

determine the wager outcome using the number of the set of skill objectives achieved by the user during gameplay of the first skill outcome and the reordered set of chance components; and update one or more credit meters using the wager outcome.

2. The self-reconfiguring electronic gaming machine of claim 1, wherein the interactive controller and the process controller are constructed from the same device, and wherein the process controller is operatively connected to the chance-based controller using a communication link.

3. The self-reconfiguring electronic gaming machine of claim 1, wherein the chance-based controller and the process controller are constructed from the same device, and wherein the process controller is operatively connected to the interactive controller using a communication link.

4. The self-reconfiguring electronic gaming machine of claim 1, further comprising:

an enclosure constructed to mount:

a user input device operatively connected to the interactive controller;

a user output device operatively connected to the interactive controller;

a credit input device operatively connected to the chance-based controller; and a credit output device operatively connected to the chance-based controller.

5. The self-reconfiguring electronic gaming machine of claim 4, wherein the chance-based controller is further constructed to:

communicate with the credit input device to receive a credit input; and communicate with the credit output device to generate a credit output based on credits transferred off of the one or more credit meters.

6. The self-reconfiguring electronic gaming machine of claim 1, wherein the skill-based game is a virtual pinball game.

7. The self-reconfiguring electronic gaming machine of claim 1, wherein the skill-based game is a catapult game.

8. The self-reconfiguring electronic gaming machine of claim 1, wherein the skill-based game is a puzzle game.

9. The self-reconfiguring electronic gaming machine of claim 1, wherein the skill-based game is a word creation game.

* * * * *